US009192949B2

(12) United States Patent
Lang et al.

(10) Patent No.: US 9,192,949 B2
(45) Date of Patent: Nov. 24, 2015

(54) FLUID APPLICATION SYSTEM

(71) Applicant: S.C. Johnson & Son, Inc., Racine, WI (US)

(72) Inventors: Christopher F. Lang, Racine, WI (US); James R. Crapser, Racine, WI (US); Thomas A. Helf, New Berlin, WI (US); Jeffrey L. Crull, McFarland, WI (US); Evan A. Sparks, Madison, WI (US); Cunjiang Cheng, Madison, WI (US); Jonathan Mark Dalton, Marietta, GA (US); David Jackson Trettin, Atlanta, GA (US); Spencer Ralph Dodge, Stone Mountain, GA (US); Hee Seung Lim, Duluth, GA (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 14/015,691

(22) Filed: Aug. 30, 2013

(65) Prior Publication Data

US 2014/0061233 A1 Mar. 6, 2014

Related U.S. Application Data

(60) Provisional application No. 61/695,773, filed on Aug. 31, 2012.

(51) Int. Cl.
*B05B 7/04* (2006.01)
*B65D 51/00* (2006.01)
(Continued)

(52) U.S. Cl.
CPC ..... *B05B 7/0408* (2013.01); *B05B 11/0054* (2013.01); *B05B 11/0078* (2013.01);
(Continued)

(58) Field of Classification Search
CPC ..... B05B 11/0054; B05B 11/0078; B05B 11/3011; B05B 7/0408
USPC ..... 222/129.3, 136, 145.1, 145.5, 145.7, 222/464.4, 569, 570
See application file for complete search history.

(56) References Cited

U.S. PATENT DOCUMENTS 2,513,081 A 6/1950 Clark et al.
3,265,290 A * 8/1966 Cali ..... 415/190
(Continued)

FOREIGN PATENT DOCUMENTS

WO 9603341 A1 2/1996
WO WO 97/38796 A1 10/1997
(Continued)

OTHER PUBLICATIONS

PCT/US2013/057679 International Search Report and Written Opinion dated Apr. 11, 2014.
(Continued)

*Primary Examiner* — Paul R Durand
*Assistant Examiner* — Vishal Pancholi

(57) ABSTRACT

A fluid application system includes a diluent reservoir, a chemical container, a sprayer housing, a manifold located in the sprayer housing, and a pump assembly in fluid communication with an outlet of the manifold. The manifold includes a diluent inlet in fluid communication with the diluent reservoir, a chemical inlet in fluid communication with the container, a mixing chamber in fluid communication with the diluent inlet and the chemical inlet and the outlet of the manifold. The pump assembly draws a mixture of the chemical and the diluent from the manifold and sprays the mixture of the chemical and the diluent from the nozzle.

32 Claims, 37 Drawing Sheets

(51) Int. Cl.
*B65D 83/68* (2006.01)
*B05B 11/00* (2006.01)

(52) U.S. Cl.
CPC ..... *B05B11/3011* (2013.01); *B05B 11/3081* (2013.01); *B05B 11/3094* (2013.01); *B65D 51/00* (2013.01); *B65D 83/682* (2013.01); *B05B 11/0008* (2013.01); *B05B 11/0018* (2013.01); *B05B 11/3083* (2013.01)

(56) References Cited

U.S. PATENT DOCUMENTS

| | | | | |
|---|---|---|---|---|
| 3,786,963 | A | | 1/1974 | Metzler, III |
| 3,940,029 | A | | 2/1976 | Horvath |
| 4,056,216 | A | | 11/1977 | Kotuby |
| 4,355,739 | A | | 10/1982 | Vierkotter |
| 4,666,430 | A | | 5/1987 | Brown et al. |
| 5,009,342 | A | | 4/1991 | Lawrence et al. |
| 5,152,461 | A | * | 10/1992 | Proctor ..... 239/304 |
| 5,332,157 | A | | 7/1994 | Proctor |
| 5,402,916 | A | | 4/1995 | Nottingham et al. |
| 5,439,141 | A | | 8/1995 | Clark et al. |
| 5,560,545 | A | | 10/1996 | Grogan et al. |
| 5,562,250 | A | | 10/1996 | O'Neill |
| 5,711,457 | A | | 1/1998 | Wanbaugh et al. |
| 5,752,626 | A | | 5/1998 | Bachand |
| 5,769,275 | A | | 6/1998 | Boehmer et al. |
| 5,819,987 | A | | 10/1998 | Miller |
| 5,887,761 | A | | 3/1999 | Foster et al. |
| 5,890,624 | A | | 4/1999 | Klima et al. |
| 5,894,955 | A | | 4/1999 | Garrigues |
| 5,964,377 | A | | 10/1999 | Demarest et al. |
| 5,996,907 | A | | 12/1999 | Toetschinger et al. |
| 6,036,057 | A | | 3/2000 | Poutiatine |
| 6,145,695 | A | | 11/2000 | Garrigues |
| 6,158,673 | A | | 12/2000 | Toetschinger et al. |
| 6,279,836 | B1 | | 8/2001 | Toetschinger et al. |
| 6,311,875 | B1 | | 11/2001 | Anderson et al. |
| 6,394,364 | B1 | | 5/2002 | Abplanalp |
| 6,505,356 | B1 | | 1/2003 | Leonard et al. |
| 6,550,694 | B1 | | 4/2003 | Foster et al. |
| 6,722,389 | B2 | | 4/2004 | Stevens |
| 6,729,560 | B2 | | 5/2004 | Foster et al. |
| 6,732,757 | B2 | | 5/2004 | Benham |
| 6,843,390 | B1 | | 1/2005 | Bristor |
| 6,869,027 | B2 | | 3/2005 | Foster et al. |
| 6,978,914 | B2 | | 12/2005 | Furner et al. |
| 6,978,946 | B2 | | 12/2005 | Sweeton |
| 7,021,499 | B2 | | 4/2006 | Hansen et al. |
| 7,090,097 | B1 | | 8/2006 | Kazarian et al. |
| 7,118,012 | B2 | | 10/2006 | Butler |
| 7,246,755 | B2 | | 7/2007 | Hornsby et al. |
| 7,357,335 | B2 | | 4/2008 | Laidler et al. |
| D568,153 | S | | 5/2008 | Harrison et al. |
| D584,617 | S | | 1/2009 | Harrison et al. |
| 7,510,101 | B2 | | 3/2009 | Foster et al. |
| 7,565,988 | B2 | | 7/2009 | Foster |
| 7,593,790 | B2 | | 9/2009 | Valpey, III et al. |
| 7,757,970 | B2 | | 7/2010 | Laidler et al. |
| 7,775,401 | B2 | | 8/2010 | Banco et al. |
| 7,775,461 | B2 | | 8/2010 | Laidler et al. |
| 7,850,043 | B2 | | 12/2010 | Foster |
| 7,906,473 | B2 | | 3/2011 | Williams et al. |
| 7,938,299 | B2 | | 5/2011 | Fahy et al. |
| 7,959,041 | B2 | | 6/2011 | Miller et al. |
| 7,997,449 | B2 | | 8/2011 | Banco et al. |
| 8,113,227 | B2 | | 2/2012 | Adams et al. |
| 8,322,630 | B2 | | 12/2012 | Richardson et al. |
| 8,322,631 | B2 | | 12/2012 | Richardson et al. |
| 8,338,354 | B2 | | 12/2012 | Williams et al. |
| 8,348,098 | B2 | | 1/2013 | Bruckner |
| 8,439,232 | B2 | | 5/2013 | Laidler et al. |
| 2001/0025859 | A1 | | 10/2001 | Dumont |
| 2004/0000566 | A1 | * | 1/2004 | Lowry ..... 222/184 |
| 2007/0012723 | A1 | | 1/2007 | Laidler et al. |
| 2008/0029541 | A1 | * | 2/2008 | Wallace et al. ..... 222/129.3 |
| 2008/0073375 | A1 | | 3/2008 | Nelson et al. |
| 2008/0314928 | A1 | | 12/2008 | Banco et al. |
| 2009/0289025 | A1 | | 11/2009 | Mueller et al. |
| 2010/0090027 | A1 | | 4/2010 | Knopow et al. |
| 2010/0108779 | A1 | | 5/2010 | Filsouf |
| 2010/0206903 | A1 | | 8/2010 | Banco et al. |
| 2010/0282776 | A1 | | 11/2010 | Knopow et al. |
| 2011/0031271 | A1 | | 2/2011 | Foster |
| 2012/0091229 | A1 | | 4/2012 | Laidler et al. |
| 2012/0255973 | A1 | | 10/2012 | Schlueter et al. |
| 2013/0037575 | A1 | | 2/2013 | van der Molen |

FOREIGN PATENT DOCUMENTS

| | | | |
|---|---|---|---|
| WO | 03011474 | A1 | 2/2003 |
| WO | 2007143503 | A2 | 12/2007 |
| WO | 2008118446 | A2 | 10/2008 |
| WO | 2009020929 | A1 | 2/2009 |
| WO | 2010147657 | A2 | 12/2010 |
| WO | 2012066068 | A1 | 5/2012 |
| WO | 2013092021 | A1 | 6/2013 |

OTHER PUBLICATIONS

"Safe Link™ Adaptive Closed Loop™" undated brochure, DEMA Engineering Company, 16 pages.

* cited by examiner

FLUID APPLICATION SYSTEM

CROSS-REFERENCES TO RELATED APPLICATIONS

This application claims priority from U.S. Patent Application No. 61/695,773 filed Aug. 31, 2012.

STATEMENT REGARDING FEDERALLY SPONSORED RESEARCH

Not Applicable.

BACKGROUND OF THE INVENTION

1. Field of the Invention

The invention relates to a fluid application system for mixing a chemical with a diluent and spraying a mixture of the chemical and the diluent.

2. Description of the Related Art

Various spraying devices are known in which a chemical is mixed into a carrier fluid and then a mixture of the chemical and carrier fluid is sprayed through a nozzle. For example, U.S. Patent Application Publication No. 2010/0282776 describes a handheld device where a manual pump assembly draws diluent (e.g., water) from a reservoir and the diluent is moved through a venturi which draws liquid concentrate from a container into the diluent forming a diluted concentrate. The diluted concentrate is then sprayed through a nozzle.

What is needed is an alternative fluid application system that can accept a container having a concentrated chemical, create a mixture of the chemical and a diluent, and spray the diluted concentrate through a nozzle.

SUMMARY OF THE INVENTION

The foregoing needs can be met with a fluid application system according to the invention. The fluid application system mixes a chemical with a diluent and sprays a mixture of the chemical and the diluent.

In one embodiment, a fluid application system for mixing a chemical with a diluent and spraying a mixture of the chemical and the diluent is provided. The system comprises a sprayer housing, a diluent reservoir for holding the diluent, a chemical container for containing the chemical, a manifold located in the sprayer housing, and a pump assembly. The chemical container includes a chemical dip tube for delivering chemical to a valve in an opening of the chemical container, with the chemical dip tube being in fluid communication with a restriction orifice having a smaller inner diameter than an inner diameter of an adjacent section of the chemical dip tube. The valve has a closed position in which fluid flow is blocked from the opening of the container and the valve has an open position in which fluid can flow from the opening of the container. Further, the valve being moved from the closed position to the open position when the chemical container is attached to the sprayer housing.

The manifold located in the sprayer housing includes a diluent inlet in fluid communication with the diluent reservoir and a mixing chamber of the manifold. The manifold further includes a chemical inlet in fluid communication with the chemical dip tube and the mixing chamber and an outlet in fluid communication with the mixing chamber.

The pump assembly includes a pump chamber in fluid communication with the outlet of the manifold and draws a mixture of the diluent and the chemical into the pump assembly from the outlet of the manifold. Further, the pump assembly then expels the mixture of the diluent and chemical from a nozzle for spraying the mixture of the chemical and the diluent.

In other aspects, the restriction orifice is attached at an intake end of the chemical dip tube. The pump assembly includes a pump chamber in fluid communication with the outlet of the manifold. Further, the pump assembly includes a piston positioned in the pump chamber, whereby the piston alternatingly increases and decreases head space in the pump chamber to draw the mixture of the diluent and the chemical into the pump chamber from the outlet of the manifold and expel the mixture of the diluent and chemical from the nozzle for spraying the mixture of the chemical and the diluent.

In further aspects, each stroke of the piston expels about 0.8 to 1.6 milliliters of the mixture of the diluent and chemical from the nozzle. The sprayer housing may include a source of electricity in electrical communication with a motor for driving the piston. The mixture of the chemical and the diluent has a ratio of chemical to diluent of 1:1 to 1:1200 and/or 1:16 to 1:256. In some systems, the variability of the ratio is ±10% when operating the pump assembly.

In different aspects, the sprayer housing comprises an attachment mechanism for attaching the chemical container to the sprayer housing, whereby the attachment mechanism includes a moveable collar suitable for engaging a hollow outlet of a closure of the chemical container. The diluent reservoir and the chemical container have mating features that align the moveable collar and the hollow outlet of the closure of the chemical container when attaching the chemical container to the sprayer housing. Further, a one-way valve is located in or adjacent the opening of the chemical container, whereby the one-way valve prevents flow upstream toward the restriction orifice. In an alternative different aspect, a one-way valve is located in or adjacent an opening of the diluent reservoir, whereby the one-way valve prevents flow upstream toward an intake end of a diluent dip tube in the diluent reservoir.

In still different aspects, the chemical container includes a mounting cup that is attached to an opening of the chemical container. The valve includes a valve body and a valve stem, whereby the valve body is attached to the mounting cup to define a closed space between the valve body and the mounting cup. The valve stem has a first end arranged in the closed space and a second end extending out of the mounting cup on a side opposite the closed space. The valve stem further has a flow passageway in fluid communication with an exit opening of the valve stem and a stem orifice in a wall of the valve stem. When the valve is in the closed position, fluid flow is blocked from the closed space into the stem orifice. When the valve is in the open position, fluid can flow from the closed space through the stem orifice and into the flow passageway.

In other aspects, the chemical container includes a stem gasket that blocks fluid flow from the closed space into the stem orifice when the valve is in the closed position. The valve body has an entry orifice in fluid communication with the closed space and the restriction orifice is located in the entry orifice. Further, the restriction orifice has a converging inner wall surface. The restriction orifice may have an inner diameter in the range of 0.07 millimeters to 0.7 millimeters (0.003 to 0.028 inches) and/or is defined by a wall that extends inwardly from an inner surface of the entry orifice.

In yet other aspects, the valve includes a biasing element for biasing the valve stem into the closed position. The wall of the valve stem includes a plurality of stem orifices spaced around the wall of the valve stem, the plurality of stem orifices being in fluid communication with the flow passageway of the valve stem. Further, the valve includes a stem gasket that blocks fluid flow from the closed space into the plurality of stem orifices when the valve is in the closed position.

Further, the mounting cup of the chemical container includes a one-way valve that permits ambient air to enter the chemical container to displace chemical dispensed therefrom. The one-way valve is radially spaced from the valve body and/or maintains pressure in the chemical container at approximately ambient pressure outside of the chemical container. In another embodiment, the mounting cup of the chemical container includes a two-way valve, the two-way valve permitting ambient air to enter the chemical container to displace chemical dispensed therefrom and permitting gas generated by the chemical to exit the chemical container. In some embodiments, the two-way valve comprises a duckbill section for permitting ambient air to enter the chemical container to displace chemical dispensed therefrom and a skirt section for permitting gas generated by the chemical to exit a valve seat flow hole in the chemical container. In another embodiment, the mounting cup of the chemical container includes a valve that permits ambient air to enter the chemical container to displace chemical dispensed therefrom and that prevents liquids from exiting the chemical container. The valve may comprise a porous polymeric membrane.

In other aspects, the sprayer housing includes an actuator body in fluid communication with the chemical inlet of the manifold. The actuator body has an entry port dimensioned to engage the valve stem and move the valve to the open position when the chemical container is attached to the sprayer housing. The actuator body includes a one-way valve located in an inner space of the actuator body to prevent flow upstream toward the valve stem. The one-way valve can comprise an umbrella valve. In some aspects, the one-way valve comprises an umbrella valve and a valve seat, whereby a sealing surface of the valve seat has a section protruding toward an underside of a skirt of the umbrella valve.

In another embodiment, the sprayer housing includes a valve body in fluid communication with the diluent inlet of the manifold, whereby the valve body includes a one-way valve located in an inner space of the valve body. The one-way valve prevents flow upstream toward the diluent reservoir. The one-way valve comprises an umbrella valve. In some embodiments, the one-way valve comprises an umbrella valve and a valve seat, whereby a sealing surface of the valve seat has a section protruding toward an underside of a skirt of the umbrella valve. In a different aspect, a flow adjustor is located in the manifold, whereby the flow adjustor is structured to vary an amount of flow through the chemical inlet.

In still further embodiments, the chemical container has a convex outer wall and the diluent reservoir has a concave wall section for receiving the convex outer wall of the chemical container. It is contemplated that the chemical container comprises a flexible bag, the chemical dip tube being in fluid communication with the valve and an interior space defined by the bag with the valve being in fluid communication with the chemical inlet of the manifold. In some embodiments, when diluent is depleted from the diluent reservoir, chemical is not dispensed from the chemical container.

In a different embodiment, a system for spraying comprises a diluent reservoir for holding a diluent, a chemical container for containing a chemical, and a manifold including a mixing chamber. The manifold includes a diluent inlet in fluid communication with the diluent reservoir and the mixing chamber. The manifold further includes a chemical inlet in fluid communication with the chemical container and the mixing chamber. Further, the manifold includes an outlet in fluid communication with the mixing chamber. The system may further comprise a pump in fluid communication with the outlet of the manifold for drawing a mixture of the diluent and the chemical from the outlet of the manifold and then expelling the mixture of the diluent and chemical from a nozzle for spraying the mixture of the chemical and the diluent. Even further, the system provides a diluent flow conduit having a first end in fluid communication with the diluent reservoir and a second end in fluid communication with the diluent inlet of the manifold and a chemical flow conduit having a first end in fluid communication with the chemical container and a second end in fluid communication with the chemical inlet of the manifold. The system further comprises a diluent metering device for creating a diluent pressure differential between the first end of the diluent flow conduit and the second end of the diluent flow conduit and a chemical metering device for creating a chemical pressure differential between the first end of the chemical flow conduit and the second end of the chemical flow conduit. It is contemplated that the mixture of the chemical and the diluent has a ratio of chemical to diluent of 1:1 to 1:300, whereby a flow rate of the mixture downstream of the outlet of the manifold is in the range of about 0.5 to about 3.5 milliliters per second. In a particular aspect, the diluent pressure differential is in the range of about −0.5 psi to about −2.5 psi and the chemical pressure differential is in the range of about 0 psi to about −2.5 psi.

In some embodiments, the diluent metering device comprises a valve located in the diluent flow conduit, whereby the valve has a cracking pressure in the range of greater than 0 to 1 psi. The valve may comprise an umbrella valve. Further, the diluent metering device comprises a vent valve in fluid communication with an interior space of the diluent reservoir, whereby the vent valve has a cracking pressure in the range of 0 to −1 psi. The vent valve may comprise a duckbill valve. Even further, the chemical metering device comprises a valve located in the chemical flow conduit, whereby the valve has a cracking pressure in the range of greater than 0 to 1 psi. The valve may comprise an umbrella valve. In a different embodiment, the chemical metering device comprises a vent valve in fluid communication with an interior space of the chemical container, whereby the vent valve has a cracking pressure in the range of 0 to −1 psi. The vent valve may comprise a duckbill valve. In some aspects, the chemical metering device comprises a capillary tube. In other aspects, the chemical metering device comprises a valve in an opening of the chemical container, whereby the valve includes a valve body having an entry orifice and a restriction orifice located in the entry orifice. The restriction orifice has a smaller inner diameter than an inner diameter of an adjacent section of the entry orifice. The restriction orifice has an inner diameter in the range of 0.07 millimeters to 0.7 millimeters (0.003 to 0.028 inches).

In another embodiment, a sprayer system comprises a sprayer head having a nozzle for emitting a product, at least two reservoirs holding constituent components of the product, and a gripping portion having a proximal end adjacent the at least two reservoirs and a distal end adjacent the sprayer head. Emission of the product results in the depletion of the components of one of the reservoirs to a greater extent than the remaining at least one reservoir. Further, emission of the product results in a change in the center of gravity of the sprayer system. During use, the center of gravity of the sprayer system translates toward the reservoir that exhibits less of a depletion of its constituent components than the remaining at least one reservoir.

In other embodiments, the sprayer system includes first and second reservoirs, wherein the first reservoir exhibits a greater depletion of the constituent components thereof than the constituent components in the second reservoir upon emission of the product. The first reservoir includes a center of gravity Cg1 and the second reservoir includes a center of gravity Cg2. The proximal end of the gripping portion is located closer to the center of gravity Cg2 of the second reservoir than the center of gravity Cg1 of the first reservoir. Further, the proximal end of the gripping portion is provided between the center of gravity Cg1 of the first reservoir and the center of gravity Cg2 of the second reservoir.

In some embodiments, the first and second reservoirs are disposed adjacent to one another, whereby an outermost portion of a wall of the first reservoir and an outermost portion of a wall of the second reservoir define a straight line linear distance of X that is perpendicular to opposing parallel lines extending along the outermost portions of the walls of the first and second reservoirs. The first reservoir exhibits a greater depletion of the constituent components thereof than the constituent components in the second reservoir upon emission of the product. Further, the first reservoir is provided adjacent a front side of the sprayer system and the second reservoir is provided adjacent a rear side of the sprayer system, and a portion of the proximal end of the gripping portion that is closest to the front side is positioned at a point at least greater than 0.5× as measured from the front side toward the rear side.

Further, it is contemplated that the first reservoir is provided adjacent a front side of the sprayer system and the second reservoir is provided adjacent a rear side of the sprayer system, and wherein a portion of the proximal end of the gripping portion that is closest to the front side is positioned at a point at least about (⅝)*X as measured from the front side toward the rear side. A first reservoir includes a weight of the constituent components represented by the value X1 in a full, pre-use state and a second reservoir includes a weight of the constituent components represented by the value Y in a full, pre-use state, and wherein during a use state the percent change in weight of the constituent components of the first and second reservoirs may be expressed by the equation % ΔX1>% ΔY.

In another aspect, a first reservoir includes a weight of the constituent components represented by the value X1 in a full, pre-use state and a second reservoir includes a weight of the constituent components represented by the value Y in a full, pre-use state, and during a use state the weight of the constituent components of the first and second reservoirs may be expressed by the equation X1<Y. In still another aspect, a first reservoir includes a weight and volume of the constituent components represented by the values X1 and V, respectively, in a full, pre-use state and a second reservoir includes a weight and volume of the constituent components represented by the values Y and W, respectively, in a full, pre-use state, and w the constituent components of the first and second reservoirs after the emission of the product during a use state may be characterized by the following: X1<Y and/or V<W.

In still another embodiment, a first reservoir includes a weight and volume of the constituent components represented by the values X1 and V, respectively, in a full, pre-use state and a second reservoir includes a weight and volume of the constituent components represented by the values Y and W, respectively, in a full, pre-use state, and the percent change of the constituent components of the first and second reservoirs after the emission of the product during a use state may be characterized by the following: %ΔX 1>% ΔY and/or % ΔV>%ΔW. Further, it is contemplated that a first reservoir includes a volume of the constituent components represented by the value V in a full, pre-use state and a second reservoir includes a volume of the constituent components represented by the value W in a full, pre-use state, wherein during a single use of the sprayer system the emitted product comprises a volume V1 of the constituent components of the first reservoir and a volume W1 of the constituent components of the second reservoir, wherein V1>W1. In some aspects, V1 is at least 10 times greater than W1. In an alternative aspect, V1 is at least 30 times greater than W1.

It is contemplated that the at least two reservoirs are provided within a single container. Alternatively, the at least two reservoirs comprise at least two separate containers. Further, it is contemplated that the first and second reservoirs are disposed adjacent to one another and/or are juxtaposed with one another. The at least two reservoirs have sidewalls with complementary shapes that nest with one another. In a different embodiment, the at least two reservoirs have sidewalls with a similar geometry or have sidewalls with a different geometry.

In yet another embodiment, a sprayer system comprises a sprayer head having a nozzle for emitting a product, first and second reservoirs holding constituent components of the product, a neck having a distal end adjacent the sprayer head and a proximal end adjacent, and a retention structure for holding the first and second containers and/or the first and second containers. Spraying of the system results in a dynamic imbalance of same, in which one of the first and second reservoirs discharges the constituent components thereof at a faster rate than the other reservoir. Further, a user gripping the neck and holding their wrist parallel to a planar floor surface results in a torque about the user's wrist of greater than about 0 kg/m and less than about 0.040 kg/m in a full pre-use state and a torque about the user's wrist that equals 0 kg/m during a use state.

It is contemplated that the proximal end of the neck is positioned to a greater extent over portions of the one of the first and second reservoirs that discharges the constituent components at a slower rate than the other reservoir. The proximal end of the neck is completely positioned over the one of the first and second reservoirs that discharges the constituent components at a slower rate than the other reservoir. Further, the first and second reservoirs are disposed adjacent to one another, and wherein an outermost portion of a wall of the first reservoir and an outermost portion of a wall of the second reservoir define a straight line linear distance of X that is perpendicular to opposing parallel lines extending along the outermost portions of the walls of the first and second reservoirs. The first reservoir is provided adjacent a front side of the sprayer system and the second reservoir is provided adjacent a rear side of the sprayer system, and wherein a portion of the proximal end of the neck that is closest to the front side is positioned at a point at least greater than 0.5× as measured from the front side toward the rear side. In some embodiments, the first reservoir is provided adjacent a front side of the sprayer system and the second reservoir is provided adjacent a rear side of the sprayer system, and wherein a portion of the proximal end of the neck that is closest to the front side is positioned at a point at least about (⅝)*X as measured from the front side toward the rear side.

In another embodiment, a container for retaining a non-pressurized product comprises a reservoir holding a non-pressurized product, a valve assembly provided within an upper end of the reservoir. The valve assembly includes a product intake conduit and a spring biased valve stem in fluid communication with the product intake conduit, wherein the spring is provided within an interior of the reservoir. The container further includes a dip tube in fluid communication with the product intake conduit.

In another embodiment, a container for a chemical that is introduced into a sprayer housing comprises a body and a hollow neck forming an opening of the container, a mounting cup secured in the opening of the container, a valve body attached to the mounting cup thereby defining a closed space between the valve body and the mounting cup, and a valve stem having a first end arranged in the closed space and having a second end extending out of the mounting cup on a side opposite the closed space. The valve stem has a flow passageway in fluid communication with an exit opening of the valve stem and a stem orifice in a wall of the valve stem. The container further includes a valve that permits ambient air to enter the container to displace chemical dispensed therefrom. Further, the valve stem has a closed position in which fluid flow is blocked from the closed space into the stem orifice and has an open position in which fluid can flow from the closed space through the stem orifice and into the flow passageway.

The container further includes a stem gasket that blocks fluid flow from the closed space into the stem orifice when the valve stem is in the closed position. The valve body has an entry orifice in fluid communication with the closed space and a restriction orifice is located in the entry orifice. The restriction orifice has a converging inner wall surface. The restriction orifice has an inner diameter in the range of 0.07 millimeters to 0.7 millimeters (0.003 to 0.028 inches). Further, the restriction orifice is defined by a wall that extends inwardly from an inner surface of the entry orifice. The container includes a biasing element for biasing the valve stem into the closed position. Further, the wall of the valve stem includes a plurality of stem orifices spaced around the wall of the valve stem, the plurality of stem orifices being in fluid communication with the flow passageway of the valve stem. The container also includes a stem gasket that blocks fluid flow from the closed space into the plurality of stem orifices when the valve stem is in the closed position. In some embodiments, the valve is a one-way valve positioned in a wall of the mounting cup, whereby the valve is radially spaced from the valve body The valve is a one-way valve that maintains pressure in the container at approximately ambient pressure outside of the container, the one-way valve being positioned in a wall of the mounting cup. In a different embodiment, the valve is a two-way valve, the two-way valve permitting ambient air to enter the container to displace chemical dispensed therefrom and permitting gas generated by the chemical to exit the container, the two-way valve being positioned in a wall of the mounting cup. The two-way valve comprises a duckbill section for permitting ambient air to enter the container to displace chemical dispensed therefrom and a skirt section for permitting gas generated by the chemical to exit a valve seat flow hole in the mounting cup. It is contemplated that the valve also prevents liquids from exiting the container. The valve comprises a porous polymeric membrane. Further, a dip tube extends into the container, the dip tube being dimensioned to engage an entry orifice of the valve body in a sealing fit. The valve stem is dimensioned to engage an actuator body of the sprayer housing. The mounting cup includes a wall extending away from the side of the mounting cup, the wall of the mounting cup including a flange extending radially outward from an end of the wall of the mounting cup. In one embodiment, when the valve stem is in the open position, the second end of the valve stem is located at a position on a longitudinal axis of the mounting cup plus or minus four millimeters from a plane transverse to a bottom of the flange of the mounting cup.

In a different embodiment, a container is adapted to connect to a sprayer assembly structured to spray a mixture of chemical and diluent at a ratio of chemical to diluent of 1:1 to 1:300 at a mixture flow rate in the range of about 0.5 to about 3.5 milliliters per second. The container comprises a reservoir holding a non-pressurized product, a valve assembly secured to an upper end of the reservoir, the valve assembly including a chemical flow conduit and a spring biased valve stem in the chemical flow conduit, the chemical flow conduit having a first end in fluid communication with an interior space of the reservoir and a second end at an opening of the valve stem, and a chemical metering device for creating a chemical flow rate in the chemical flow conduit, the chemical flow rate being in the range of about 0.008 milliliters/second to about 1.05 milliliters/second. The chemical flow rate is measured at the opening of the valve stem. The chemical metering device comprises a vent valve in fluid communication with an interior space of the reservoir, the vent valve having a cracking pressure in the range of 0 to −1 psi. The vent valve comprises a duckbill valve. Further, the chemical metering device comprises a capillary tube and/or a dip tube.

In other embodiments, the chemical metering device comprises a valve body having an entry orifice and a restriction orifice is located in the entry orifice, the restriction orifice having a smaller inner diameter than an inner diameter of an adjacent section of the entry orifice, the valve stem being positioned in the valve body. The restriction orifice has an inner diameter in the range of 0.07 millimeters to 0.7 millimeters (0.003 to 0.028 inches).

In yet another embodiment, a container for retaining a non-pressurized product comprises a reservoir holding a non-pressurized product and a valve assembly provided within an upper end of the reservoir, wherein the valve assembly includes a product intake conduit and a spring biased valve stem in fluid communication with the product intake conduit, wherein the product intake conduit includes a flow restrictor. The product intake conduit further includes a product dip tube in fluid communication therewith. The flow restrictor includes a conduit that is coaxially aligned with a channel of the product dip tube. The flow restrictor conduit comprises a capillary tube having a non-converging flow channel and a converging flow channel. In an aspect, the non-converging flow channel has a length of between about 5.0 millimeters (mm) to about 10.0 mm. The non-converging flow channel is at least 7.7 mm in length and at least 1.5 mm in diameter and the converging flow channel is at least 0.50 mm in length that converges toward a secondary non-converging flow channel that is at least 0.25 mm in length and at least 0.40 mm in diameter.

In still another aspect, the axial length of the non-converging flow channel as compared to the axial length of the converging flow channel provided in a ratio of between about 12.5 to about 13.5. A cross-sectional area AN of the non-converging channel as compared to the smallest cross-sectional area AC of the converging channel is provided in a ratio AN/AC of between about 10.0 to about 15.0. The flow restrictor defines a conduit having an exit portal with a channel area AX and an entry portal with a channel area AT, wherein $AX/AT<1$.

In another embodiment, a kit comprises a first container containing a first chemical, the valve body of the first container having a first entry orifice in fluid communication with the closed space of the first container, the first entry orifice having a first restriction orifice located in the first entry orifice. The kit further comprises second container containing a second chemical, the valve body of the second container having a second entry orifice in fluid communication with the closed space of the second container, the second entry orifice having a second restriction orifice located in the second entry orifice. The first restriction orifice has a different transverse area than the second restriction orifice. The first chemical and the second chemical are different.

In another embodiment, a valve assembly for a container comprises a mounting element, a valve body attached to the mounting element thereby defining a closed space between the valve body and the mounting element, the valve body having an entry orifice in fluid communication with the closed space, and the valve body having a restriction orifice located in the entry orifice, and a valve stem having a first end arranged in the closed space and having a second end extending out of the mounting element on a side opposite the closed space, the valve stem having a flow passageway in fluid communication with an exit opening of the valve stem and a stem orifice in a wall of the valve stem. The valve stem has a closed position in which fluid flow is blocked from the closed space into the stem orifice. The valve stem has an open position in which fluid can flow from the closed space through the stem orifice and into the flow passageway. A stem gasket blocks fluid flow from the closed space into the stem orifice when the valve stem is in the closed position. In another aspect of the valve assembly, the restriction orifice has a converging inner wall surface. The restriction orifice has an inner diameter in the range of 0.07 millimeters to 0.7 millimeters (0.003 to 0.028 inches). Further, the restriction orifice is defined by a wall that extends inwardly from an inner surface of the entry orifice.

The valve assembly further comprises a biasing element for biasing the valve stem into the closed position. The wall of the valve stem includes a plurality of stem orifices spaced around the wall of the valve stem, the plurality of stem orifices being in fluid communication with the flow passageway of the valve stem, and the valve assembly includes a stem gasket that blocks fluid flow from the closed space into the plurality of stem orifices when the valve stem is in the closed position. The valve assembly may further comprise a one-way valve positioned in a wall of the mounting element. The one-way valve is radially spaced from the valve body. A valve positioned in a wall of the mounting element allows gases to pass through the valve and the valve preventing liquids from passing through the valve. Further, the valve comprises a porous polymeric membrane. In another embodiment, a two-way valve is positioned in a wall of the mounting element. The two-way valve comprises a central duckbill section and a skirt section that covers a valve seat flow hole in the mounting element. Further, the mounting element includes a wall extending away from the side of the mounting element, the wall of the mounting element includes a flange extending radially outward from an end of the wall of the mounting element.

In yet another embodiment, a method for spraying at least two different mixtures of one or more chemicals comprises providing a fluid application system having a sprayer housing and a diluent reservoir, whereby the diluent reservoir stores a diluting liquid, operatively engaging a first chemical container to the sprayer housing, whereby the first chemical container has a first restriction orifice and storing a first chemical, and activating the sprayer housing to spray a first mixture of the first chemical and the diluting liquid. The method further comprises operatively disengaging the first chemical container from the sprayer housing, operatively engaging a second chemical container to the sprayer housing, the second chemical container having a second restriction orifice and storing a second chemical, and activating the sprayer housing to spray a second mixture of the second chemical and the diluting liquid. The first restriction orifice and the second restriction orifice allow different quantities of chemicals to pass through.

In some embodiments, the first chemical and the second chemical are different. The first mixture has a first chemical to diluting liquid mix ratio and the second mixture has a second chemical to diluting liquid mix ratio, wherein the first mix ratio and the second mix ratio are different.

The fluid application system provides a means for dispensing concentrated formula at a reduced, but predetermined, level of chemical concentration. The fluid application system can automatically blend a diluent with a concentrated formula to achieve proper performance.

The fluid application system can accurately blend two products by means of displacement via system of conduit, metering orifices and check valves.

The fluid application system incorporates a fluid transfer model that is designed to (1) deliver a pre-determined amount of concentrate mixed with a given amount of diluent (target ratio) (2) by using a displacement pump ranging from 0.8-1.6 grams displacement pump and a (3) pre-disposed metering orifice.

The fluid application system uses a refill in the form of a replaceable vessel that is constructed to manage the contents to provide proper flow of product and venting of the headspace throughout the life of the refill. The refill protects the contents from user intervention by incorporating an aerosol-type valve as a closing device. The valve incorporates a metering orifice so that every refill is automatically distributed at the correct dilution. The valve incorporates a means for replacing headspace at-or-greater-than the rate at which the concentrate is removed. The valve incorporates a means for eliminating "bottle paneling" due to concentrate reaction with head-space. The valve automatically vents headspace should formula release gas, such as a gas released from hydrogen peroxide.

The refill valve architecture provides means of attachment/release as well as ensure communication link between the displacement device and refill contents. The refill accommodates a single-direction means of retention with mechanical means of refill release for replacement. The refill provides a docking system that insures a liquid-tight communication link to a formula. The refill incorporates variable tension means that communicate docking is complete, ensures that seal surfaces remain intact and serve as means of disengagement when the refill requires replacement.

These and other features, aspects, and advantages of the present invention will become better understood upon consideration of the following detailed description and drawings.

BRIEF DESCRIPTION OF THE DRAWINGS

Like reference numerals will be used to refer to like parts from Figure to Figure in the following detailed description.

DETAILED DESCRIPTION OF THE INVENTION

Figure 1:
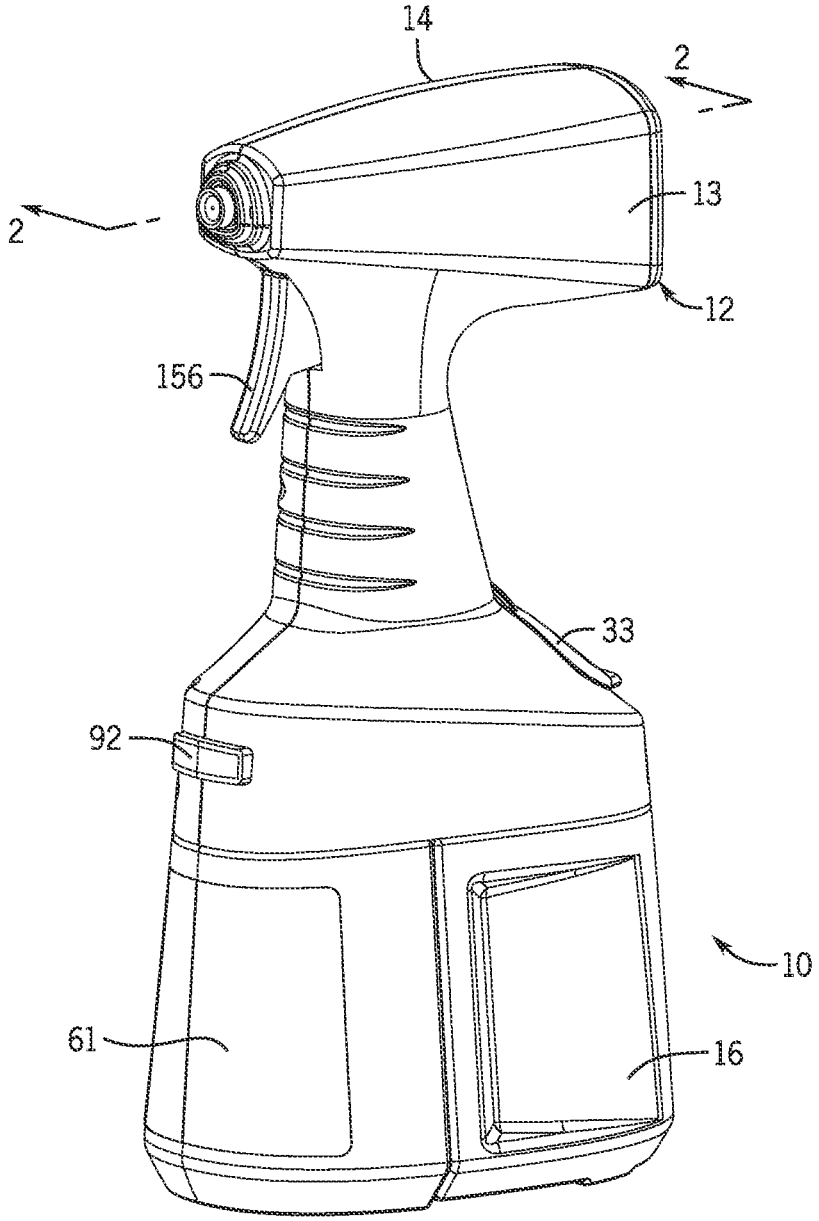
FIG. 1 is a top, right, front perspective view of one embodiment of a fluid application system in accordance with the invention.

Looking at FIGS. 1 to 7, there is shown an example embodiment of a fluid application system 10 according to the invention. The fluid application system 10 includes a sprayer housing 12 having a first shell 13 and a second shell 14 that can be fastened together with screws or another suitable fastening device. The sprayer housing 12 surrounds a sprayer assembly 110 that will be described in detail below.

The fluid application system 10 includes a diluent reservoir 16 which in one non-limiting version holds about sixteen fluid ounces. Water is the preferred diluent, but any other fluid suitable for diluting a concentrated liquid chemical can be used as the diluent. The diluent reservoir 16 can be formed from a suitable material such as polymeric material (e.g., polyethylene or polypropylene). The diluent reservoir 16 has an outlet neck 17 that terminates in a peripheral flange 18. A diluent reservoir cap 20 having an outer circular wall 21 with an inner lower rib 22 is installed on the neck 17 of the diluent reservoir 16 with the rib 22 engaging the flange 18 of the cap 20. The diluent reservoir cap 20 has a central well 24 that is in fluid communication with an inlet port 25 of the diluent reservoir cap 20. A dip tube holder 26 is press fit over the end of the inlet port 25. A one way valve, which is duckbill valve 28 in this embodiment, is positioned between the well 24 and the dip tube holder 26. A diluent dip tube 29 is press fit into the dip tube holder 26. The duckbill valve 28 allows fluid flow from the diluent dip tube 29 toward the well 24, and prevents flow from the well 24 back toward the diluent dip tube 29. Alternative one way valves are also suitable for use in the dip tube holder 26 such as a ball valve. It is contemplated that the one way valve is located in or adjacent an opening of the diluent reservoir 16 to prevent flow upstream toward an intake end of the diluent dip tube 29 in the diluent reservoir 16.

The diluent reservoir 16 has a fill opening 31 that allows the diluent reservoir 16 to be refilled with diluent. A refill cap 33 covers the fill opening 31 after refilling. A vent opening 34 is located in the refill cap 33, and an umbrella valve 35 controls venting from the interior of the diluent reservoir 16 to ambient atmosphere. The diluent reservoir 16 has outer wall 36 with a protruding ridge 37.

A fluid manifold 40 is located within the sprayer housing 12 of the fluid application system 10. The manifold 40 has a main body 42 that defines a mixing chamber 43. The manifold 40 has an outlet port 44 that is in fluid communication with the mixing chamber 43 and a mixed fluid supply conduit 45. A fluid stream comprising a mixture of the diluent and chemical is provided from the manifold to the mixed fluid supply conduit 45 to a sprayer assembly as described below.

Figure 4:
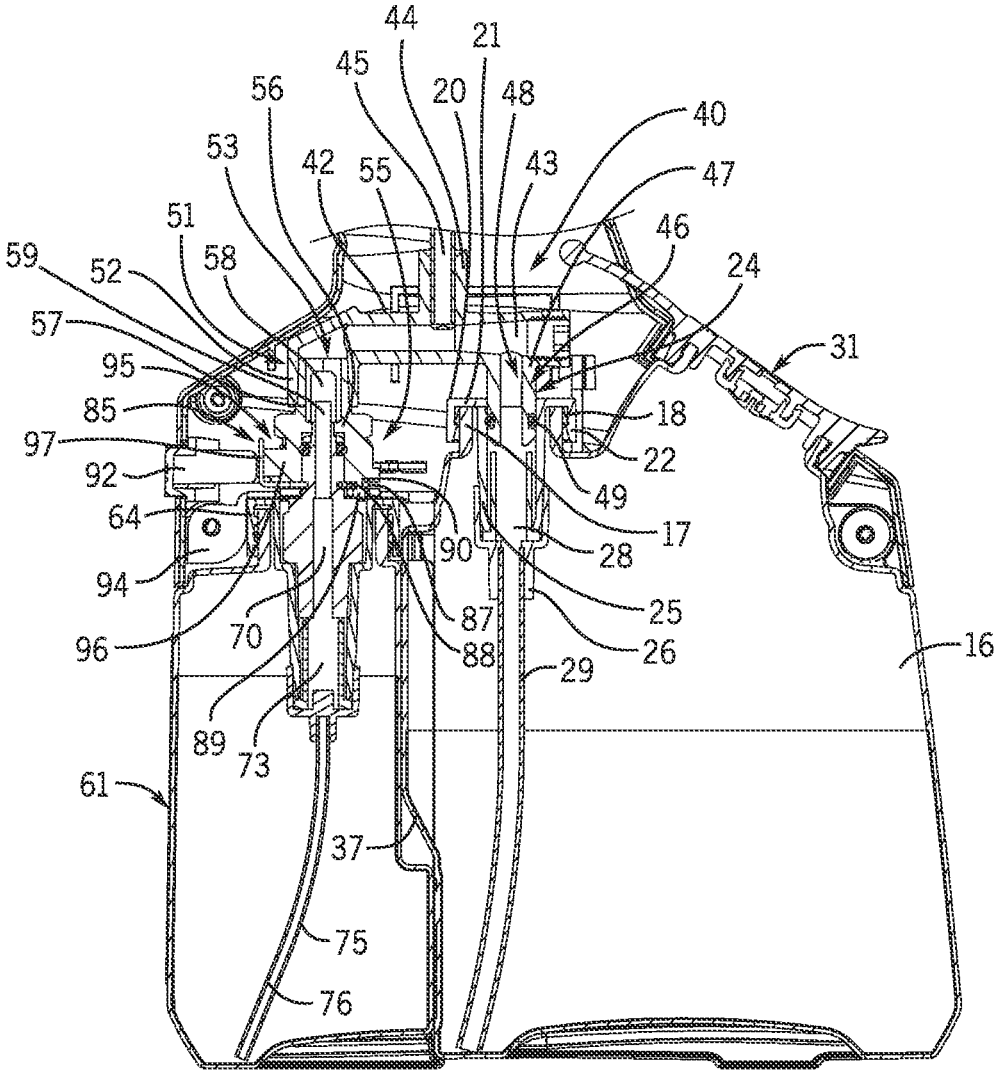
FIG. 4 is a detailed cross-sectional view of the manifold, diluent reservoir, and chemical concentrate container of the fluid application system of FIG. 1 taken along line 4-4 of FIG. 2.
Figure 5:
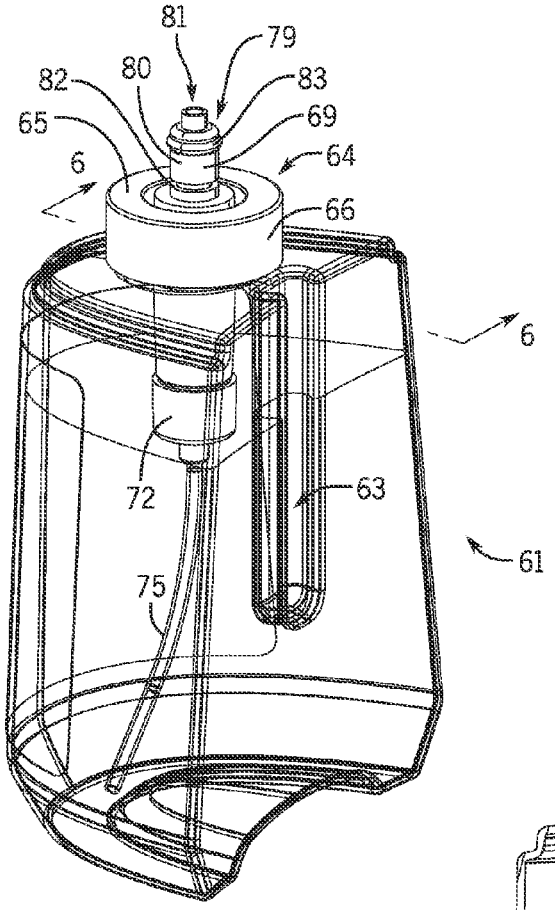
FIG. 5 is a right, rear perspective view of the chemical concentrate container of the fluid application system of FIG. 1.
Figure 6:
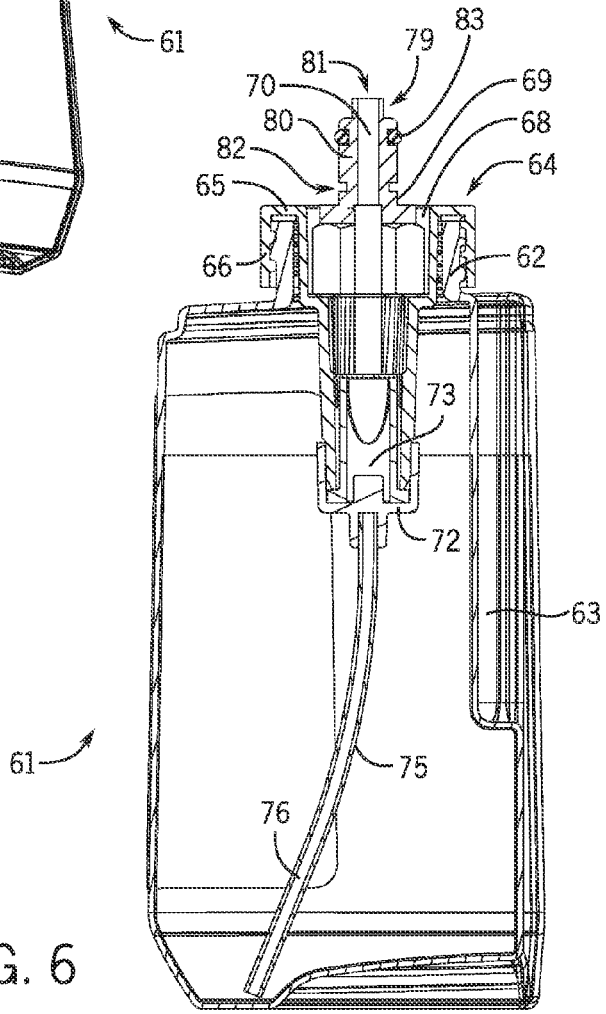
FIG. 6 is a cross-sectional view of the chemical concentrate container of the fluid application system taken along line 6-6 of FIG. 5.

The manifold 40 has a diluent inlet port 46 having a cylindrical outer wall 47 that defines a diluent inlet 48 of the manifold 40. An O-ring 49 is provided on the outside of the outer wall 47 of the diluent inlet port 46. As shown in FIG. 4, the diluent inlet port 46 is assembled in the well 24 of the diluent reservoir cap 20 with the O-ring 49 providing a seal thereby placing the inlet port 25 of the diluent reservoir cap 20 in fluid communication with the diluent inlet 48 of the manifold 40.

The manifold 40 also has a chemical inlet port 51 in fluid communication with the mixing chamber 43. The chemical inlet port 51 has an outer wall 52 that defines a chemical inlet 53 of the manifold 40. A valve body 55 is assembled into the chemical inlet port 51. The valve body 55 has an inwardly protruding wall 56 that supports a spring-biased valve stem 57 having a central passageway 58 with a slit 59 that allows for fluid flow from the central passageway 58 to the chemical inlet 53 of the manifold 40 when the slit 59 is uncovered by upward movement of the valve stem 57.

The fluid application system 10 includes a chemical concentrate container 61 which in one non-limiting version holds about six fluid ounces. The concentrate can be selected such that when the concentrate is diluted with the diluent, any number of different fluid products is formed. Non-limiting example products include general purpose cleaners, kitchen cleaners, bathroom cleaners, dust inhibitors, dust removal aids, floor and furniture cleaners and polishes, glass cleaners, anti-bacterial cleaners, fragrances, deodorizers, soft surface treatments, fabric protectors, laundry products, fabric cleaners, fabric stain removers, tire cleaners, dashboard cleaners, automotive interior cleaners, and/or other automotive industry cleaners or polishes, or even insecticides. The chemical concentrate container 61 can be formed from a suitable material such as polymeric material (e.g., polyethylene or polypropylene), and in certain embodiments, the chemical concentrate container 61 comprises a transparent material that allows the user to check the level of chemical concentrate in the chemical concentrate container 61. It should be appreciated that the term "chemical" when used to describe the concentrate in the chemical concentrate container 61 can refer to one compound or a mixture of two or more compounds.

The chemical concentrate container 61 has an externally threaded outlet neck 62. A closure cap 64 is threaded onto the neck 62 of the chemical concentrate container 61. The closure cap 64 has an upper wall 65, and a skirt 66 that extends downward from the upper wall 65. The closure cap 64 has a well 68 that extends downward from the upper wall 65. A closure cap inlet port 69 defines a concentrate inlet 70 that is in fluid communication with the well 68.

A dip tube holder 72 is press fit over the end of the closure cap inlet port 69. A one way valve, which is duckbill valve 73 in this embodiment, is positioned between the well 68 and the dip tube holder 72. A chemical dip tube 75 is press fit into the dip tube holder 72. The duckbill valve 73 allows fluid flow from the chemical dip tube 75 toward the well 68, and prevents flow from the well 68 back toward the chemical dip tube 75. Alternative one way valves are also suitable for use in the dip tube holder 72 such as a ball valve. It is contemplated that the one way valve is located in or adjacent an opening of the chemical concentrate container 61 to prevent flow upstream toward the restriction orifice 76.

The bottom end, or intake end, of the chemical dip tube 75 has a restriction orifice 76 that is press fit into the chemical dip tube 75. The restriction orifice 76 has a smaller inner diameter than the inner diameter of an adjacent section of the chemical dip tube 75. The restriction orifice 76 can be of various throughhole inner diameters to provide a metering function. It can be appreciated that any number of different chemical dip tubes 75 with a restriction orifice 76 can be provided with the chemical concentrate container 61 for achieving different chemical to diluent mix ratios. For example, a first chemical concentrate container containing a first chemical can have a dip tube in fluid communication with a restriction orifice having a first throughhole inner diameter in the chemical concentrate container to achieve a chemical to diluent mix ratio of 1:5. A second chemical concentrate container containing a second chemical can have a dip tube in fluid communication with a restriction orifice having a throughhole inner diameter of a second smaller size to achieve a chemical to diluent mix ratio of 1:15. A third chemical concentrate container containing a third chemical can have a dip tube in fluid communication with a restriction orifice having a throughhole inner diameter of a third smaller size to achieve a chemical to diluent mix ratio of 1:32. A fourth chemical concentrate container containing a fourth chemical can have a dip tube in fluid communication with a restriction orifice having a throughhole inner diameter of a fourth smaller size to achieve a chemical to diluent mix ratio of 1:64. Of course, other chemical to diluent mix ratios in the range of 1:1 to 1:1200, 1:1 to 1:100, or 1:16 to 1:256 can be achieved. Further, it is contemplated that variability of the chemical to diluent mix ratio is plus or minus about 10 percent when operating the pump assembly.

A closure cap outlet port 79 is press fit into the well 68 of the closure cap 64. The closure cap outlet port 79 has an outer wall 80 that defines a concentrate outlet 81. There is a groove 82 in the outer wall 80 of the closure cap outlet port 79, and an external O-ring 83 is located on the closure cap outlet port 79.

The fluid application system 10 includes a concentrate container attachment mechanism 85 on the spray housing 12 for attaching the chemical concentrate container 61 to the valve body 55. The concentrate container attachment mechanism 85 includes a slide plate 87 having an aperture 88. The concentrate container attachment mechanism 85 includes a catch pin 89 that is movable in a recess 90 of the valve body 55 by way of a compression spring 91. The concentrate container attachment mechanism 85 includes a push release button 92 that is mounted above a mounting bracket 94. A compression spring 95 is positioned between a lateral protrusion 96 on the valve body 55 and an upwardly extending tab 97 of the slide plate 87.

Figure 2:
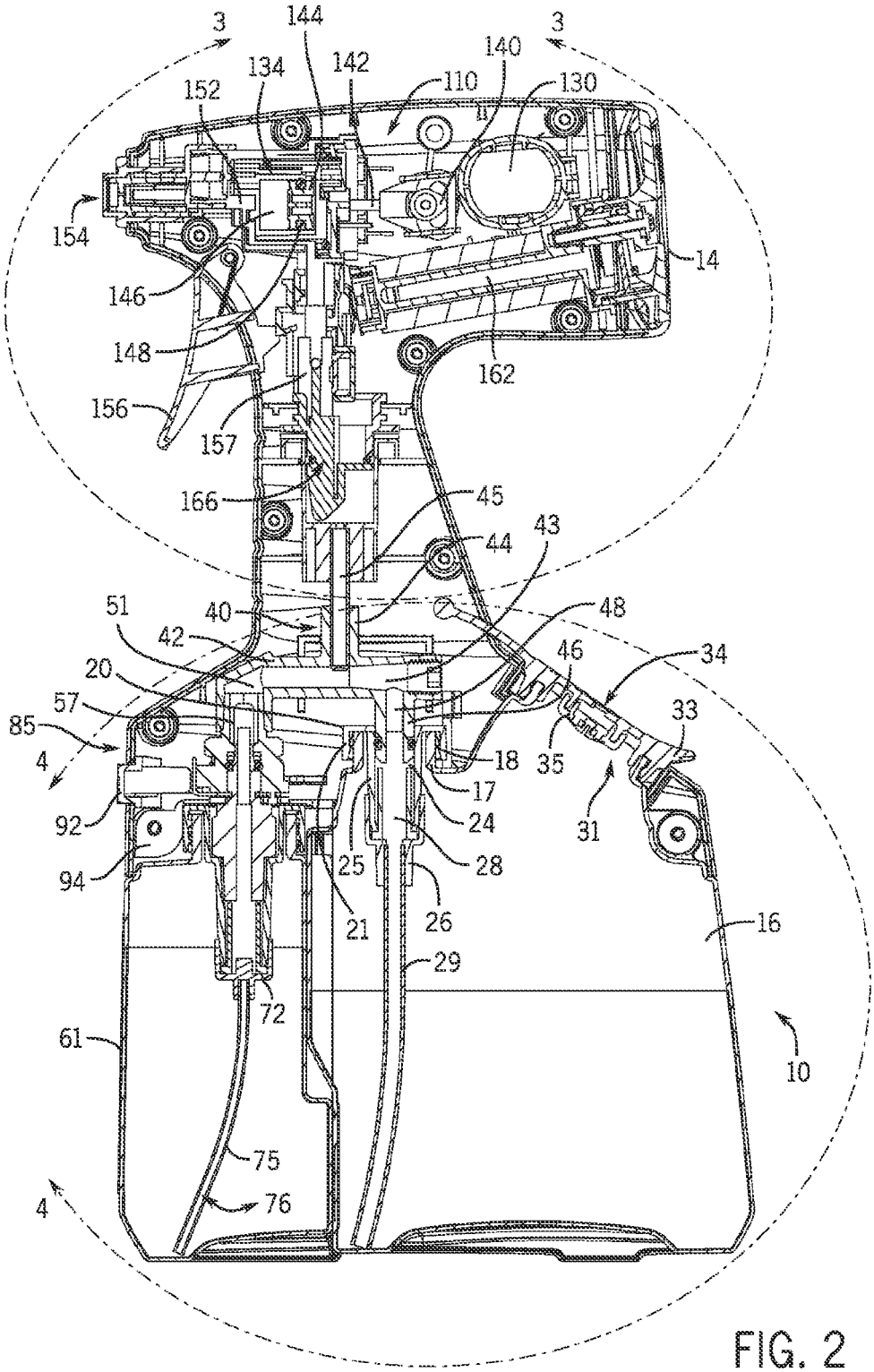
FIG. 2 is a cross-sectional view of the fluid application system of FIG. 1 taken along line 2-2 of FIG. 1.
Figure 3:
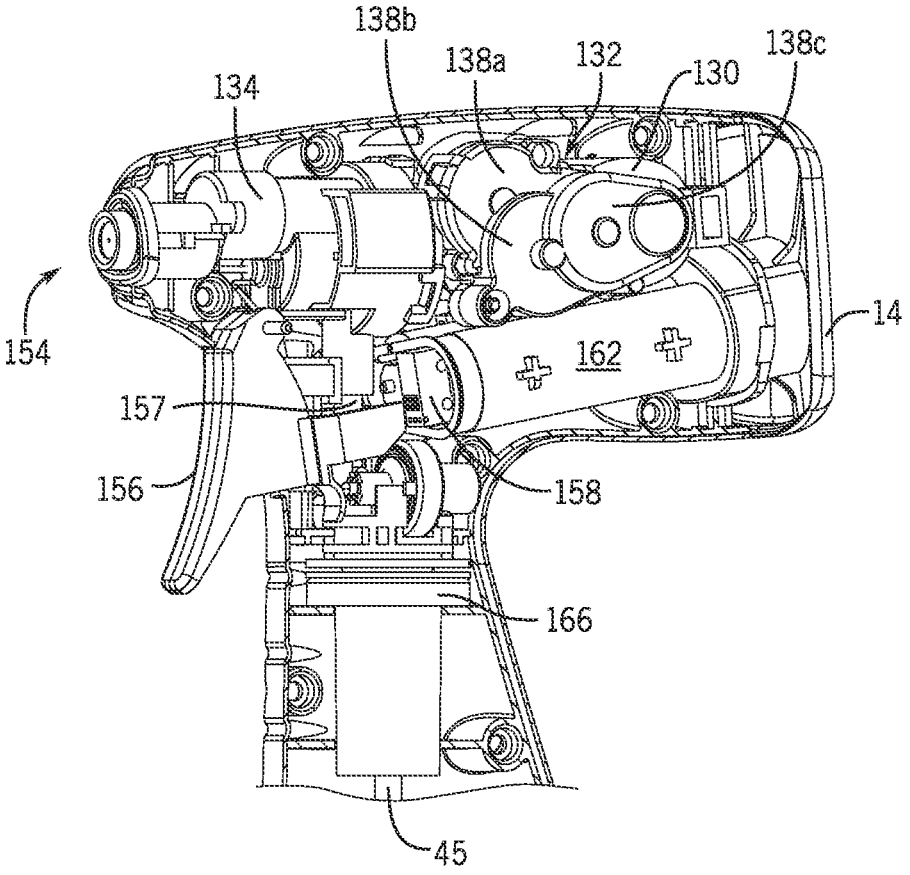
FIG. 3 is a detailed front right perspective view of the sprayer component of the fluid application system of FIG. 1 taken along line 3-3 of FIG. 2.

Looking at FIGS. 2 and 3, a sprayer assembly 110 is located within the sprayer housing 12 of the fluid application system 10. The sprayer assembly 110 includes an electric motor 130, a transmission 132 and a pump 134. The motor 130 includes a drive gear, and the transmission 132 includes a series of three gears 138*a*, 138*b*, 138*c*, a cam 140, and a cam follower shaft 142. The pump 134 includes a piston 144 that is linearly displaceable within a pump cylinder 146 of the pump 134. The piston 144 has an external O-ring 148 which helps clear the pump chamber formed by the pump cylinder 146. The O-ring 148 maximizes the pump suction to draw in and push out the mixture of diluent and chemical being dispensed. Although one O-ring is depicted, it should understood that other embodiments can use a different number of O-rings. The pump cylinder 146 is in fluid communication with a discharge conduit 152 which is in fluid communication with a nozzle 154 for spraying the mixture of the chemical and the diluent.

The sprayer assembly 110 includes a trigger 156 that contacts a microswitch 158 that controls the flow of electricity from batteries 162 to the motor 130. When the trigger 156 is depressed to contact the microswitch 158, the motor 130, by way of the transmission 132, drives the piston 144 back and forth within the pump cylinder 146 of the pump 134 to draw a mixture of the diluent and the chemical into the pump cylinder 146 and then expel the mixture of the diluent and chemical from the nozzle 154 for spraying the mixture of the chemical and the diluent. The pump cylinder 146 is in fluid communication with a pump supply conduit 157 that is placed in fluid communication with the mixed fluid supply conduit 45 by way of a sprayer connector 166 which is further described in U.S. Patent Application Publication No. 2008/0105713, which is incorporated herein by reference. In one embodiment, it is contemplated that each stroke of the piston 144 expels about 0.8 to about 1.6 milliliters of the mixture of the diluent and chemical from the nozzle. In another embodiment, each stroke of the piston 144 expels about 1.3 milliliters of the mixture of the diluent and chemical from the nozzle.

While FIGS. 2 and 3 illustrate the employment of a dual reciprocating piston-type pump 134, a gear pump, a peristaltic pump or other suitable pumping assembly may be substituted for the piston pump 134 without departing from the spirit of the invention. A dual reciprocating pump such as the one illustrated in FIGS. 2 and 3 is advantageous for use in the present invention to achieve a more continuous flow and/or even dispersion or emission of the pumped material. Various alternative pump configurations are described in U.S. Pat. No. 7,246,755, which is incorporated herein by reference.

Having described the components of the fluid application system 10, use of the fluid application system 10 can be further described. A user fills the diluent reservoir 16 through the fill opening 31 with a diluent, preferably water. The refill cap 33 is secured over the fill opening 31 after filling.

Figure 7:
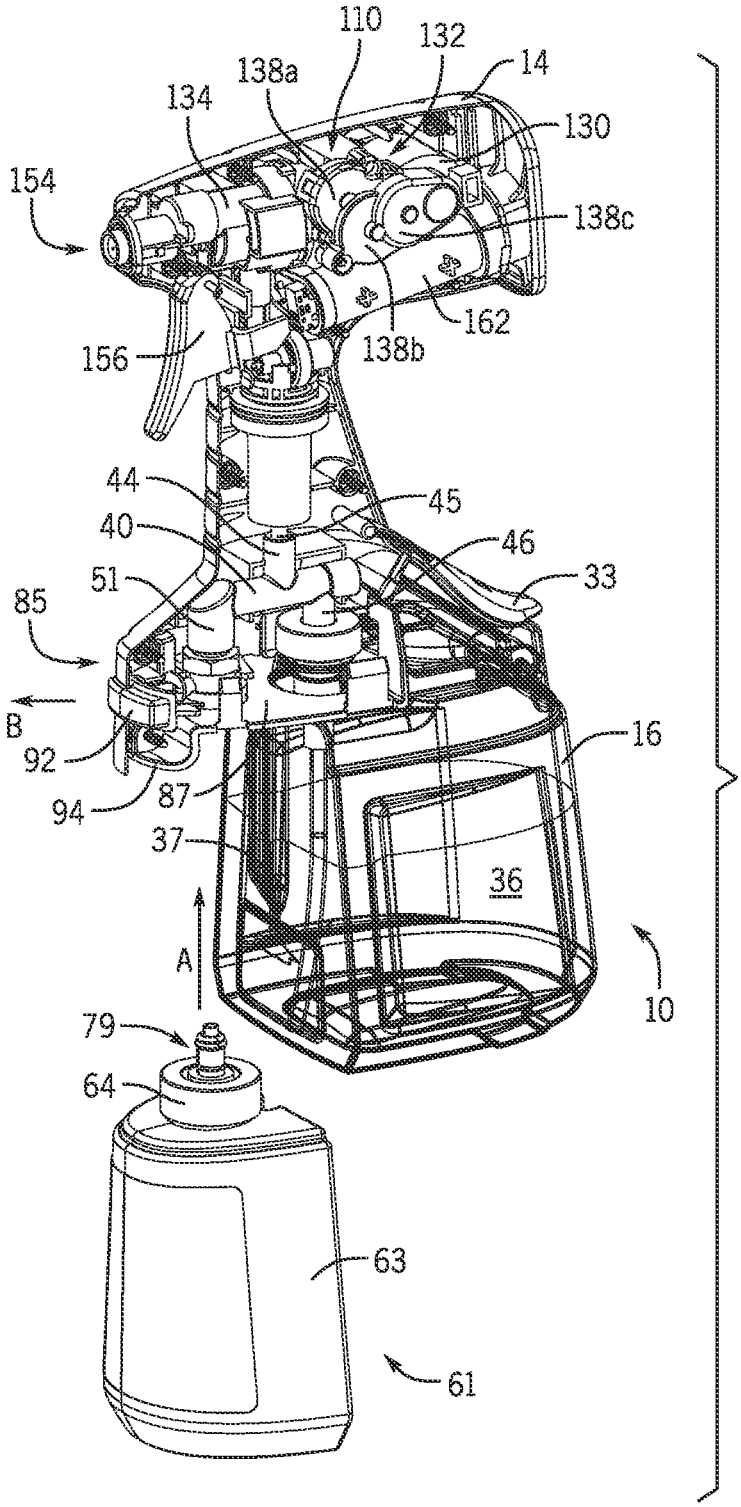
FIG. 7 is a top, right, front perspective view of the fluid application system of FIG. 1 with one shell of the sprayer housing removed showing the chemical concentrate container being installed into the fluid application system.

The chemical concentrate container 61 is assembled to the sprayer housing 12 by moving the chemical concentrate container 61 in direction A as shown in FIG. 7. The closure cap outlet port 79 of the chemical concentrate container 61 is advanced through the aperture 88 in the slide plate 87 of the concentrate container attachment mechanism 85. The protruding ridge 37 of the diluent reservoir 16 can be positioned in the groove 63 of the chemical concentrate container 61 to assist in alignment. The upper wall 65 of the closure cap 64 contacts and then moves upward the catch pin 89 that is movable in the recess 90 of the valve body 55 by way of the compression spring 91. The slide plate 87 is then removed from engagement with the catch pin 89 such that the slide plate 87 moves in relation to the mounting bracket 94 in direction B shown in FIG. 7 due to the biasing force of the compression spring 95 that is positioned between the lateral protrusion 96 on the valve body 55 and the upwardly extending tab 97 of the slide plate 87. An inner edge of the aperture 88 in the slide plate 87 then enters the groove 82 in the outer wall 80 of the closure cap outlet port 79 thereby attaching the chemical concentrate container 61 to the sprayer housing 12. When the chemical concentrate container 61 is attached to the sprayer housing 12, the closure cap outlet port 79 moves valve stem 57 of the valve body 55 upward such that the slit 59 is uncovered thereby allowing for fluid flow from the central passageway 58 of the valve stem 57 to the chemical inlet 53 of the manifold 40.

The chemical concentrate container 61 can be removed from the sprayer housing 12 by pressing the push release button 92 in the direction opposite to direction B in FIG. 7 so that the slide plate 87 moves in the direction opposite to direction B and the inner edge of the aperture 88 in the slide plate 87 exits the groove 82 in the outer wall 80 of the closure cap outlet port 79. The chemical concentrate container 61 can then be pulled in the direction opposite to direction A in FIG. 7 to remove the chemical concentrate container 61 from the sprayer housing 12.

Having filled the diluent reservoir 16 with diluent and having assembled the chemical concentrate container 61 to the sprayer housing 12, the user can apply a mixture of the diluent and chemical to a surface. When the trigger 156 is depressed, the motor 130 causes piston 144 to reciprocate in the pump chamber formed by the pump cylinder 146, and the pump suction draws a mixture of the diluent and chemical into the pump cylinder 146. Specifically, the pump suction draws diluent up the diluent dip tube 29, through the duckbill valve 28 and the diluent inlet 48 of the manifold 40 and into the mixing chamber 43 of the manifold 40. The pump suction also draws chemical up the chemical dip tube 75, through the duckbill valve 73 and the chemical inlet 53 of the manifold 40 and into the mixing chamber 43 of the manifold 40. The amount of chemical entering the mixing chamber 43 is controlled by the inner diameter of the restriction orifice 76 of the chemical dip tube 75 as explained above. The amount of chemical entering the mixing chamber 43 determines the mixing ratio of diluent and chemical.

The pump suction draws the mixture of the chemical and the diluent created in the mixing chamber 43 through the outlet port 44 of the manifold, through the mixed fluid supply conduit 45, through the sprayer connector 166, through the pump supply conduit 156 and into the pump chamber. The pump 134 expels the mixture of the chemical and the diluent into the discharge conduit 152 which is in fluid communication with the nozzle 154 for spraying the mixture of the chemical and the diluent.

Figure 8:
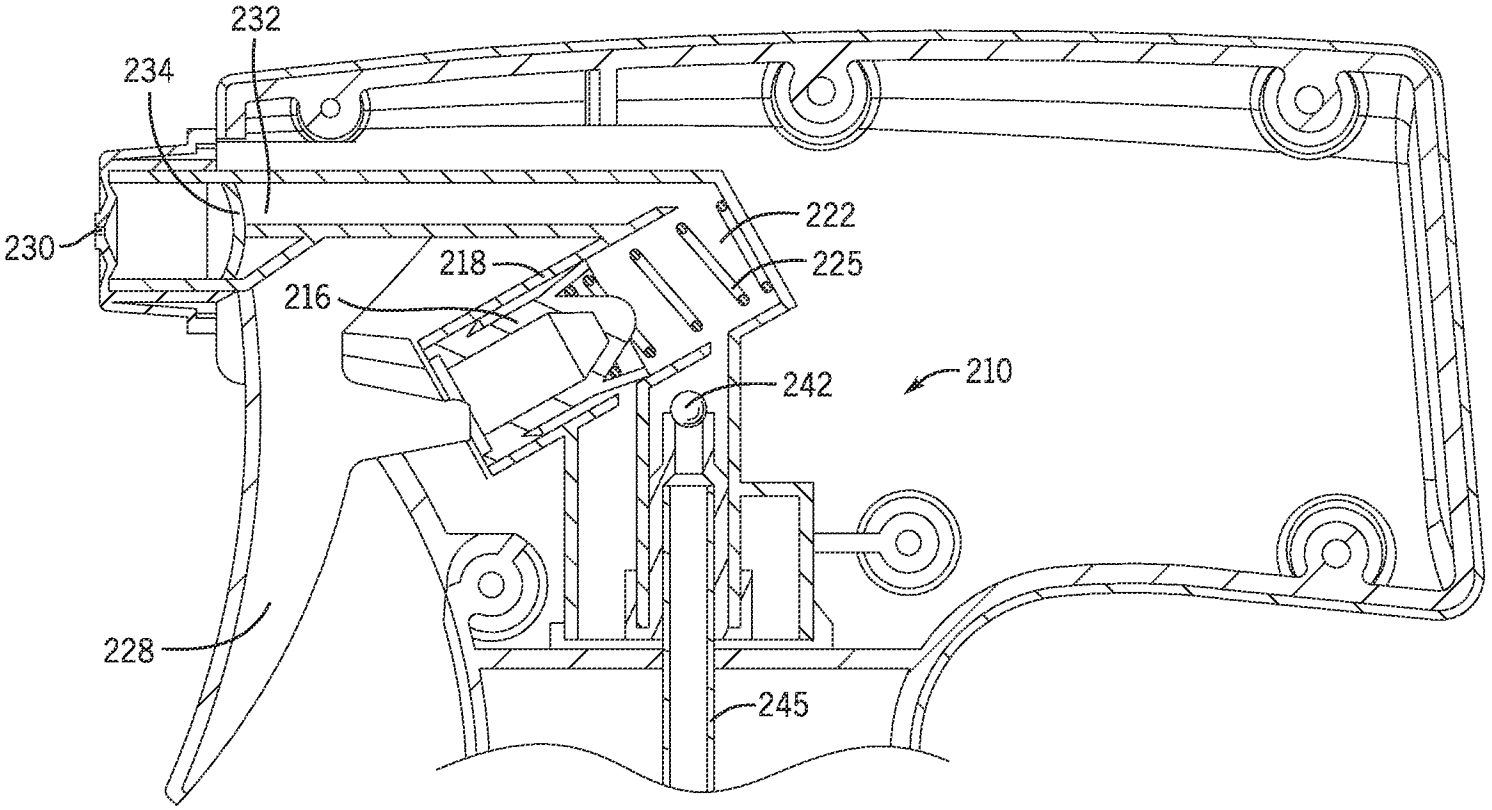
FIG. 8 is a detailed cross-sectional view, similar to FIG. 2, of the sprayer component of another embodiment of a fluid application system in accordance with the invention.
Figure 9:
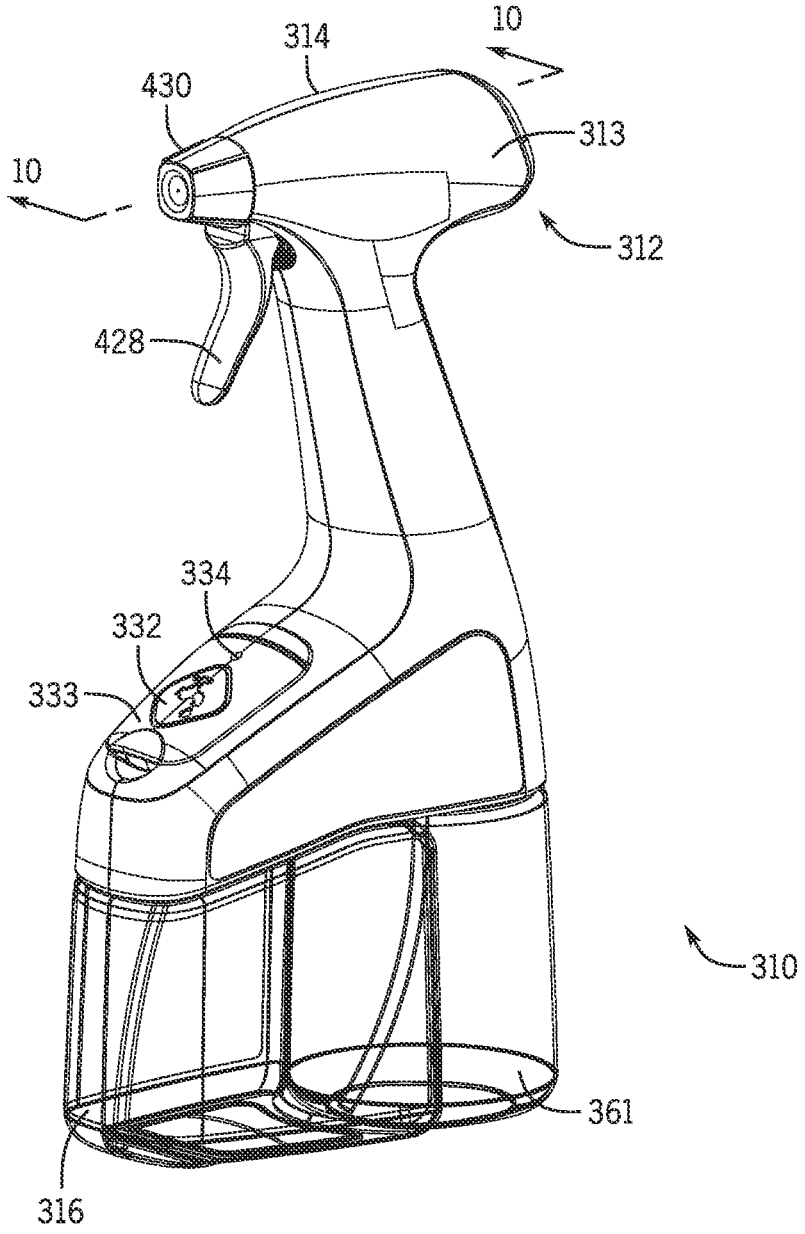
FIG. 9 is a top, right, front perspective view of yet another embodiment of a fluid application system in accordance with the invention.

Turning now at FIG. 8, another example embodiment of a fluid application system according to the invention includes a sprayer assembly 210. The manifold 40, the diluent reservoir 16, and the chemical concentrate container 61 of the fluid application system of FIG. 1 as shown in FIG. 4 are in fluid communication with the sprayer assembly 210 by way of a mixed fluid supply conduit 245. The fluid connections between the manifold 40, the diluent reservoir 16, and the chemical concentrate container 61 are all described above and will not be repeated for the fluid application system including the sprayer assembly 210.

The sprayer assembly 210 includes a finger operated trigger 228 for reciprocatingly moving a piston 216 within a pump cylinder 218, alternatingly increasing and decreasing the cylinder head space 220 to (i) draw a mixture of the diluent and chemical into a pump chamber 222 from a mixed fluid supply conduit 245 and (ii) then expel the mixture of the diluent and chemical from the chamber 222. A compression spring 225 biases the piston 216 outward toward the trigger 228. A cylindrical discharge conduit 232 provides fluid communication between the chamber 222 and a nozzle 230. The discharge conduit 232 has a discharge check valve 234 that permits fluid to move toward the nozzle 230 and not back toward the chamber 222. A ball valve 242 permits fluid to move toward the chamber 222 and not back toward the mixed fluid supply conduit 45.

Referring now to FIGS. 2 and 8, having filled the diluent reservoir 16 with diluent and having assembled the chemical concentrate container 61 to the sprayer housing 12, the user can apply a mixture of the diluent and chemical to a surface.

When the trigger 228 is repeatedly depressed and released, the piston 216 reciprocates in the pump cylinder 218, and the pump suction draws a mixture of the diluent and chemical into the pump cylinder 218. Specifically, the pump suction draws diluent up the diluent dip tube 29, through the duckbill valve 28 and the diluent inlet 48 of the manifold 40 and into the mixing chamber 43 of the manifold 40. The pump suction also draws chemical up the chemical dip tube 75, through the duckbill valve 73 and the chemical inlet 53 of the manifold 40 and into the mixing chamber 43 of the manifold 40. The amount of chemical entering the mixing chamber 43 is controlled by the inner diameter of the restriction orifice 76 of the chemical dip tube 75 as explained above. The amount of chemical entering the mixing chamber 43 determines the mixing ratio of diluent and chemical.

The pump suction draws the mixture of the chemical and the diluent created in the mixing chamber 43 through the outlet port 44 of the manifold, through the mixed fluid supply conduit 245, and into the pump cylinder 218. The pump cylinder 218 expels the mixture of the chemical and the diluent into the discharge conduit 232 which is in fluid communication with the nozzle 230 for spraying the mixture of the chemical and the diluent.

An alternative embodiment of a fluid application system 310 is shown in FIGS. 9-24. The fluid application system 310 is similar to the fluid application system 10, except for the differences noted herein. Further, it is contemplated that various embodiments described in the following paragraphs can be combined or interchanged with various embodiments related to the fluid application system 10.

The fluid application system 310 includes a sprayer housing 312 having a first shell 313 and a second shell 314 that can be fastened together with screws or another suitable fastening device. The sprayer housing 312 surrounds a sprayer assembly 410 that will be described in further detail below.

Referring to FIGS. 9, 10, 12, and 15, the fluid application system 310 includes a diluent reservoir 316 which in one non-limiting version holds about twelve fluid ounces. Water is the preferred diluent, but any other fluid suitable for diluting a concentrated liquid chemical can be used as the diluent. The diluent reservoir 316 can be formed from a suitable material such as polymeric material (e.g., polyethylene or polypropylene). The diluent reservoir 316 has an outlet neck 317 that terminates in a peripheral flange 318. A diluent reservoir cap 320 having an outer circular wall 321 with an inwardly-projecting inner lower rib 322 is installed on the neck 317 of the diluent reservoir 316. In particular, the rib 322 engages an underside of the flange 318 of the cap 320.

Figure 12:
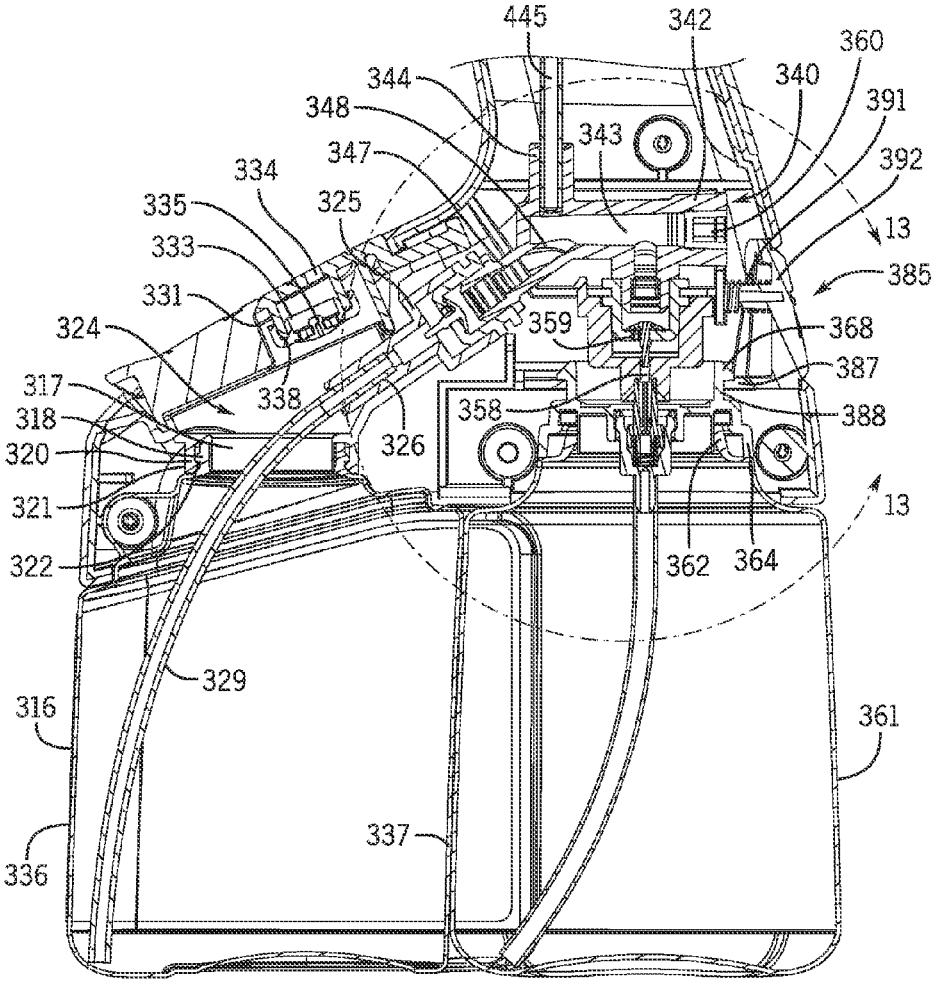
FIG. 12 is a detailed cross-sectional view of the manifold, diluent reservoir, and chemical concentrate container of the fluid application system of FIG. 9 taken along line 12-12 of FIG. 10.

Referring to FIG. 12, the outer circular wall 321 of the cap 320 extends further upward to provide a central well 324 that is in fluid communication with an inlet port 325 and a fill opening 331. As such, the diluent reservoir cap 320 operates as a water reservoir splitter by guiding an incoming stream of refill diluent through the fill opening 331 and by securing thereto the inlet port 325 that guides an outgoing stream of diluent. In particular, the inlet port 325 is an open-ended cylindrical channel with a proximal end having an integrally formed dip tube holder 326 and a distal end adapted to receive an umbrella valve 328 assembly. The proximal end of the inlet port 325 extends into the central well 324 and receives a diluent dip tube 329 that is press-fit into a sealing fit therein. The distal end of the inlet port 325 projects beyond the cap 320 and is characterized by a cylindrical portion that is greater in diameter than the proximal end, thereby allowing the distal end to abut against an outer surface of the cap 320.

Figure 13:
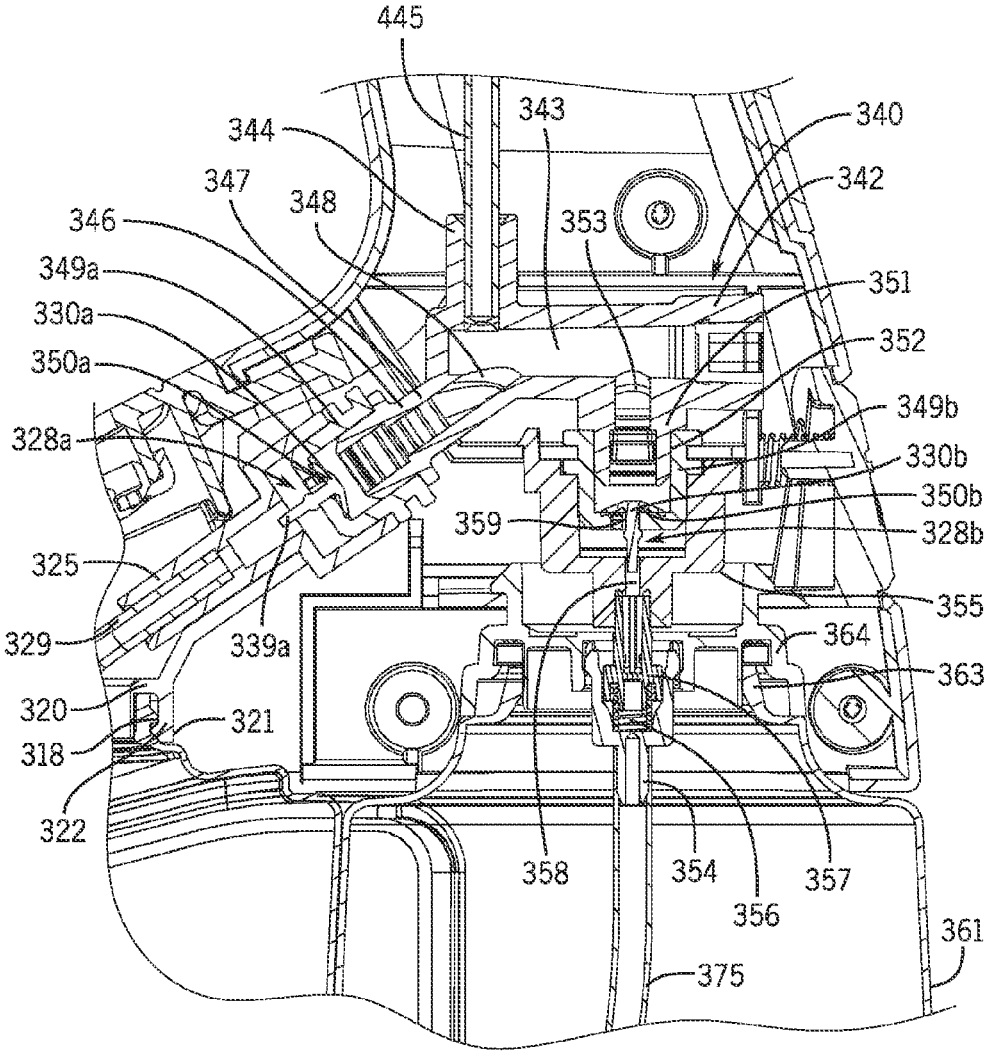
FIG. 13 is a detailed cross-sectional view of the manifold of the fluid application system of FIG. 9 taken along line 12-12 of FIG. 10.

As shown in FIG. 13, a one-way valve, such as the umbrella valve **328*a*, is positioned within the distal end of the inlet port 325 and is therefore located outside of the cap 320. The umbrella valve 328*a* allows fluid to flow from the diluent dip tube 329 toward the sprayer assembly 410 and prevents fluid that is downstream of the umbrella valve 328*a* from flowing back toward the diluent dip tube 329. In one non-limiting form, the umbrella valve 328*a* has a cracking pressure in the range of greater than 0 to 1 psi. As shown in the present embodiment, the umbrella valve 328*a* comprises a skirt 330*a* with an underside having a protruding post 339*a*. Alternative one way valves are also suitable for use in the inlet port 325, such as a ball valve. It is contemplated that the one way valve is located in or adjacent an opening of the diluent reservoir 316 to prevent flow that is upstream of the reservoir 316 to flow back toward an intake end of the diluent dip tube 329 that is in fluid communication with the diluent reservoir 316** and is located therein.

Referring back to FIG. 12, the fill opening 331 allows the diluent reservoir 316 to be refilled with diluent. A refill cap 333 covers the fill opening 331 and can be removed or lifted off of the sprayer housing 312 to uncover the fill opening 331. After refilling the diluent, the refill cap 333 is subsequently inset back onto the sprayer housing 312 to cover the fill opening 331. In some embodiments, an exterior surface of the refill cap 333 provides a visual indicator 332, such as an embedded icon of a water faucet or other diluent sources, to signify the refill cap 333 to the user. Further, a vent opening 334 is located on the refill cap 333 and traverses through the thickness of the cap 333 toward the central well 324 of the reservoir cap 320. The vent opening 334 opens to an umbrella valve 335 that is situated on an umbrella seat 338, which is retained on an underside of the refill cap 333. The umbrella valve 335 controls venting from the interior of the diluent reservoir 316 to ambient atmosphere to restore air into the diluent reservoir 316. In a different aspect, the diluent reservoir 316 defines an outer wall 336 with a concave sidewall 337 to rest against the somewhat frustoconical-shaped chemical concentrate container 361. It is contemplated that other sidewall configurations can be applied with complementary or non-complementary shapes between the diluent reservoir 316 and the chemical concentrate container 361. Preferably, the diluent reservoir 316 has a larger volume than the chemical concentrate container 361. Preferably, the diluent reservoir 316 is located forward of the chemical concentrate container 361 with respect to the direction of spray.

Figure 10:
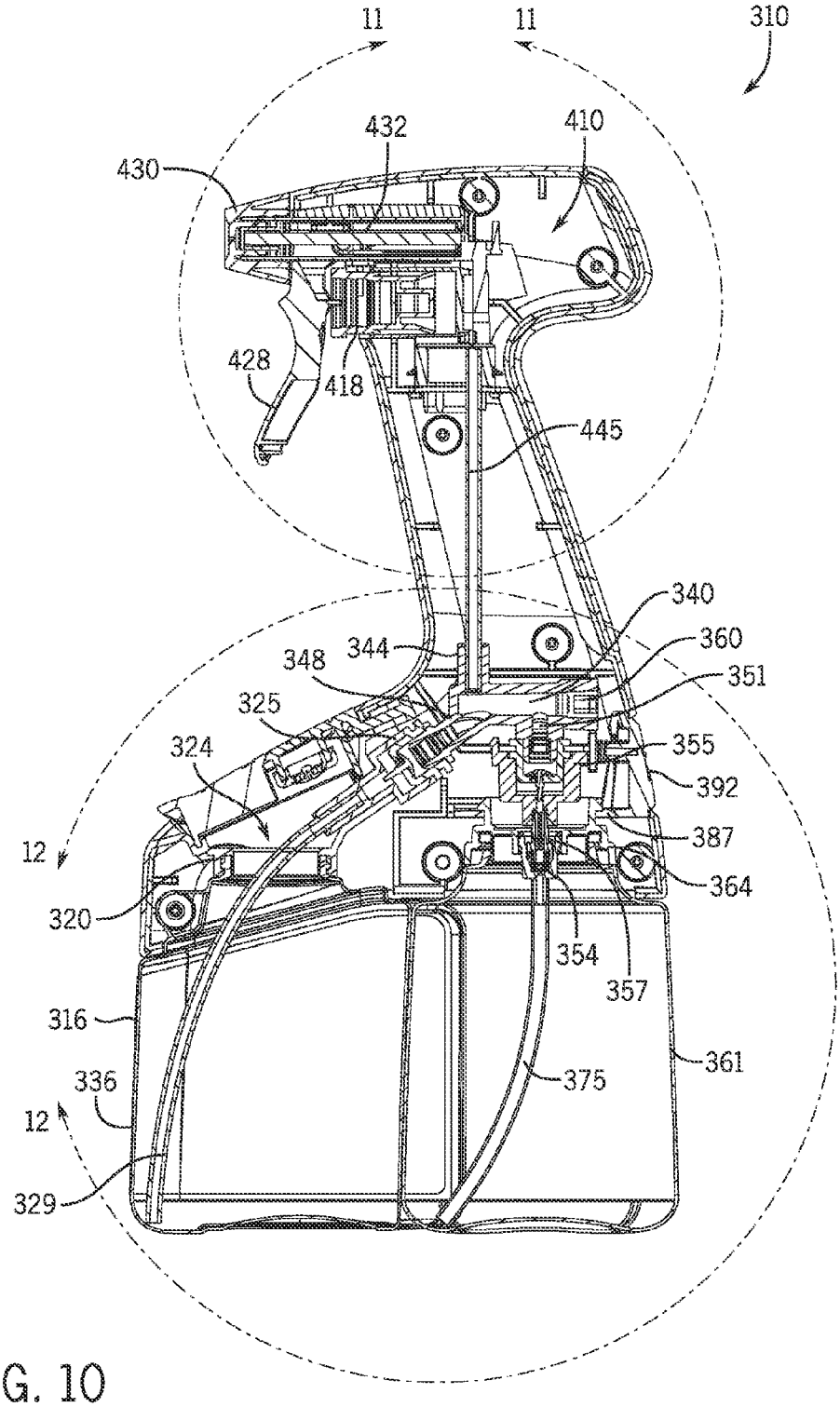
FIG. 10 is a cross-sectional view of the fluid application system of FIG. 9 taken along line 10-10 of FIG. 9.

As shown in FIGS. 10, 12, and 13, the fluid manifold 340 is located within the sprayer housing 312 of the fluid application system 310. The manifold 340 has a main body 342 that defines a mixing chamber 343. The manifold 340 has an outlet port 344 that is in fluid communication with the mixing chamber 343 and a mixed fluid supply conduit 445. A fluid stream comprising a mixture of the diluent and chemical is provided from the manifold 340 to the mixed fluid supply conduit 445 to the sprayer assembly 410 as described below.

The manifold 340 has a diluent inlet port 346 having a cylindrical outer wall 347 that defines a diluent inlet 348 of the manifold 340. An umbrella seat **349*a* is provided on the outside of the outer wall 347 of the diluent inlet port 346 and contains the umbrella valve 328*a* therein. As shown in FIG. 13, the diluent inlet port 346 is operatively engaged to the central well 324 of the diluent reservoir cap 320 by inserting one end of the inlet port 346 into the umbrella seat 349*a*. The umbrella seat 349*a* is further inserted into the distal end of the inlet port 325, which extends to the proximal end that is located in the central well 324. As such, the umbrella seat 349*a* connects the manifold 340 to the diluent inlet port 325 and allows communication of fluid therethrough. Further, the umbrella seat 349*a* provides a sealing surface through which the umbrella valve 328***a* is retained. The sealing surface comprises a raised ridge 350*a* protruding toward an underside of a skirt 330*a* of the umbrella valve 328*a*. In some embodiments, the sealing surface is an O-ring.

The manifold 340 has a chemical inlet port 351 in fluid communication with the mixing chamber 343. The chemical inlet port 351 has an outer wall 352 that defines a chemical inlet 353 of the manifold 340. The chemical inlet port 351 is further in fluid communication with a valve stem 357 of the chemical concentrate container 361. In particular, the outer wall 352 of the chemical inlet port 351 is inserted into an umbrella seat 349*b*, which is further inserted into an actuator body 355 having an entry port dimensioned to engage an upper portion of the valve stem 357 thereby and mechanically actuating the valve stem 357. The valve stem 357 is received in a valve body 354 and biased toward the actuator body 355 with a spring 356, such that the actuator body 355 can move the valve stem 357 to an open position when the chemical concentrate container 361 is attached to the sprayer housing 312. It is contemplated that other biasing elements for biasing the valve stem 357 into a closed position can be utilized. The actuator body 355 further includes a central passageway 358 that is aligned with a channel 359 downstream thereof. An inner space of the central passageway 358 is partially blocked by a portion of a post 339*b* that is fixed to an underside of a skirt 330*b* of an umbrella valve 328*b*, which is movably retained in the channel 359 of the umbrella seat 349*b*. In one non-limiting form, the umbrella valve 328*b* has a cracking pressure in the range of greater than 0 to 1 psi. Similar to the umbrella seat 349*a*, the umbrella seat 349*b* includes a sealing surface that comprises a raised ridge 350*b* protruding toward an underside of the skirt 330*b* of the umbrella valve 328*b*. As such, the chemical concentrate released from the chemical concentrate container 361 travels through the flow passageway 358*a* of the valve stem 357, into the channel 359, past the umbrella valve 328*b* and toward the chemical inlet port 351.

The manifold 340 further includes a flow adjustor 360 located in the manifold 340 and structured to vary an amount of flow through the chemical inlet 353 such as by blocking off a portion of the chemical inlet 353. In particular, the flow adjustor 360 can be threaded to corresponding threads in the manifold 340 or friction-fit therein, such that the user can alter the position of the flow adjustor 360 and vary the amount of chemical through the chemical inlet 353, or vary other flow characteristics in the manifold 340. In one aspect, the flow adjustor 360 is a rubberized plug that closes off an end of the manifold 340. In another aspect, the flow adjustor 360 can be manipulated to alter flow or mixing characteristics within the manifold 340. An end of the flow adjustor 360 may extend through the sprayer housing 312 allowing the user to alter the position of the flow adjustor 360 in the manifold 340. The flow adjustor 360 allows the user to vary the chemical to diluent mix ratio.

In one non-limiting version of the fluid application system 310, the chemical concentrate container 361 holds about ten fluid ounces. The concentrate can be selected such that when the concentrate is diluted with the diluent, any number of different fluid products is formed. Non-limiting example products include general all purpose cleaners, kitchen cleaners, bathroom cleaners, dust inhibitors, dust removal aids, floor and furniture cleaners and polishes, glass cleaners, degreasers, carpet cleaners, peroxide-containing cleaners, anti-bacterial cleaners, fragrances, deodorizers, soft surface treatments, fabric protectors, laundry products, fabric cleaners, fabric stain removers, tire cleaners, dashboard cleaners, automotive interior cleaners, and/or other automotive industry cleaners or polishes, or even insecticides. The chemical concentrate container 361 can be formed from a suitable material such as polymeric material (e.g., polyethylene or polypropylene), and in certain embodiments, the chemical concentrate container 361 comprises a transparent material that allows the user to check the level of chemical concentrate in the chemical concentrate container 361. It should be appreciated that the term "chemical" when used to describe the concentrate in the chemical concentrate container 361 can refer to one compound or a mixture of two or more compounds.

Figure 24:
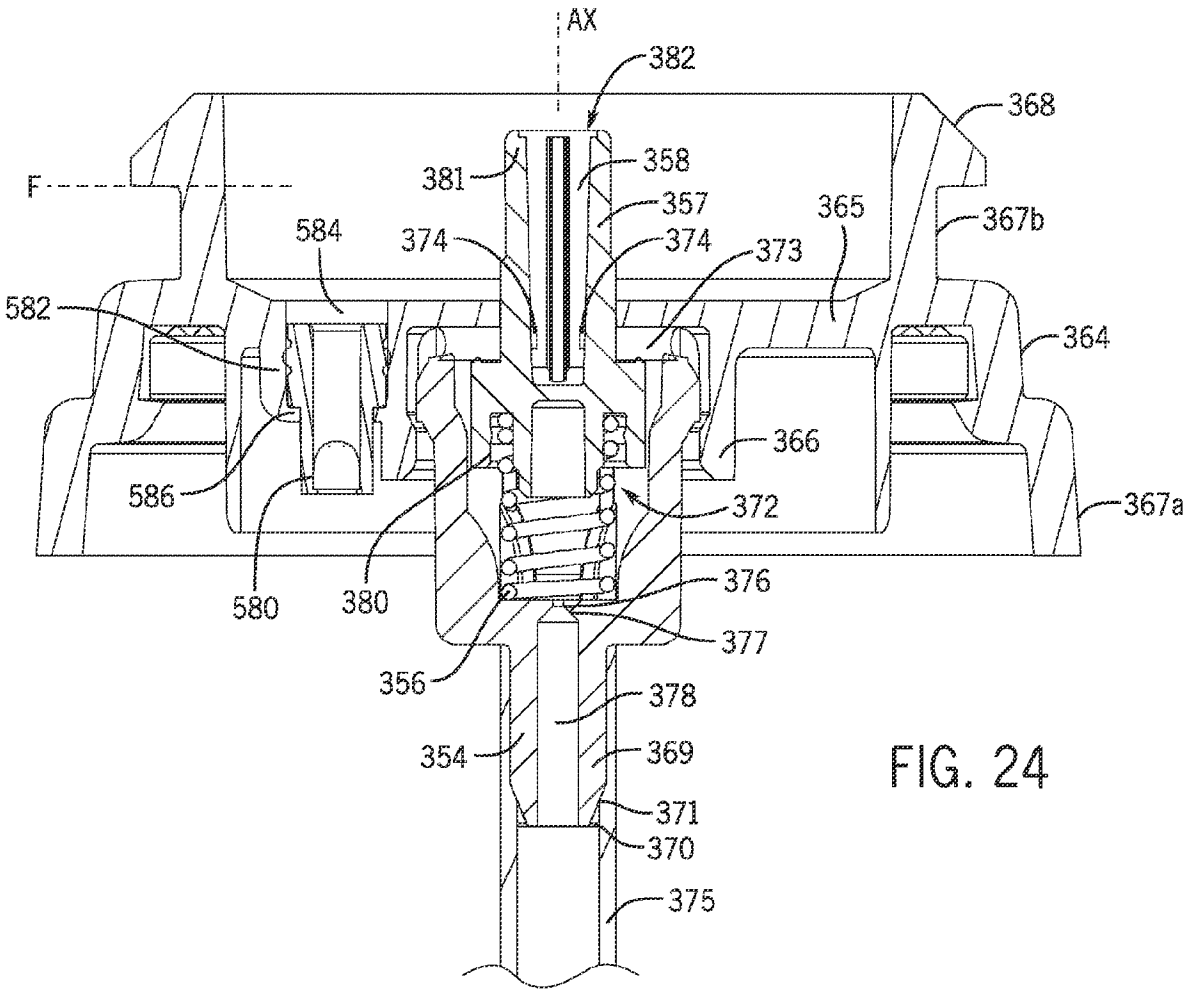
FIG. 24 is a cross-sectional detailed view of a valve system of the chemical concentrate container of FIGS. 16 and 17 taken along line 17-17 of FIG. 16.

Turning now to FIGS. 12, 13, and 24, the chemical concentrate container 361 has an outlet neck 362. A closure cap, hereon referred to as a mounting cup 364, is secured onto the outlet neck 362 of the chemical concentrate container 361. In particular, the mounting cup 364 has an upper plate 365 that is generally circular and covering at least a portion of the outlet neck 362, which defines a hollow outlet 363 of a closure of the chemical concentrate container 361. The upper plate 365 extends to an inner skirt 366 at a central, underside portion of the upper plate 365 toward the chemical concentrate container 361 to retain the valve body 354 therein. The upper plate 365 further defines outer skirts about a periphery of the upper plate 356 that extend as walls away from the side of the mounting cup 364. In particular, an outer, lower skirt 367*a* is defined by walls extending downwardly about the periphery of the upper plate 365 to provide corresponding threads, or other engaging mechanisms, to the outlet neck 362 of the chemical concentrate container 361. An outer, upper well 367*b* extends upwardly from the periphery of the upper plate 365 and houses the valve stem 357 which protrudes therein. The upper well 367*b* further includes a peripheral flange 368 extending from an outer surface thereof to assist in attaching the chemical concentrate container 361 to the fluid application system 310, as further described below. In the present embodiment, the peripheral flange 368 extends radially outward from an end of the wall or the outer, upper well 367*b* of the mounting cup 364. The mounting cup 364 functions as a mounting element and can comprise a metallic or a polymeric material, such as polyethylene or polypropylene.

As shown in FIG. 24, in a particular aspect, the valve body 354 that is fitted within the inner well 366 of the mounting cup 364 defines a valve body inlet port 369 having a hollow channel 378, which is further described below. One end of the valve body inlet port 369 protrudes into the chemical concentrate container 361 and defines an end of the hollow channel 378 as a concentrate inlet 370. In the present embodiment, the concentrate inlet 370 is characterized by an angled outer surface 371 at the edge of the valve body inlet port 369 where the surface 371 tapers inwardly toward the centrally-disposed channel 378. It is contemplated that the tapered design facilitates assembly of a chemical dip tube 375, as described further below, which can be slipped over the tapered portion and press-fit into a sealing fit onto the valve body inlet port 369 over an entry orifice thereof. Further, the mounting cup 364 defines a closed space, such as a valve cavity 372, that secures a first end of 380 the spring-biased valve stem 357 therein. A second end 381 of the valve stem 357 extends out of the mounting cup 364 on a side opposed to the valve cavity 372 and defines an exit opening 382 of the valve stem 357. When in the open position, the second end 381 of the valve stem 357 is located at a position on the longitudinal axis AX (see FIG. 24) of the mounting cup 364 plus or minus four millimeters (0.157 inches) from the transverse reference plane F (see FIG. 24) at the bottom of the peripheral flange 368 of the mounting cup 364. A portion of the upper plate 365 of the mounting cup 364 defines a circular stem gasket 373 that the valve stem 357 projects through. The stem gasket 373 is approximately centrally disposed on the mounting cup 364 and is adapted to fit substantially snugly around the valve stem 357 to cover one or more valve stem orifices 374 disposed circumferentially thereof. In particular, the valve stem orifices 374 are circumferential openings through a wall of the valve stem 357 that allow chemical inside the valve body 354 to enter the valve stem 357. Initially, chemical enters the valve body 354 by way of the chemical dip tube 375, which is press-fit around the valve body inlet port 369 to communicate a volume of chemical concentrate from the chemical concentrate container 361 into the valve body 354. In a closed position, fluid flow is blocked between the valve stem 357 and the valve cavity 372 by way of the stem gasket 373. In an open position, fluid flow is permitted from the valve cavity 372 through the stem orifices 374, into the valve stem 357 and through the exit opening 382 of the valve stem 357.

As shown in FIG. 24, in some embodiments, the valve body inlet port 369 comprises a restriction orifice 376 for restricting a volume of chemical concentrate from reaching the valve stem 357. In particular, the restriction orifice 376 is defined by an angled generally conical wall 377 that converges inwardly from an inner surface of the valve body inlet port 369 and more particularly extends inwardly from the hollow channel 378 at a distal end, otherwise known as an entry orifice, of the channel 378 from the concentrate inlet 370. In other embodiments, the restriction orifice 376 is characterized by a combination of all or a portion of the hollow channel 378 and the angled wall 377. Still, in other embodiments, the hollow channel 378 also comprises angled or tapering surfaces in addition to the angled wall 377 of the restriction orifice 376, or has a uniform diameter, to assist in restriction of fluid access to the valve stem 357. The wall 377 may also be annular with right angle corners. It is noted that upon activation of the fluid application system 310, the valve stem 357 is depressed downward by the actuator body 355 to expose the valve stem orifices 374 and draw a flow of chemical concentrate into the chemical inlet 353 of the fluid manifold 340.

It is contemplated that the restriction orifice 376 has a smaller inner diameter than the inner diameter of an adjacent section of the chemical dip tube 375 and/or the concentrate inlet 370, and/or the hollow channel 378. The restriction orifice 376 can be of various throughhole inner diameters, such as 0.003 to 0.028 inches (0.07-0.7 millimeters), to provide a metering function and/or for achieving different chemical mix ratios. Among other things, the restriction orifice 376, the umbrella valve 328*a*, and the umbrella valve 328*b* control variability when achieving different chemical mix ratios. Test results of restriction orifices in the range of 0.005-0.020 inches showed chemical to diluent mix ratios of 1:15 to 1:59. For example, a first chemical concentrate container containing a first chemical can have a dip tube in fluid communication with a restriction orifice having a first throughhole inner diameter in the chemical concentrate container to achieve a chemical to diluent mix ratio of 1:5. A second chemical concentrate container containing a second chemical can have a dip tube in fluid communication with a restriction orifice having a throughhole inner diameter of a second smaller size to achieve a chemical to diluent mix ratio of 1:15. A third chemical concentrate container containing a third chemical can have a dip tube in fluid communication with a restriction orifice having a throughhole inner diameter of a third smaller size to achieve a chemical to diluent mix ratio of 1:32. A fourth chemical concentrate container containing a fourth chemical can have a dip tube in fluid communication with a restriction orifice having a throughhole inner diameter of a fourth smaller size to achieve a chemical to diluent mix ratio of 1:64. Of course, other mix ratios in the range of 1:1 to 1:1200, 1:1 to 1:100, or 1:16 to 1:256 can be achieved. Further, it is contemplated that variability of the mix ratio is plus or minus about 10 percent when operating the pump assembly. The chemical to diluent mix ratio can be further controlled by using a capillary dip tube in combination with the restriction orifice 376. Alternatively, the restriction orifice 376 can be omitted and the capillary dip tube can control the chemical to diluent mix ratio. A capillary dip tube wicks product from surface tension. A first chemical concentrate container containing a first chemical can have a capillary dip tube having a first inner diameter, and a second chemical concentrate container containing a second chemical can have a capillary dip tube of a second inner diameter.

The fluid application system 310 includes a concentrate container attachment mechanism 385 on the sprayer housing 312 for attaching the chemical concentrate container 361 to the actuator body 355. The concentrate container attachment mechanism 385 includes a moveable collar 387 having an aperture 388 that is adapted to engage the peripheral flange 368 of the mounting cup 364. In particular, a compression spring is positioned adjacent to an inner side of a push release button 392 to bias the push release button 392 outward of the sprayer housing 312. To release the chemical concentrate container 361, the user presses the push-release button to slide the moveable collar 387 laterally within the sprayer housing 312 and disengage the peripheral flange 368 of the mounting cup 364. Upon disengaging the peripheral flange 368, the chemical concentrate container 361 can be freely removed from the sprayer housing 312.

Figure 14:
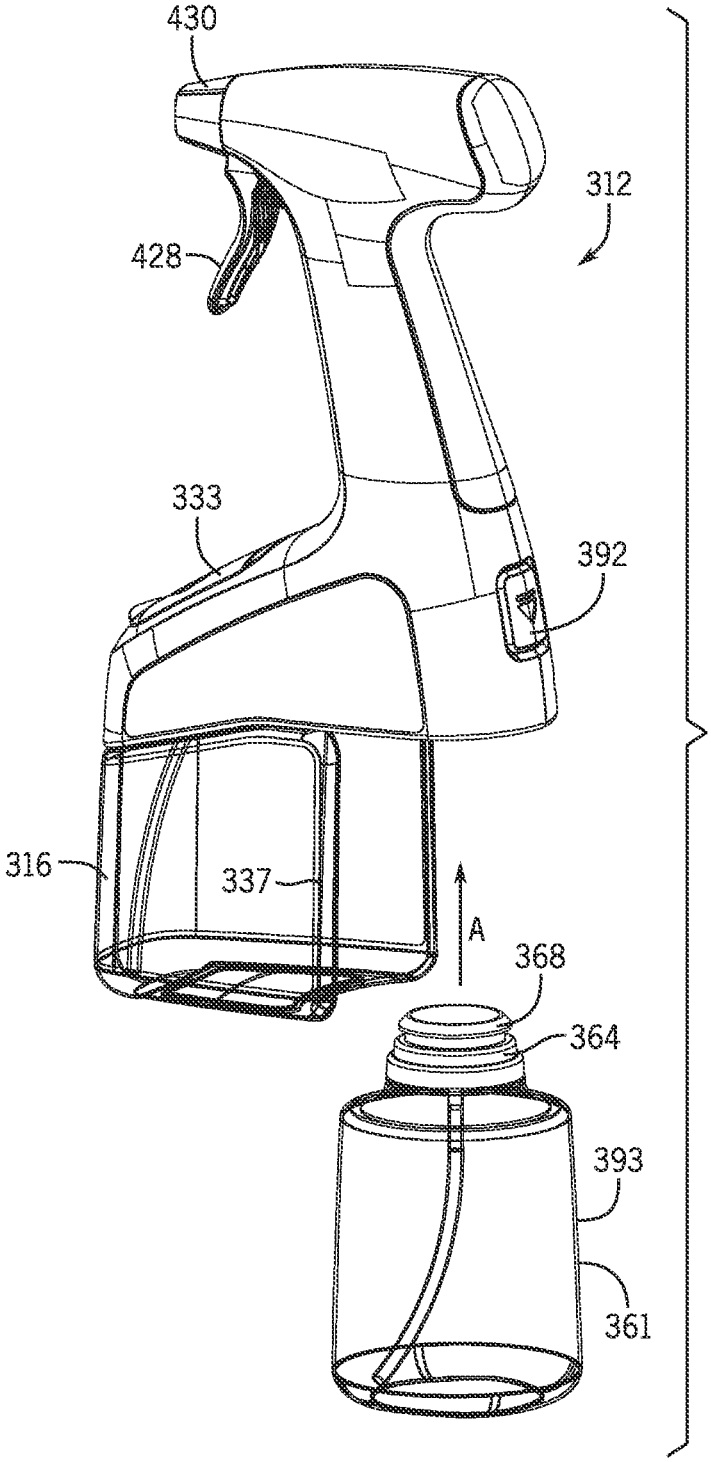
FIG. 14 is a top, right, rear perspective view of the fluid application system of FIG. 9 showing the chemical concentrate container being installed into the fluid application system.

Turning now to FIG. 14, the chemical concentrate container 361 is assembled to the sprayer housing 312 by moving the chemical concentrate container 361 in direction A. In particular, by moving the chemical concentrate container 361 toward the sprayer housing 312, the mounting cup 364 of the chemical concentrate container 361 is advanced through the aperture 388 in the moveable collar 387 of the concentrate container attachment mechanism 385. The spring-biased moveable collar 387 catches an underside of the peripheral flange 368 of the mounting cup 364 creating an audible click. In the present embodiment, a convex sidewall 393 of the chemical concentrate container 361 juxtaposes or slides adjacently to the concave sidewall 337 of the diluent container 316.

Still referring to FIG. 14, the chemical concentrate container 361 can be removed from the sprayer housing 312 by pressing the push release button 392 so that the container 361 can be removed in substantially the opposite of direction A. In particular, the pushing the push release button 392 causes the moveable collar 387 to reposition laterally and disengage its aperture 388 from the peripheral flange 368 of the mounting cup 364. The chemical concentrate container 361 can then be pulled in the direction opposite to direction A to remove the chemical concentrate container 361 from the sprayer housing 312.

Figure 11:
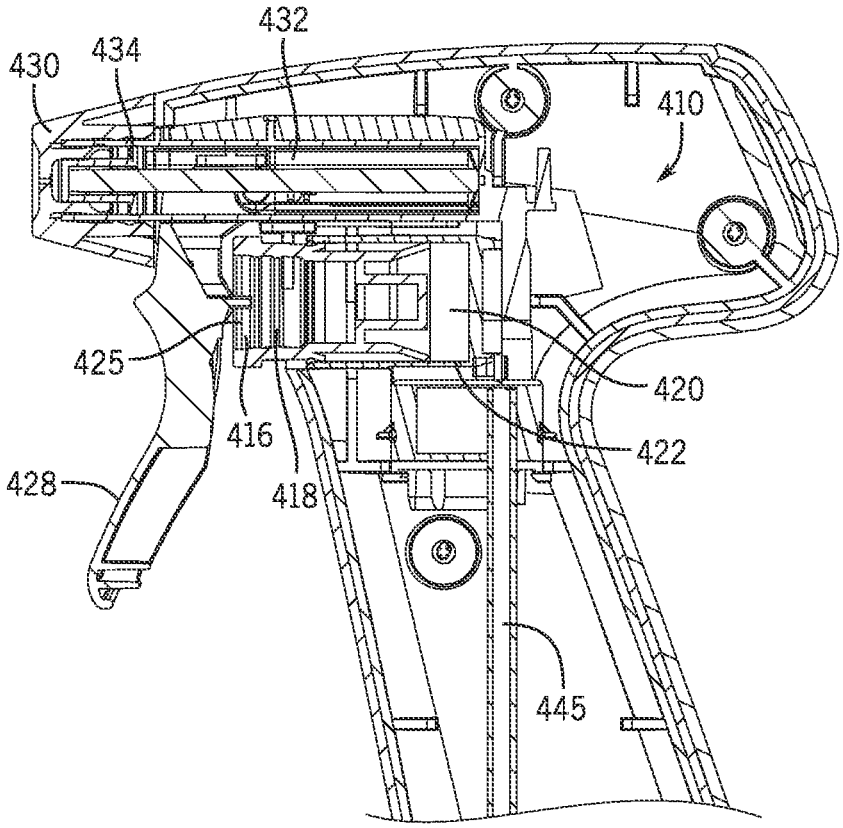
FIG. 11 is a detailed cross-sectional view of the sprayer component of the fluid application system of FIG. 9 taken along line 11-11 of FIG. 10.

Turning now to FIGS. 10 and 11, the sprayer assembly 410 is located within the sprayer housing 312 of the fluid application system 310. The fluid manifold 340, the diluent reservoir 316, and the chemical concentrate container 361 of the fluid application system 310 are in fluid communication with the sprayer assembly 410 by way of a mixed fluid supply conduit 445. The fluid connections between the manifold 340, the diluent reservoir 316, and the chemical concentrate container 361 are all described above and will not be repeated for the fluid application system including the sprayer assembly 410.

The sprayer assembly 410 includes a finger operated trigger 428 for reciprocatingly moving a piston 416 within a pump cylinder 418, alternatingly increasing and decreasing the pump cylinder head space 420 to (i) draw a mixture of the diluent and chemical into a pump chamber 422 from the mixed fluid supply conduit 445 and (ii) then expel the mixture of the diluent and chemical from the chamber 422. A compression spring 425 biases the piston 416 outward toward the trigger 428. A cylindrical discharge conduit 432 provides fluid communication between the pump chamber 422 and a nozzle 430. In the present embodiment, the discharge conduit 432 has a discharge check valve 434 that permits fluid to move toward the nozzle 430 and not back into the discharge conduit 432 or the pump chamber 422.

Still referring to FIGS. 10 and 11, having filled the diluent reservoir 316 with diluent and having assembled the chemical concentrate container 361 to the sprayer housing 312, the user can apply a mixture of the diluent and chemical to a surface. When the trigger 428 is repeatedly depressed and released, the piston 416 reciprocates in the pump cylinder 418, and the pump suction draws a mixture of the diluent and chemical into the pump cylinder 418. Specifically, the pump suction draws diluent up the diluent dip tube 329, through the inlet port 325 which operatively connects the dip tube 329 to the umbrella valve 328*a*, through the umbrella seat 349*a*, which operatively connects the inlet port 325 to the diluent inlet port 346 of the fluid manifold 340. Simultaneously, the pump suction also draws chemical up the chemical dip tube 375, through the restriction orifice 376 of the valve body 354 that secures the valve stem 357 and further past the umbrella valve 328*a* in the actuator body 355 to the chemical inlet 353 of the fluid manifold 340. Among other things, the amount of chemical entering the mixing chamber 343 is controlled by the inner diameter of the restriction orifice 376, as explained above, and determines the mixing ratio of diluent and chemical. It is contemplated that when diluent is depleted from the diluent reservoir 316, chemical concentrate is not dispensed from the chemical concentrate container 361.

The pump suction continues to draw the mixture of the chemical and the diluent created in the mixing chamber 343 through the outlet port 344 of the fluid manifold 340, through the mixed fluid supply conduit 445, and into the pump cylinder 418. The pump cylinder 418 expels the mixture of the chemical and the diluent into the discharge conduit 432 which is in fluid communication with the nozzle 430 for spraying the mixture of the chemical and the diluent. The fluid application system 310 is configured such that differences in the extent of pull on the finger operated trigger 428 do not vary the chemical to diluent mix ratio. For example, a half pull (i.e., a short stroke) and a full pull on the finger operated trigger 428 yield the same chemical to diluent mix ratio. Optionally, the refill cap 333, the push release button 392, the trigger 428, and the nozzle 430 may have a common color to identify user action points on the fluid application system 310.

Figure 15:
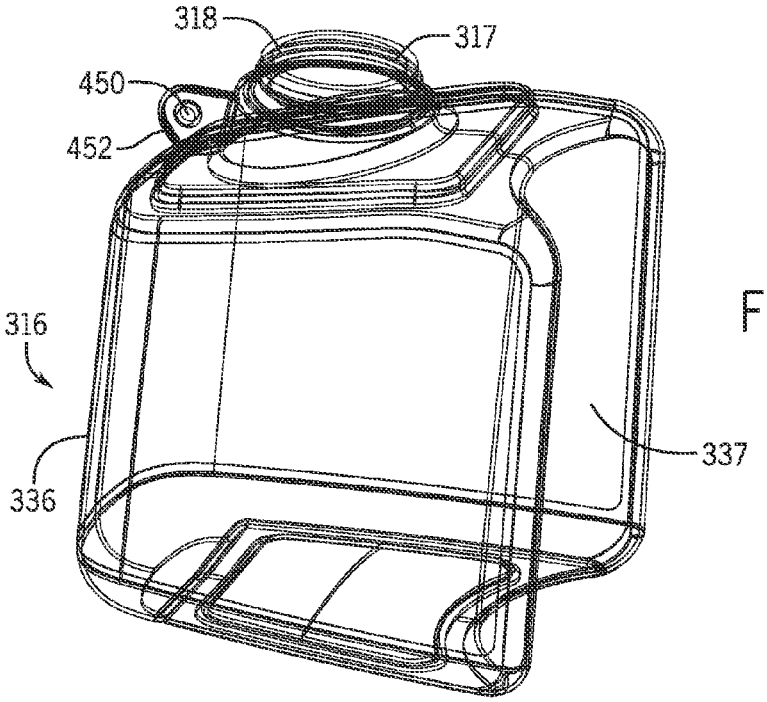
FIG. 15 is a right, rear perspective view of the diluent reservoir of the fluid application system of FIG. 9.

Turning now to FIG. 15, a detailed view of one embodiment of the diluent reservoir 316 of FIG. 1 is shown. The diluent reservoir 316 is adapted to be secured to the sprayer housing 312 through a securing orifice 450 that is provided on a protruding flap 452. It is contemplated that a nail, rod, nut and bolt assembly, or other corresponding engagement mechanism is inserted through the securing orifice 450 to attach the diluent reservoir 316 to the sprayer housing 312. In one embodiment, the diluent reservoir 316 is not removable by a user. Further, it is contemplated that the peripheral flange 318 circumferentially surrounding all or a portion of the outlet neck 317 engage the diluent reservoir cap 320 that is located within the sprayer housing 312. As such, either or both of the peripheral flange 318 and the securing orifice 450 assists in removably or more permanently attaching the diluent reservoir 316 to the sprayer housing 312. Further, the outer wall 336 of the diluent reservoir 316 is generally rectangular and box-shaped with one side of the outer wall 336 defining the concave sidewall 337. As noted previously, the concave sidewall 337 is adapted to be geometrically-compatible with the convex sidewall 393 of the adjacent or juxtaposed chemical concentrate container 361. It can be appreciated that any geometric configurations can be applied to either or both of the concave sidewall 337, the convex sidewall 393, or other portion of the diluent reservoir 316 or the chemical concentrate container 361. Further, it is contemplated that the outer wall 336 is substantially or slightly transparent to allow the user to monitor a fill level of the diluent reservoir 316. In other embodiments, the diluent reservoir 316 is substantially less transparent, opaque, and/or comprises a measuring scale of ounces, milliliters, a refill-indicating line, or other marks that may be useful for operation.

Figure 16:
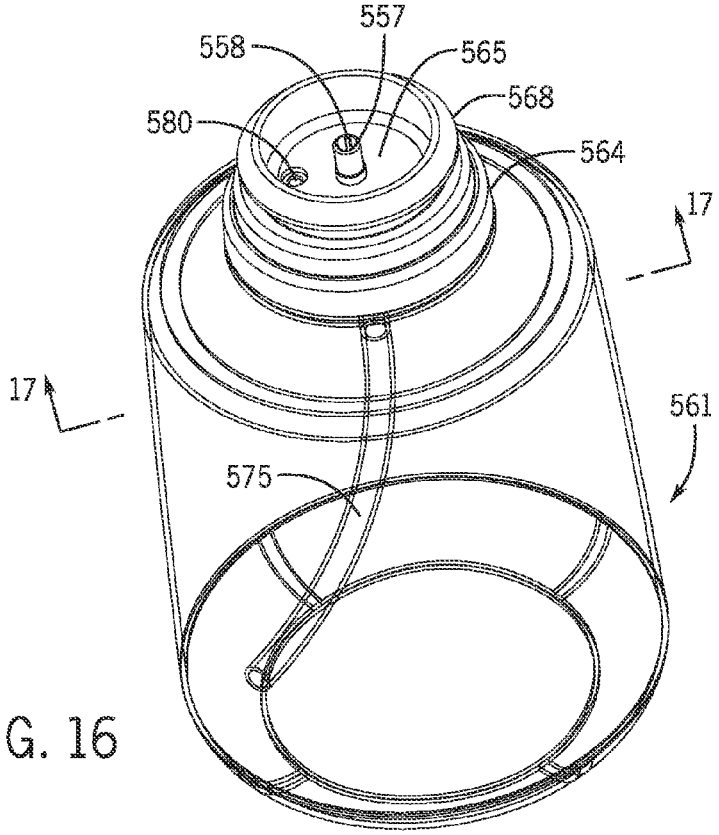
FIG. 16 is a top, right perspective view of one embodiment of the chemical concentrate container of FIG. 9 with a duckbill valve.
Figure 17:
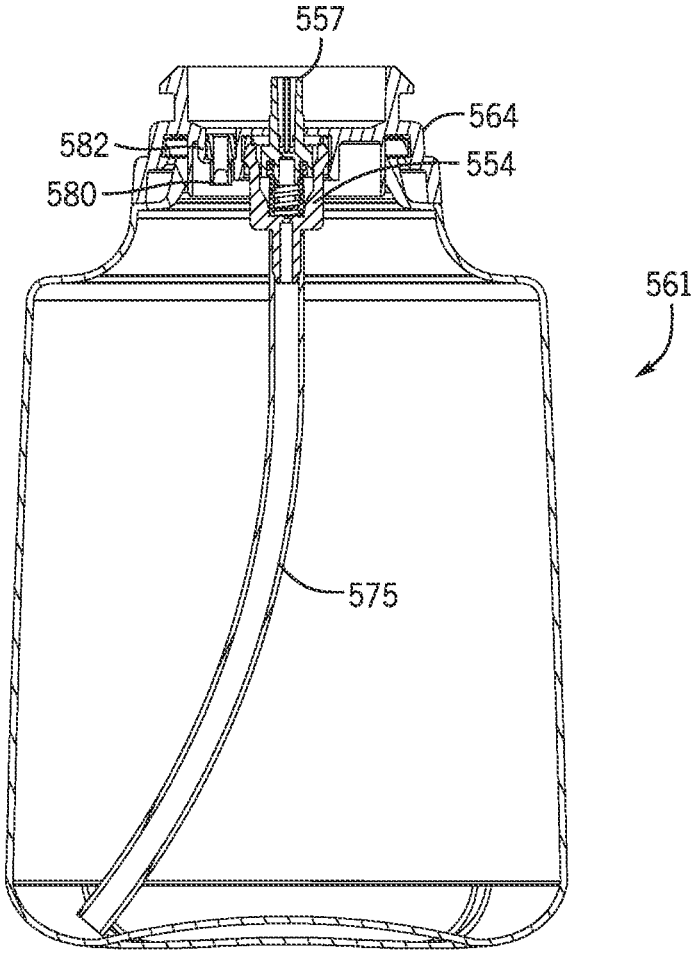
FIG. 17 is a cross-sectional view of the chemical concentrate container of FIG. 16 in a closed position taken along line 17-17 of FIG. 16.

Turning now to FIGS. 16 and 17, one embodiment of a chemical reservoir container 561 is shown comprising a one-way valve on a mounting cup 564. The chemical reservoir container 561 and the mounting cup 564 may be similar to the chemical reservoir container 361 and the mounting cup 364 described previously, except for the differences noted herein. In particular, the mounting cup 564 provides an upper plate 565 and a peripheral flange 568, which is received in the attachment mechanism 385 described above. The upper plate 565 receives therethrough a valve stem 557 having a flow passageway 558 that is fluidly aligned with a chemical dip tube 575, which extends from an underside of the upper plate 565 into the chemical reservoir container 561. Further, the upper plate 565 provides the one-way valve, such as a duckbill valve 580, that is radially spaced from the valve stem 557 and the valve body 554. In one non-limiting form, the duckbill valve 580 has a cracking pressure in the range of 0 to −1 psi (with the negative indicating flow direction). In one non-limiting form, the duckbill valve 580 is normally open. The duckbill valve 580 creates a liquid closed system which is liquid tight but not air tight.

As shown in FIGS. 17 and 24, the duckbill valve 580 is retained on the underside of the upper plate 565 by a valve retainer 582, which houses a portion of the duckbill valve 580 through a channel 584 that terminates with an inwardly projecting ring 586. The inwardly projecting ring 586 is a circumferential ring having a smaller diameter than the channel 584, such that the duckbill valve 580 can be slidingly placed within the channel 584 until a surface of the valve 580 catches the inwardly projecting ring 586 to prevent further insertion. In one aspect, as shown in FIG. 24, the one-way valve assembly is provided on the mounting cup 364 described above. It is contemplated that a portion of the valve retainer 582 is integrally formed or shares a portion of the inner skirt 366 that houses a valve body 554, which may be similar to the valve body 354. In an aspect, the duckbill valve 580 permits ambient air to enter the chemical concentrate container 561 to restore an internal pressure of the reservoir 561 by replacing space left by chemical dispensed from the reservoir 561. For instance, a vacuum can be created within the chemical concentrate container 561 upon exit of chemical concentrate leaving the reservoir 561. The duckbill valve 580 allows air to enter the reservoir 561 to restore an original pressure of the chemical concentrate container 561, which may be approximately an ambient pressure outside of the reservoir 561. Other valves that can permit entry of gases and restoration of the internal pressure may also be utilized, as described further below.

Figure 18:
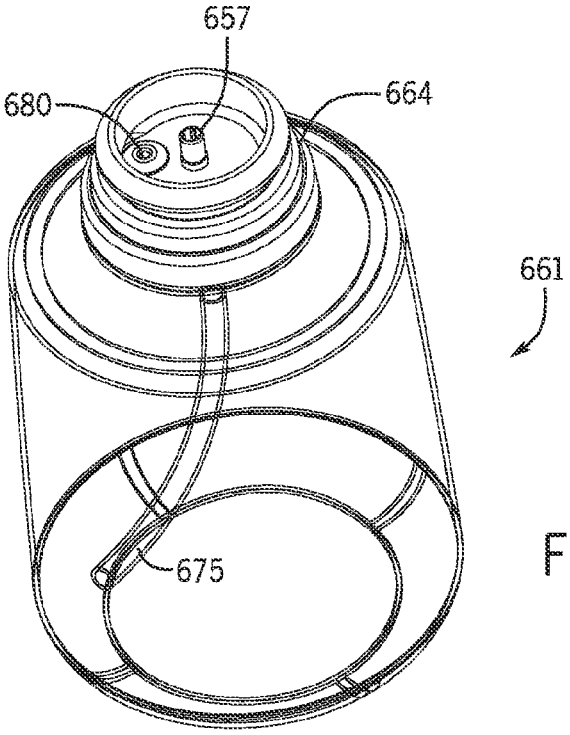
FIG. 18 is a top, right perspective view of another embodiment of the chemical concentrate container of FIG. 9 with a two-way valve.
Figure 19:
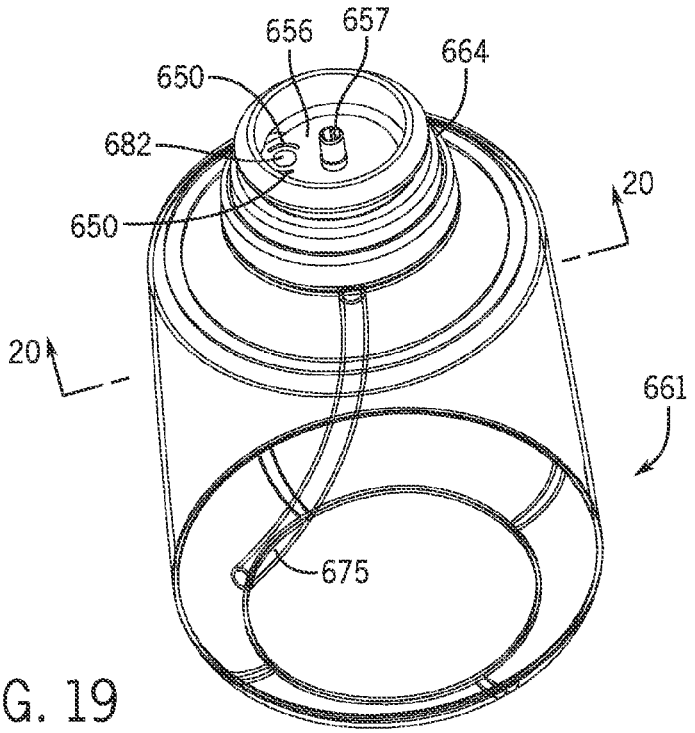
FIG. 19 is a top, right perspective view of the chemical concentrate container of FIG. 18 with the umbrella valve removed to reveal the fluid flow path.
Figure 20:
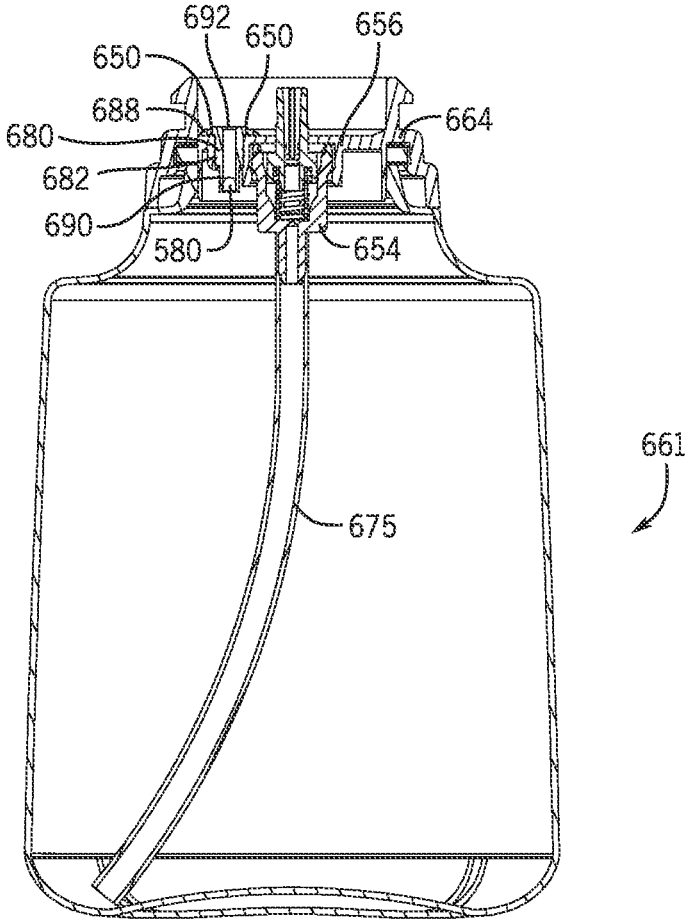
FIG. 20 is a cross-sectional view of the chemical concentrate container of FIG. 18 in a closed position taken along line 20-20 of FIG. 18.

Turning now to FIGS. 18-20, a two-way valve assembly is shown on a chemical reservoir container 661. A mounting cup 664 having a valve stem 657 protruding therethrough further provides an umbrella valve 680 adjacent to the valve stem 657. The valve stem 657 is in fluid communication with a chemical dip tube 675 that is retained within a valve body 654 attached to the mounting cup 664 and extended into the chemical concentrate container 661. The umbrella valve 680 is retained within a valve retaining orifice 682, which includes a channel 684 and an inwardly projecting ring 686 similar to the valve retaining mechanism described above. Further, the mounting cup 664 provides at least one valve seat flow hole 650 through an upper plate 656 of the cup 664. As shown in FIG. 19, two valve seat flow holes 650 are provided, with each valve seat flow hole 650 generally semicircular shaped. It is contemplated that other valve seat flow hole configurations can be applied, such as a circular valve seat flow hole.

As shown in FIG. 20, the two-way umbrella valve 680 includes the skirt 688 which rests above the upper plate 656 and a post 690 that extends through the valve retaining orifice 682. The post 690 comprises a one-way valve, such as the one-way duckbill valve 580 described above. As such, the skirt 688 is perforated with an open top 692 to expose the duckbill valve 580 retained within the post 690 extending from the skirt 688. The two-way valve permits gas generated by chemical concentrate to escape from the chemical concentrate container 561 and further permits ambient air to enter the reservoir 561 to displace chemical dispensed therefrom. In particular, it is the duckbill valve 580 that permits ambient air to enter the chemical concentrate container 661 to displace chemical dispensed therefrom and the skirt 668 permits gas generated by the chemical concentrate to exit through the valve seat flow hole 650. For example, when the chemical concentrate container 561 contains a concentrate including hydrogen peroxide, pressure may build in the chemical concentrate container 561 at up to 1 psi of pressure per day. The skirt 668 permits gas generated by the peroxide-containing concentrate to exit through the valve seat flow hole 650.

Figure 21:
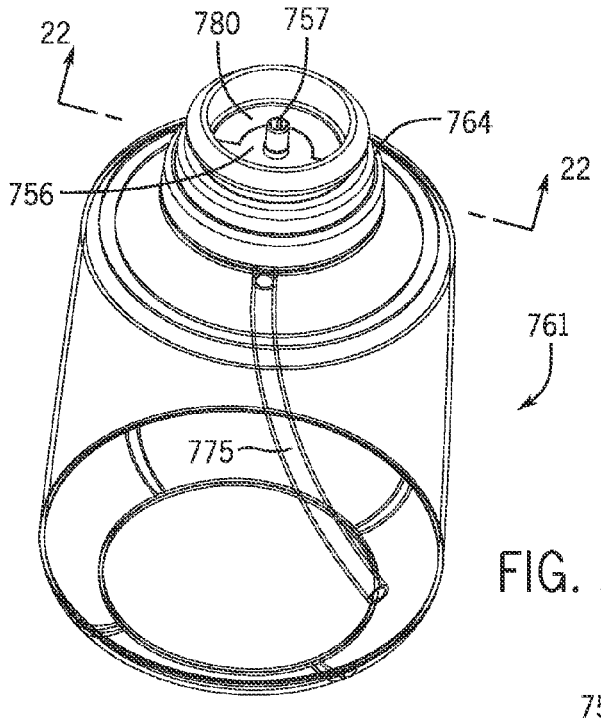
FIG. 21 is a top, right perspective view of yet another embodiment of the chemical concentrate container of FIG. 9 with a permeable two way valve.
Figure 22:
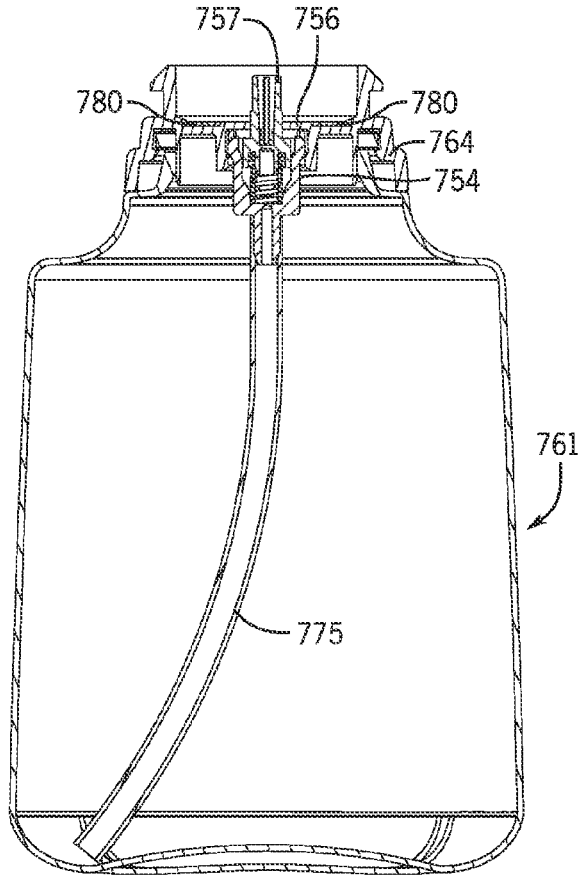
FIG. 22 is a cross-sectional view of the chemical concentrate container of FIG. 21 in a closed position taken along line 22-22 of FIG. 21.

Turning to FIGS. 21 and 22, a third embodiment of a chemical concentrate container 761 having a gas-permeable valve disposed on a mounting cup 764 is shown. The mounting cup 764 has a valve stem 757 protruding therethrough, which is retained by a valve body 754 having a chemical dip tube 775 secured thereto. The gas-permeable valve may comprise a membrane 780 of expanded polytetrafluoroethylene such as a Gore™ vent available from W. L. Gore & Associates, Inc., Elkton, Md., USA. The membrane 780, which may comprise another suitable porous polymeric membrane, is located on an upper plate 767 of the mounting cup 764. In some embodiments, the mounting cup 764 may provide a recess for receiving the membrane 780 therein. Further, the upper plate 767 may have gas-permeable characteristics similar to that of the membrane 780. In the present embodiment, the membrane 780 is a semicircular sheet of gas-permeable material surrounding a portion of the valve stem 757, although other shapes can be contemplated, such as a full ring or a plurality of sections of the material. It is contemplated that the gas-permeable material permits ambient air to enter the chemical concentrate container 761 to displace chemical dispensed therefrom and prevents liquids from exiting the container 761.

Figure 23:
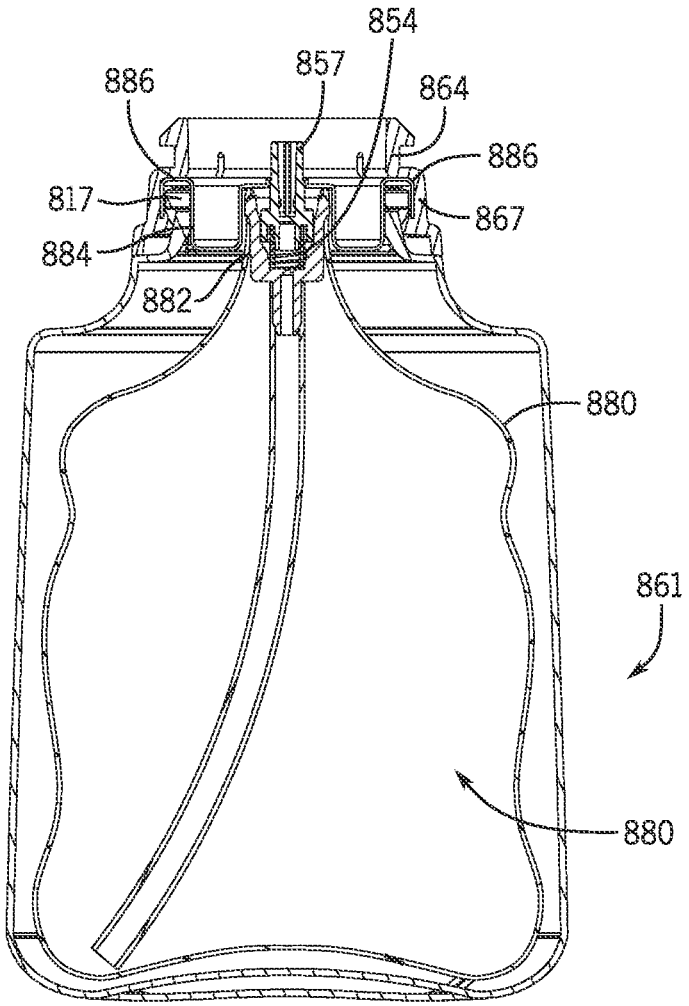
FIG. 23 is a cross-sectional view of still another embodiment of the chemical concentrate container of FIG. 9 with a flexible inner bag.

Referring to FIG. 23, a container of flexible material, such as a flexible inner bag 880, can be disposed within a chemical concentrate container 861 to hold a supply of chemical concentrate therein. It is contemplated that the flexible inner bag 880 has an opening 882 that is secured to a valve body 854 with assistance from a bag bracket 884. The bag bracket 884 may snugly fit around the valve body 854 and/or a portion of a valve stem 857 mounted within the valve body 854 to press-fit the inner bag 880 around the valve body 854. Further, the bag bracket 884 may define a circumferential lip 886 that is adapted to be received over an outlet neck 817 of the chemical concentrate container 861. As such, the circumferential lip 886 is further retained onto the outlet neck 817 by an inner surface of the mounting cup 864, such as an inner surface defined by an underside of a lower well 876 of the mounting cup 864. The lower well 876 may be similar to the lower well 367*a* described above. Furthermore, it is contemplated that a venting apparatus or an inner plate similar to the inner plates described above are not provided on the mounting cup 864, since the flexible inner bag 880 can shrink during usage. In one aspect, the flexible inner bag 880 can be used with or without the chemical concentrate container 861.

Further, it is contemplated that a kit can be provided to include a first chemical concentrate container and a second chemical concentrate container. The first and second chemical concentrate containers can comprise any of the above-described chemical concentrate containers. It is contemplated that the first chemical concentrate container can contain a first chemical and include a valve body that has a first entry orifice, which has a first restriction orifice located therein. Further, it is contemplated that the second chemical concentrate container contains a second chemical and includes a second entry orifice in fluid communication with a closed space of the second container. The second entry orifice has a second restriction orifice located therein. It is contemplated that the first restriction orifice comprises different restriction characteristics, such as a different transverse area, than the second restriction orifice. Further, the first and the second chemicals can be the same or different. It can be appreciated that additional chemicals and chemical concentrate containers can be incorporated to the fluid application system described herein.

Turning to FIGS. 25-28, further advantages of the fluid application systems described herein are illustrated. A general fluid application system 900 comprises a sprayer head 902 having a nozzle 904 and a trigger 906 provided on or adjacent to a front side 908 of the sprayer head 902, which opposes a rear side 910 thereof. In general, the front side 908 of the sprayer 902 corresponds to a front 912 of the fluid application system 900 and the rear side 910 of the sprayer head 902 corresponds to a rear 914 of the fluid application system 900. It is also contemplated that other sprayer head 902 geometries may be used, which may be generally characterized as having front portions for emitting a spray and opposing rear portions. It is further contemplated that the trigger 906 or a button may be placed anywhere on a sprayer head, but conventionally is placed on the front side 908 of such devices.

Figure 25:
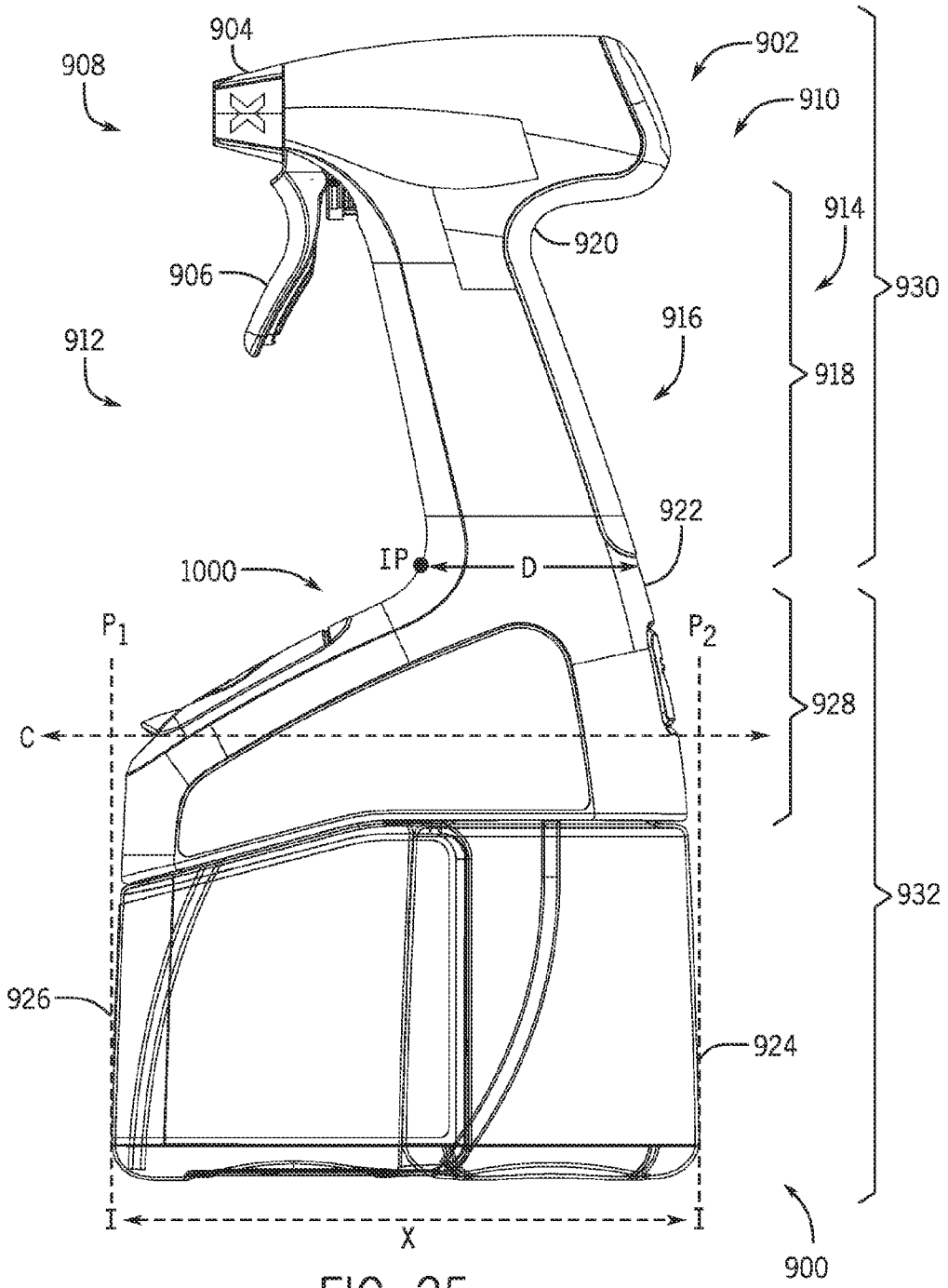
FIG. 25 is a right side perspective view of another embodiment of a fluid application system in accordance with the invention.
Figure 26:
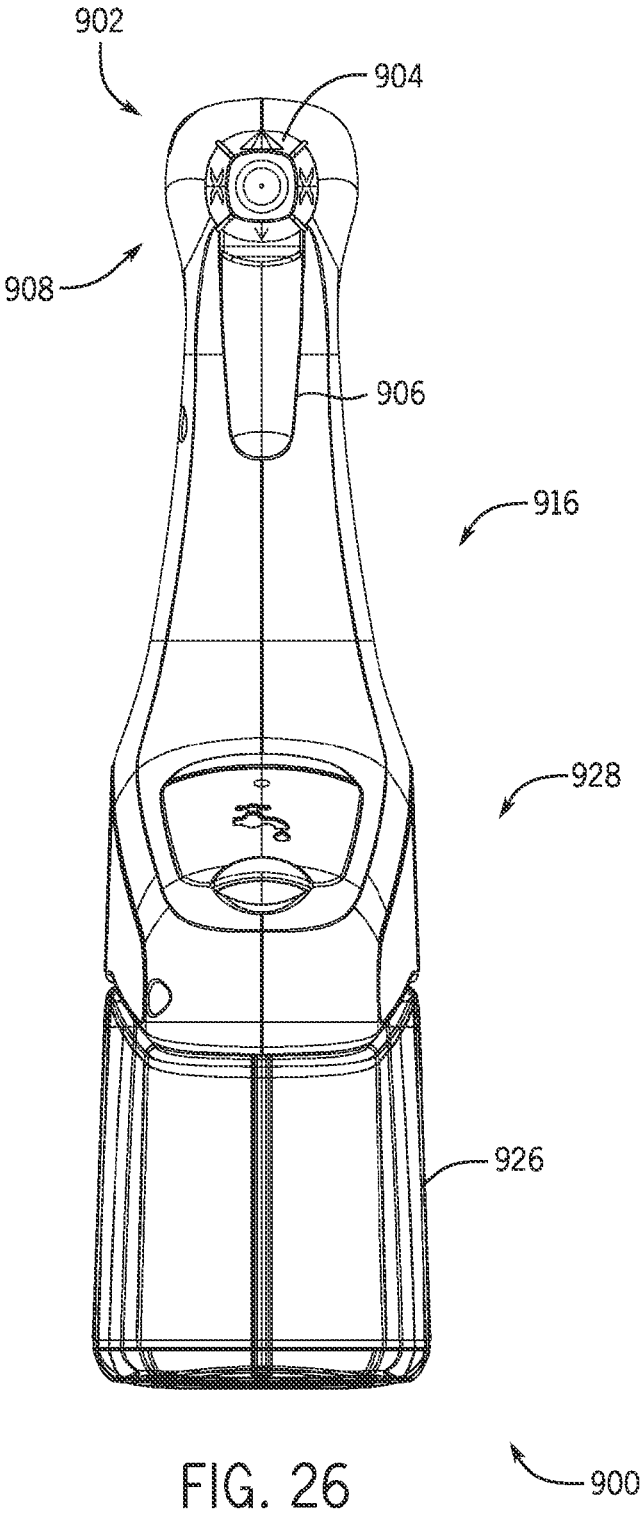
FIG. 26 is a front perspective view of the fluid application system of FIG. 25.

The sprayer head 902 is disposed on a sprayer neck 916, which may be generally referred to as a gripping portion or a member having a neck body 918. In the present exemplary embodiment, the sprayer head 902 is provided on an upper end 920 or distal end of the neck body 918. A lower end 922 or proximal end of the sprayer neck 916 is disposed proximate a refill container 924. More specifically, the lower end 922 of the sprayer neck 916 of the present embodiment is provided adjacent the refill container 924 and adjacent the diluent container 926. In some embodiments, as illustrated in FIGS. 25 and 26, the sprayer neck 916 attaches to and/or is adjacent to a container housing 928 or retention structure, which receives therein at least a portion of the refill container 924 and the diluent container 926. In other embodiments, it can be appreciated that the container housing 928 is formed by the lower end 922 of the sprayer neck 916. In general, it is contemplated that all or a portion of the neck body 918 that is grippable by a user is provided above all or a portion of the refill container 924 and the diluent container 926, or, in other embodiments that it is provided above one or more reservoirs for holding a product therein. In some embodiments, the sprayer head 902 may be characterized as disposed on a top half 930 of the fluid application system 900 and that the refill container 924 and the diluent container 926 (or the one or more reservoirs) are disposed on a bottom half 932 of the system 900.

Figure 27:
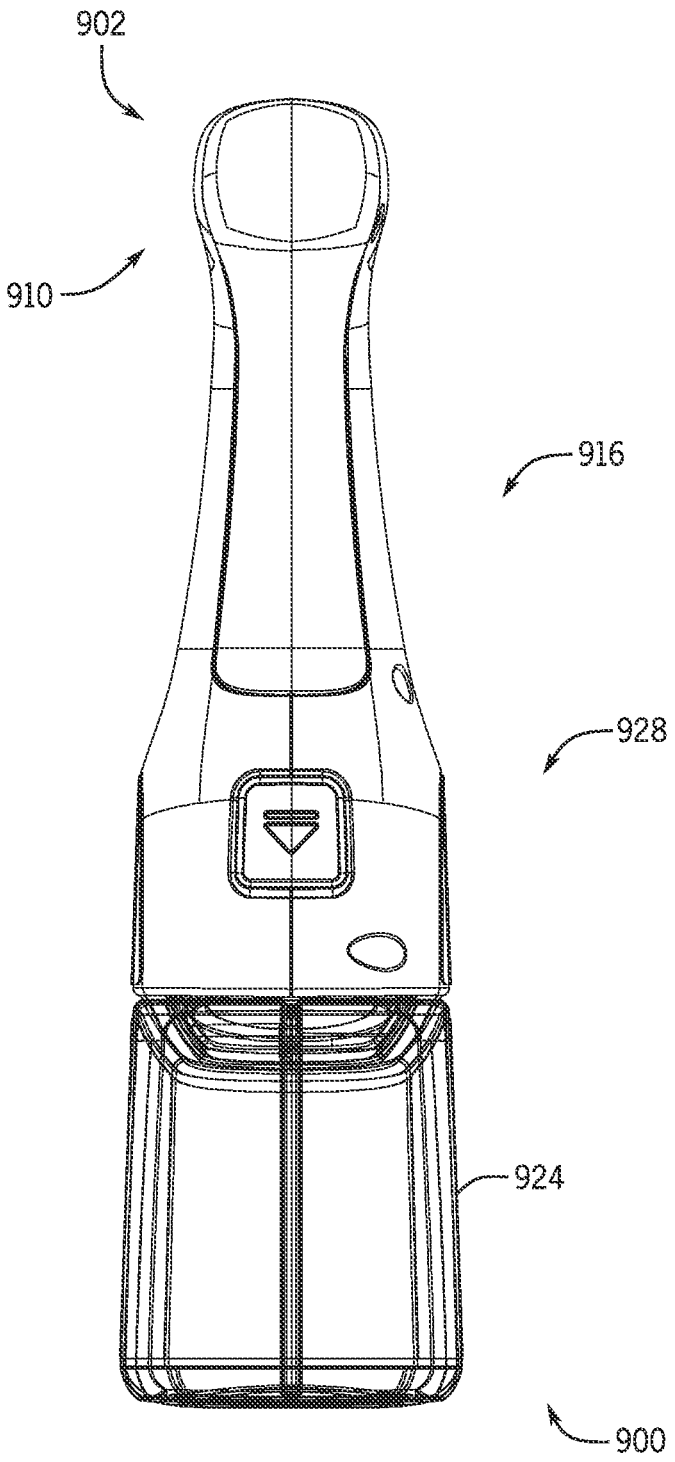
FIG. 27 is a rear perspective view of the fluid application system of FIG. 25.

FIG. 26 shows a front view of the fluid application system 900, whereby the trigger 906 and the nozzle 904 on the front side 908 of the sprayer head 902 are disposed above the diluent container 926. FIG. 27 shows a rear view of the fluid application system 900 with the rear side 910 of the sprayer head 902 disposed above the refill container 924. In both of the front and rear views of FIGS. 26 and 27, the sprayer neck 916 and the container housing 928 extend between the sprayer head 902 and all or a portion of the refill and diluent containers 924, 926.

Figure 28:
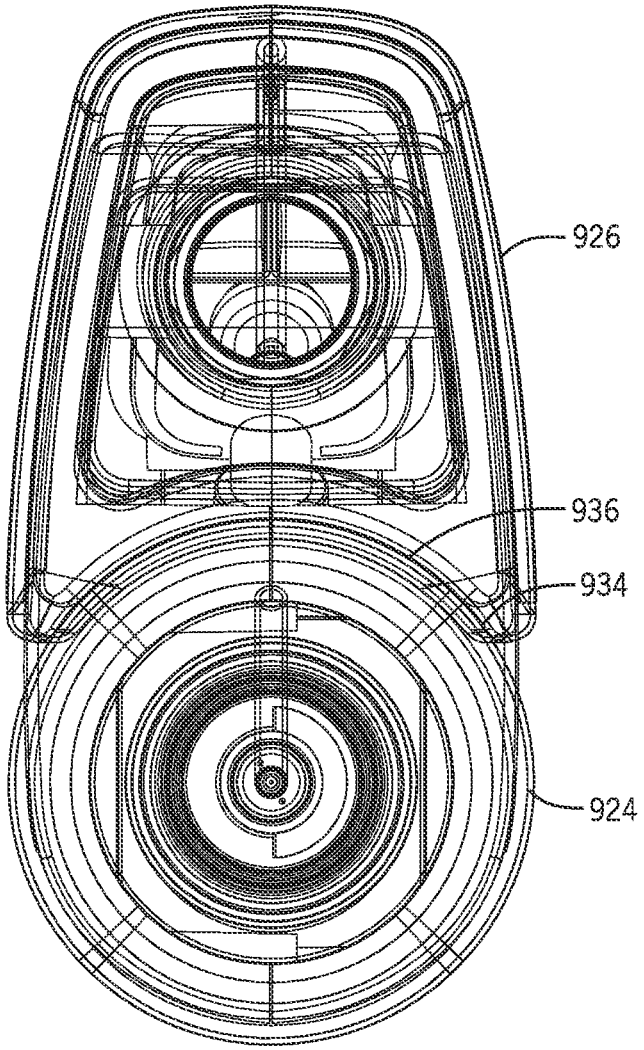
FIG. 28 is a bottom perspective view of the fluid application system of FIG. 25.

Turning to FIG. 28, the positioning of the diluent container 926 relative to the refill container 924 is shown when attached to the container housing 928. The refill container 924 comprises a convex sidewall 934 that is adjacent to a concave sidewall 936 of the diluent container 926. Other geometric shapes for the refill container 924 and the diluent container 926 can be contemplated that may be complementary or non-complementary together, such as flat sidewalls, a convex diluent sidewall adjacent to a concave refill sidewall, flexible or amorphous sidewalls, and the like. Further, the refill and diluent containers 924, 926 may be transparent to provide a visual indication of the fluid level in the containers 924, 926. With the refill container 924 and the diluent container 926 assembled onto the fluid application system 900, it is contemplated that the sprayer neck 916 operates as a handle or a gripping portion for a user to grasp and actuate the fluid application system 900.

In a particular aspect, the dispensing system described above is adapted to simultaneously dispense product contained within at least two separate reservoirs for exit through the same sprayer head assembly. Such multi-reservoir dispensers have structural and operational requirements that are different than single-container reservoirs, which need only dispense a product contained within a single container. For instance, structural considerations such as placement, balance, and attachment of the multiple reservoirs to the multi-reservoir dispenser are introduced, such as allowing for each reservoir to be attached and/or detached independently. Further, the multi-reservoir dispenser needs to be adapted to support the additional weight and dynamics of the additional reservoir(s). Even further, the multi-reservoir dispensers are typically sized with about the same geometry as single-reservoir dispensers to allow handheld user operation, yet may have more components and moving parts for dispensing the multiple products. Thus, multi-reservoir dispensers have more imbalances, weight considerations and complexities within their systems. As such, the multi-reservoir dispensers behave and respond differently during operation than single-reservoir dispensers.

Furthermore, some multi-reservoir dispensers, such as the fluid application system 900 described herein, are adapted to dispense the constituent components from one reservoir at a faster rate than the constituent components from the remaining reservoir to achieve different mix ratios that comprise the product being dispensed. As such, one reservoir is depleted before the remaining reservoir during normal operation. For instance, one reservoir may be half full while the remaining reservoir is substantially fuller than the other reservoir. The different dispensing rates between the two reservoirs create dynamic imbalances throughout the normal operational period, which are not as prevalent in single reservoir dispensers or multi-reservoir dispensers having the same dispensing rate for the multiple reservoirs. In a particular aspect, the dynamic imbalances that occur are not linear as they may be in a single reservoir dispenser, because there are two reservoirs having different weight distributions and different changes in weight throughout operation. While a single-reservoir dispenser is optimized for a particular operational envelope exhibiting dynamics that are generally linear over time, a multi-reservoir container must be optimized for a variety of dynamic, non-linear behaviors, such as the changing balance of the system due to weight differences between the reservoirs, which effect the center of gravity of the system and torque forces exhibited by the system. As such, for multi-reservoir dispensers, it is necessary to create an optimal design for a complex operational envelope while still balancing ergonomics and ease-of-use considerations for the user.

The above concerns are addressed herein in various manners as described below and as shown in FIGS. 25-35. To achieve a balanced multi-reservoir dispenser that provides optimum performance for a dispensing period having dynamic imbalances during normal usage, the dispenser herein is designed for an operational profile that is most prevalent during the lifetime of the dispenser. In one embodiment, the operational profile is a state when the diluent reservoir 926 is partially full and the refill reservoir 294 is full. In an alternative embodiment, the operational profile is a state when the diluent reservoir 926 is about 70 percent to about 80 percent full and the refill reservoir 294 is substantially full or fuller than the diluent reservoir 296. In another alternative embodiment, the operational profile is a state when the diluent reservoir 926 is about 40 percent to about 60 percent full and the refill reservoir 924 is substantially full or more full than the diluent reservoir 926. In the present embodiment, the operational profile of the fluid application system 900 is considered with the diluent reservoir at about 50 percent full and the refill reservoir 924 being full or substantially full.

It is contemplated that a balanced system for any of the operational profiles above can be achieved by optimizing the placement of the sprayer neck 916 on the fluid application system 900. Referring to FIGS. 25-27, it is contemplated that the sprayer neck 916 is characterized by a grippable portion of the fluid application system 900 that is adapted to be grasped by the user when actuation of the system 900 is desired. In the present embodiment, the grippable portion is provided between the sprayer head 902 and the refill and diluent containers 924, 926. It can be contemplated in other systems, however, that the grippable portion is above or includes the sprayer head 902, or the grippable portion is below or above the refill and diluent containers 924, 926, or in any other possible orientation. In general, the sprayer neck 916 is characterized by a surface adapted to receive the user's grip during deployment and operation of the device. It is noted that the sprayer neck 916 may extend beyond the gripping surface as well. In one embodiment, the gripping surface comprises finger grips, ribs, rubberized tracks, indents or other markings to indicate its purpose and/or to facilitate its grasping.

Referring to FIGS. 25-27, a lower end or a lower boundary of the sprayer neck 916 or gripping portion may be better understood. In one embodiment, the sprayer neck 916 is defined as the neck body 918 disposed above or received over the refill and diluent containers 924, 926, which have an uppermost portion of both of the containers that extends to a line C in FIG. 25. In particular, the lower end 922 of the sprayer neck 916 is received over the refill and diluent containers 924, 926 and the neck body 918 continuously extends thereabove. In a different embodiment, the lower end 922 extends below the line C, thereby receiving a portion of the refill and diluent containers 942, 926, therein. In other aspects, the sprayer neck 916 can be defined by the lower end 922 of the sprayer neck 916 having a neck securement region 1000, which may be further emphasized by a concave surface or inflection point IP which separates the container housing 928 from the lower end 922 of the sprayer neck 916. The inflection point IP may occur above the line C as shown in FIG. 25 or below it, and such a demarcation of the lower boundary of the neck 916 is shown as a line D in the present embodiment. In a further aspect, the lower end 922 of the sprayer neck 916 is an end of the neck 916 that is proximal to retention structures within the container housing 928 for retaining the refill and diluent containers 924, 926. Even further, it is contemplated that the sprayer neck 916 comprises a lower end 922 defined by a narrowest cross-section portion of the container housing 928 which retains the refill and diluent containers 924, 926. As shown in FIG. 25, it is contemplated that the narrowest cross-section of the container housing 928 also defines an uppermost region of the housing 928 where the lower end 922 of sprayer neck 916 begins. However, regardless of the manner in which the lower boundary of the neck is defined given a particular dispensing system and neck, it is understood that all portions of the neck must be grippable and/o adapted to be so gripped during normal use of the sprayer, i.e., actuation and movement of the sprayer. In the present embodiment, the lower boundary of the neck 916 is indicated by the line D.

Still referring to FIG. 25, the sprayer neck 916 is generally displaced off-centered or toward the rear 914 of the fluid application system 900. It is contemplated that this positioning may contribute to an optimized system that is balanced for the most common usage conditions, and particularly for the condition where the diluent container 926 is fifty percent full while the refill container 924 is full. In an aspect, the sprayer neck 916 is disposed substantially above the refill container 924, which is dispensed less quickly and therefore exhibits less change (or a lower loss) in weight and mass over a period of dispensing. In one particular embodiment, a distance X is measured between peripheral portions of the refill and diluent containers 924, 926 as shown in FIG. 25. More particularly, the refill and diluent containers 924, 926 may be juxtaposed or adjacent to one another and include portions that are distal to other portions of the corresponding containers. In the particular embodiment, two parallel lines P1, P2 tangent to the outermost distal portions of the refill and diluent containers 924, 926 represent a linear distance X, which extends therebetween, transversely or perpendicular to the parallel lines P1, P2. Such a distance X may also be the distance between distal portions of a single container with multiple reservoirs. In some embodiments, it is contemplated that the lower end 922 of the sprayer neck 916 has a cross section with a width taken from the front 912 to the rear 914 that is between about 0.30*X to about 0.60*X; more preferably between about 0.40*X to about 0.50*X; and most preferably between about 0.42*X to about 0.48*X. In some embodiments, it is contemplated that the inflection point IP is positioned beyond a point X/2 of the linear distance X.

Figure 29A:
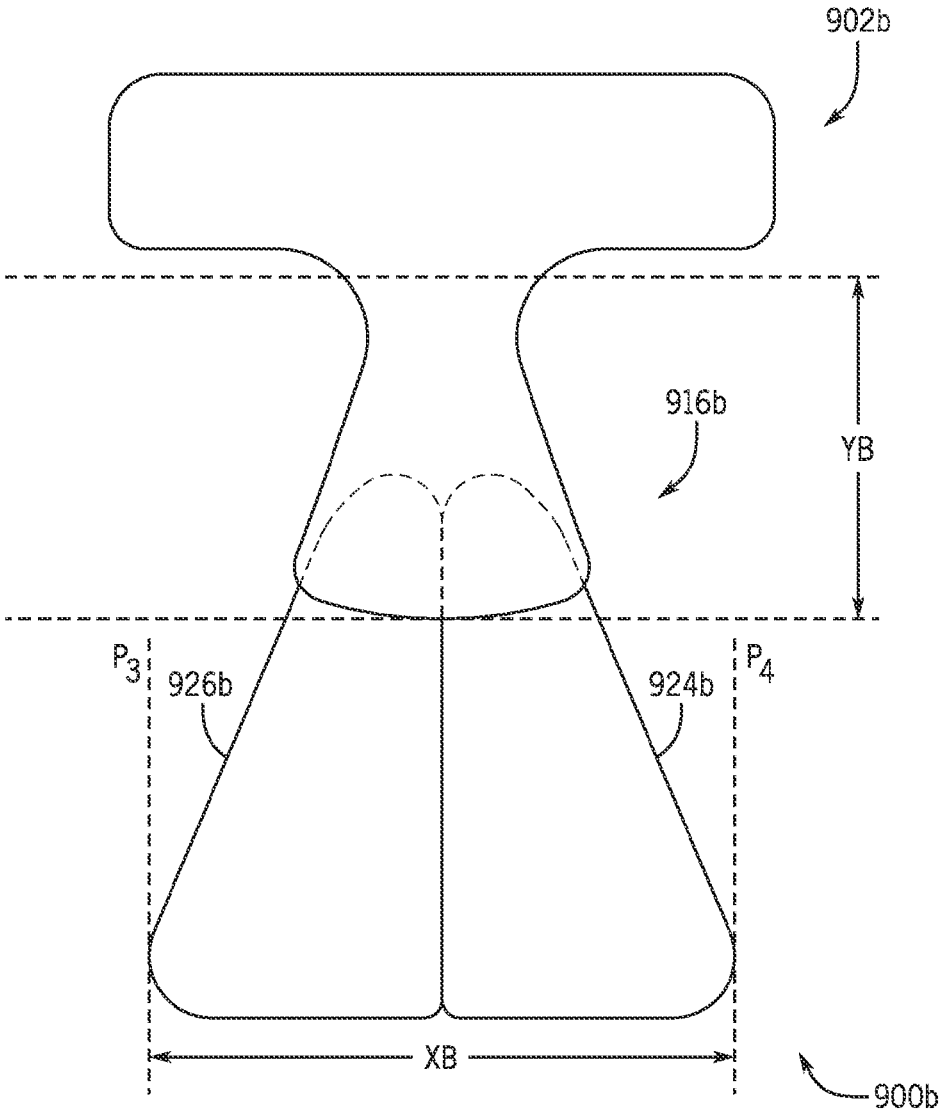
FIGS. 29A-C are schematic diagrams of additional fluid application systems and containers in accordance with the invention.
Figure 29B:
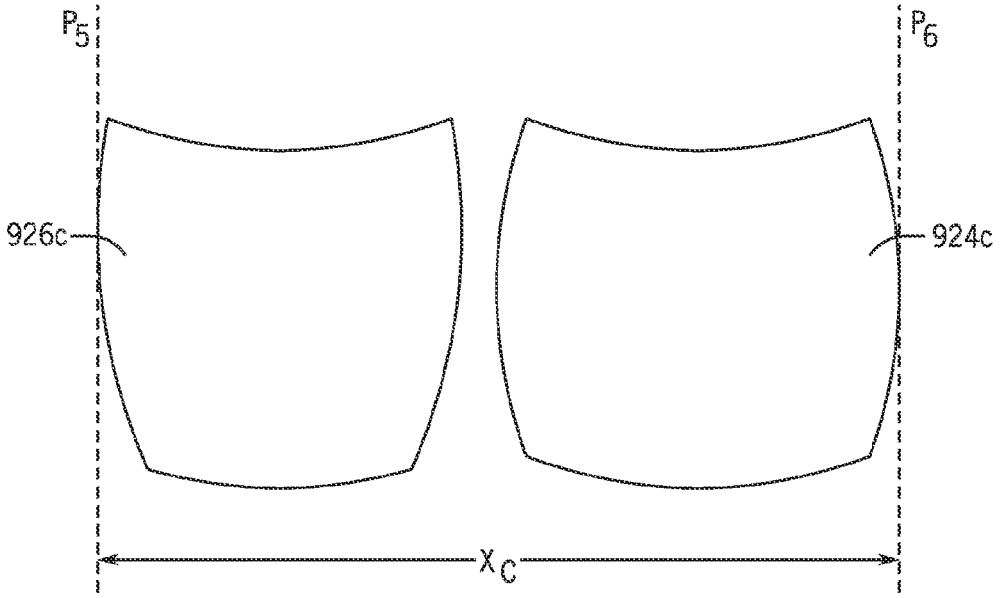
Figure 29C:
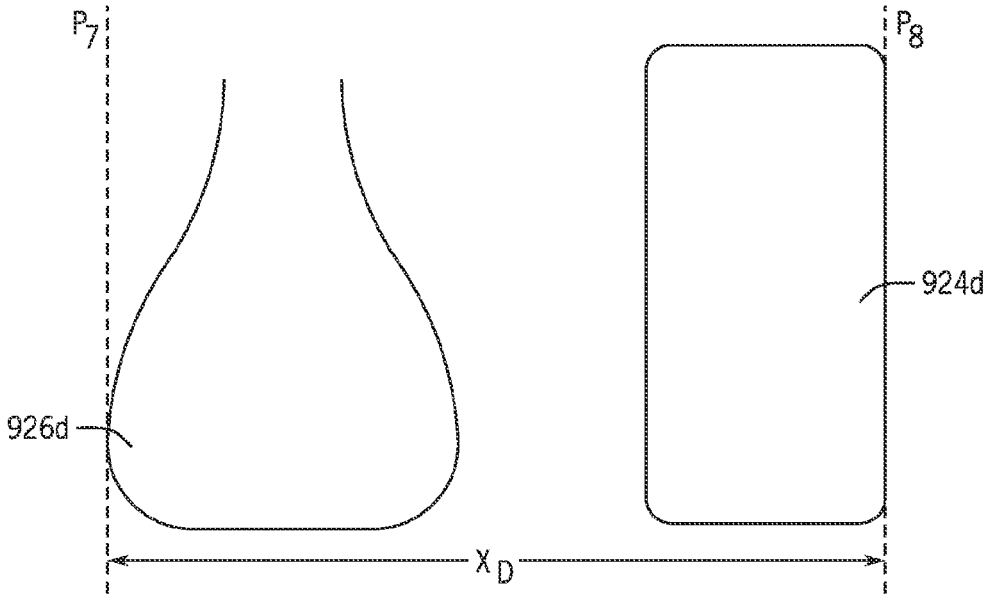

Turning to FIGS. 29A-C, it is further understood that the containers or reservoirs may have different volume and/or geometric shapes, but it is also understood that a linear distance between distal portions of such containers or reservoirs may be calculated based on a straight line defined between the outer portions that are farthest from one another. For instance, FIG. 29A illustrates a fluid dispensing system 900*b* comprising two angular containers 924*b*, 926*b* received within a neck 916*b* that extends to a sprayer head 902*b*. In this configuration, a horizontal distance $X_B$ is defined between two parallel lines P3, P4 that are tangent to the outermost peripheries of the containers 924*b*, 926*b*. Further, it is noted that the neck 916*b* is centrally disposed and comprises a height $Y_B$ that receives therein a portion of the containers 926*b*, 924*b*.

FIGS. 29B and 29C show other geometric shapes for containers that define a horizontal distance based on the outer peripheries of their geometries. In particular, FIG. 29B shows two rounded containers 924*c*, 926*c* that define a horizontal distance $X_C$ between two parallel lines P5, P6, which bound the outermost peripheries of the containers 924*c*, 926*c*. Similarly, FIG. 29C illustrates two non-complementary shaped containers 924*d*, 926*d* that define a horizontal distance $X_D$ between two parallel lines P7, P8, which bound the outermost peripheries thereof. It is contemplated that the horizontal lines defined herein are transverse and perpendicular to their respective parallel lines P1-P8.

Referring back to FIG. 25, the sprayer neck 916 is elongate-shaped, angled forward at the lower end 922 toward the front 912 of the fluid application system 900, and substantially disposed off-centered, toward a rear 914 of the system 900 above the refill container 924. It is contemplated that the present embodiment provides several advantages over other dispensing systems known in the art. For instance, it is easier for a user to operate the fluid application system 900 than previous dispensers due to the significantly improved ergonomic characteristics that are uniquely achieved by the present configuration. In operation, the user's experience during a dispensing period of the fluid application system 900 is enhanced by the present configuration, which directly mitigates the longstanding problem of torque-related dynamics imparted on the user's joints over a period of dispensure. In particular, such problems that were encountered and considerably alleviated herein include wrist discomfort and other human joint-related strains that afflict operation of other dispensing systems known in the art. More particularly, a focus of improving the user experience herein involves optimizing the gripping portion or member of the fluid application system 900, such as a position of the sprayer neck 916, in a common usage situation whereby a front container, e.g. the diluent container 926, is emptied at a faster rate than a rear container, e.g. the refill container 924. In fact, such a system may also benefit other sprayers that utilize a single container with two or more reservoirs or sprayers with two or more separate containers, in which one of the containers and/or reservoirs is emptied at a faster rate during normal usage.

Figure 30:
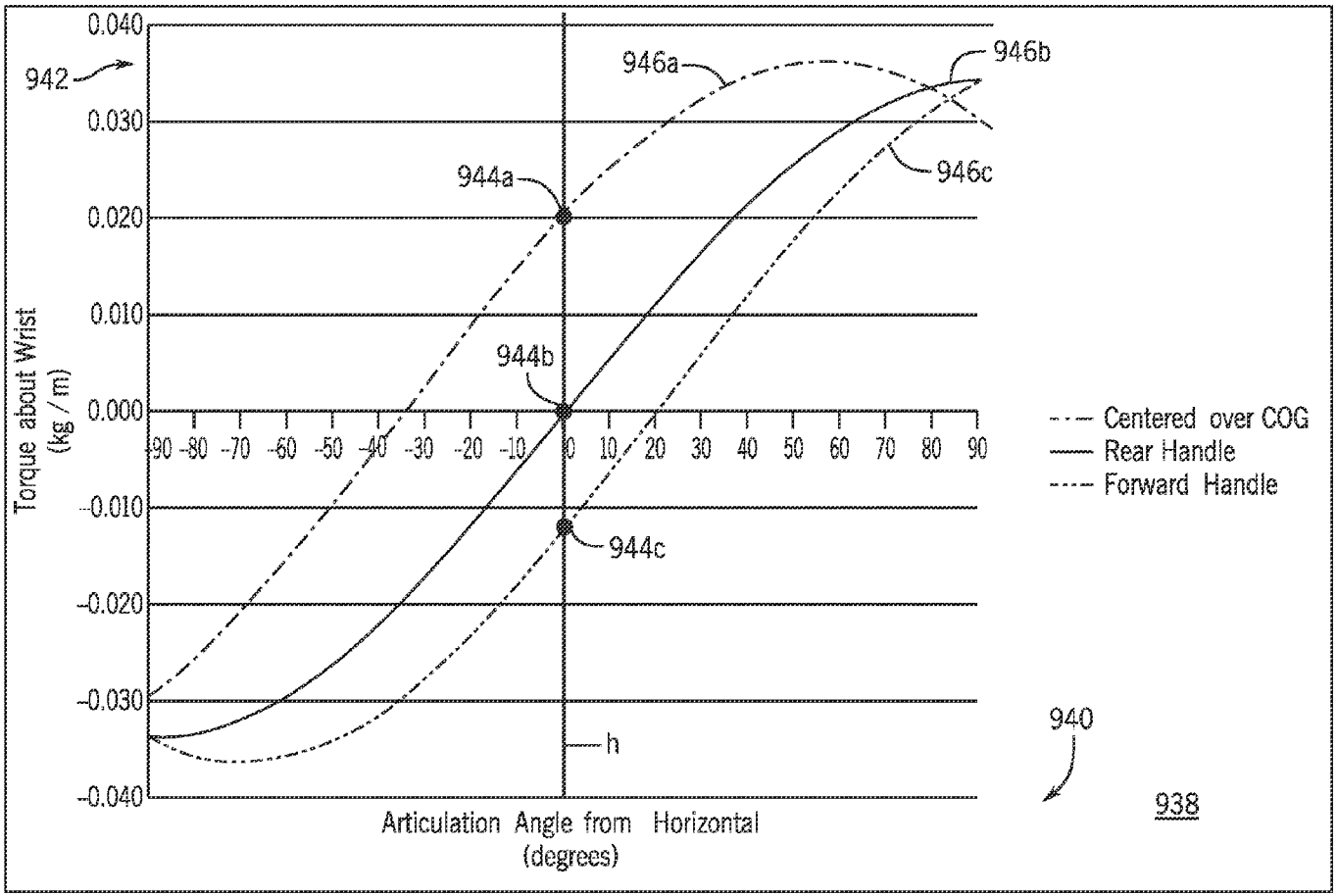
FIG. 30 is a plot of results from a theoretical analysis of the fluid application system of FIG. 25.

Referring to FIG. 30, results from an optimization analysis of the position of the sprayer neck 916 to enhance ergonomic characteristics of the fluid dispensing system 900 are shown. The optimization analysis was utilized to minimize forces and torques about the user's joints, with a primary focus being minimization of the torque force about the user's wrist. In the theoretical study, three different positions of the sprayer neck 916 were analyzed and their torque profiles plotted. A half-filled diluent container 926 and a full refill container 924 were assumed to simulate a typical usage situation, in which the diluent contained in the diluent container 926 is used up at a faster rate than the refill contained in the refill container 924.

FIG. 30 shows a plot of torque about the user's wrist across various angles of articulation of the user's arm during usage of various positions of the sprayer neck 916. Particularly, an x-axis 940 of arm articulation angles from a horizontal plane in degrees and a y-axis 942 of the torque about the user's wrist in kg/m are provided. A vertical line h represents a horizontal arm position, in which the arm is stretched horizontally outward in line with a horizontal plane, such as a planar floor, and thus is zero degrees above or below the horizontal. The vertical line h forms intersection points 944*a*, 944*b*, 944*c* with a torque curve 946*a* measured in a forward position, a torque curve 946*b* measured in an off-center position, and a torque curve 946*c* measured in a rear position. It was understood that as the user rotated their arm up or down, i.e., above or below the horizontal, a torque about the user's wrist was created.

Figure 31A:
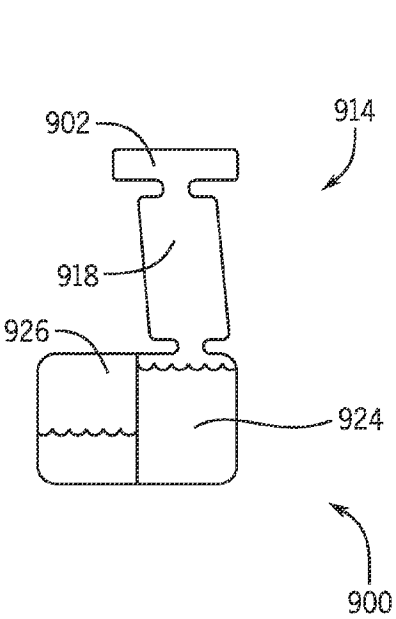
FIGS. 31A-C are schematic diagrams of various scenarios analyzed in the theoretical analysis of the fluid application system of FIG. 25.

Referring to FIGS. 30 and 31A-C, in one analysis the sprayer neck 916 is located in a forward position on a fluid application system 900 as shown in FIG. 31A, whereby the sprayer neck 916 is to a greater extent disposed above the diluent container 926. This representation is also illustrative of a sprayer neck 916 provided above one reservoir of a multi-reservoir single container that evacuates a product to a greater extent than the other reservoir(s). The forward position produces the torque curve 946*a* that intersects with the horizontal arm curve h at the intersection point 944*a*. The intersection point 944*a* indicates that at a zero angle horizontal arm position where the user grips the forward positioned sprayer neck 916, a torque of approximately 0.020 kg/m about the user's wrist in the horizontal position is created. The torque increases as the user's arm is raised from the horizontal to about 55 degrees above the horizontal where the torque climbs to about 0.035 kg/m. The torque about the wrist then drops as the arm is continued to be raised from 55 degrees and 90 degrees above the horizontal, where the torque drops to about 0.029 kg/m. Similarly, as the user lowers their arm from the horizontal, where the torque starts at 0.020 kg/m, the torque drops to zero when their arm is about 35 degrees below the horizontal. The torque then gradually increases in an opposing direction when the arm moves from 35 degrees below to 90 degrees below the horizontal, where the torque increases to 0.029 kg/m.

Figure 31B:
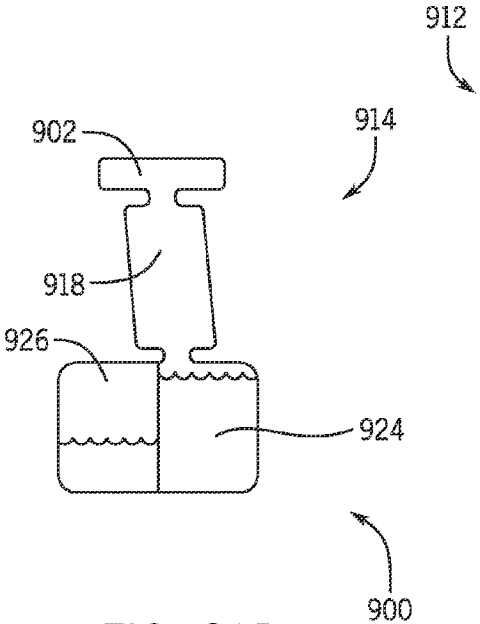

A second analysis was performed with the sprayer neck 916 located at an off-centered position on the fluid application system 900 as shown in FIG. 31B, whereby the sprayer neck 916 is disposed to a lesser extent over the diluent container 926 and to a greater extent over the refill container 924 or biased toward the rear 914 of the fluid application system 900. Such representations are also illustrative of a sprayer neck 916 provided off-centered above one reservoir of a multi-reservoir single container that evacuates a product to a greater extent than the other reservoir(s). The off-center position produces the torque curve 946*b* that intersects with the horizontal arm curve h at the intersection point 944*b*, which indicates that by offsetting the sprayer neck 916 from the center of the fluid application system 900, there is zero torque about the user's wrist in the horizontal position. The torque increases as the user's arm rises from the horizontal to 90 degrees above the horizontal, where to about 0.033 kg/m. As the user's arm lowers from the horizontal to 90 degrees below the horizontal, the torque increases to about 0.033 kg/m in the opposite direction. It is noted that a maximum torque felt by the user in the off-centered position, 0.033 kg/m, is theoretically less than the maximum torque felt by the user in the forward position at 0.035 kg/m, as described above.

Figure 31C:
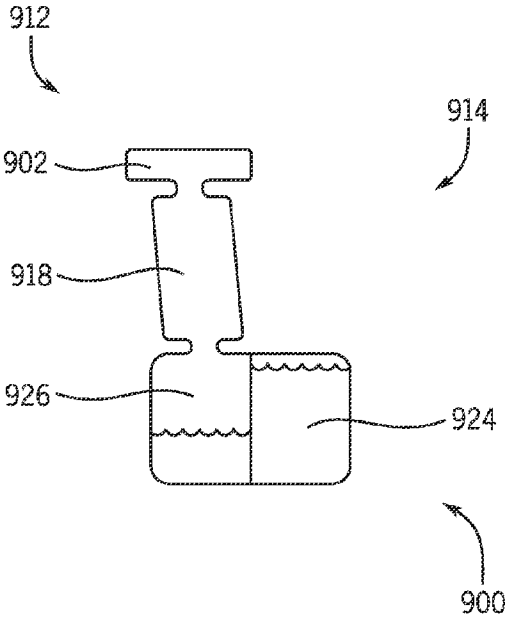

In a third analysis, the sprayer neck 916 was disposed at a rear position of the fluid application system 900 as shown in FIG. 31C, whereby the sprayer neck 916 is disposed predominately over the refill container 924. This representation is also illustrative of a sprayer neck 916 provided above a rear portion of one reservoir of a multi-reservoir dispenser that evacuates a product from one reservoir more quickly than the other reservoir(s). The rear position produces the torque curve 946*c* that intersects with the horizontal arm curve h at the intersection point 944*c*, which indicates that a torque of approximately 0.012 kg/m is created about the user's wrist in the horizontal position. Moving upward on the curve 946, the torque decreases to zero when the arm is raised about 20 degrees from the horizontal. As the user's arm continues to be raised from 20 degrees to 90 degrees above the horizontal, the torque gradually increases to about 0.033 kg/m. On the other hand, as the user's arm lowers from the horizontal to about 70 degrees below the horizontal, the torque increases to a maximum of about 0.035 kg/m. As the user's arm continues to drop from 70 degrees to 90 degrees below the horizontal, the torque decreases from about 0.035 kg/m to about 0.033 kg/m. It is noted that a maximum torque felt by the user in the rear position, 0.035 kg/m, is theoretically larger than the maximum torque felt by the user in the off-center position at 0.033 kg/m.

As such, the three positions that were analyzed indicate that the location of the sprayer neck 916 is optimized in the off-centered position for the usage situation where the diluent container 926 is half full and the refill container 924 is full. The off-centered position achieves zero torque about the user's wrist at the horizontal, zero-degree position and provides the lowest torque through the articulation angles from the horizontal for all three positions. In a further aspect, it is understood that as the fluid application system 900 is used and contents are depleted from the refill container 924 and the diluent container 926, a center of gravity Cg changes and thus requires the position of the sprayer neck 916 to change in order to achieve a more balanced system 900 with the user's arm in the horizontal position. For instance, in usage situations where the diluent container 926 is more full than the refill container 924, the sprayer neck 916 should be positioned biased toward the front 912 of the fluid application system 900. On the other hand, in usage positions where the diluent container 926 is less full than the refill container 924, the sprayer neck 916 should be positioned biased toward the rear 914. Given the present situation where the diluent container 926 empties faster than the refill container 924 and is therefore typically less full than the refill container 924 during a usage period, the optimal sprayer neck 916 positioning is biased toward the rear 914 of the fluid application system 900.

Figure 32:
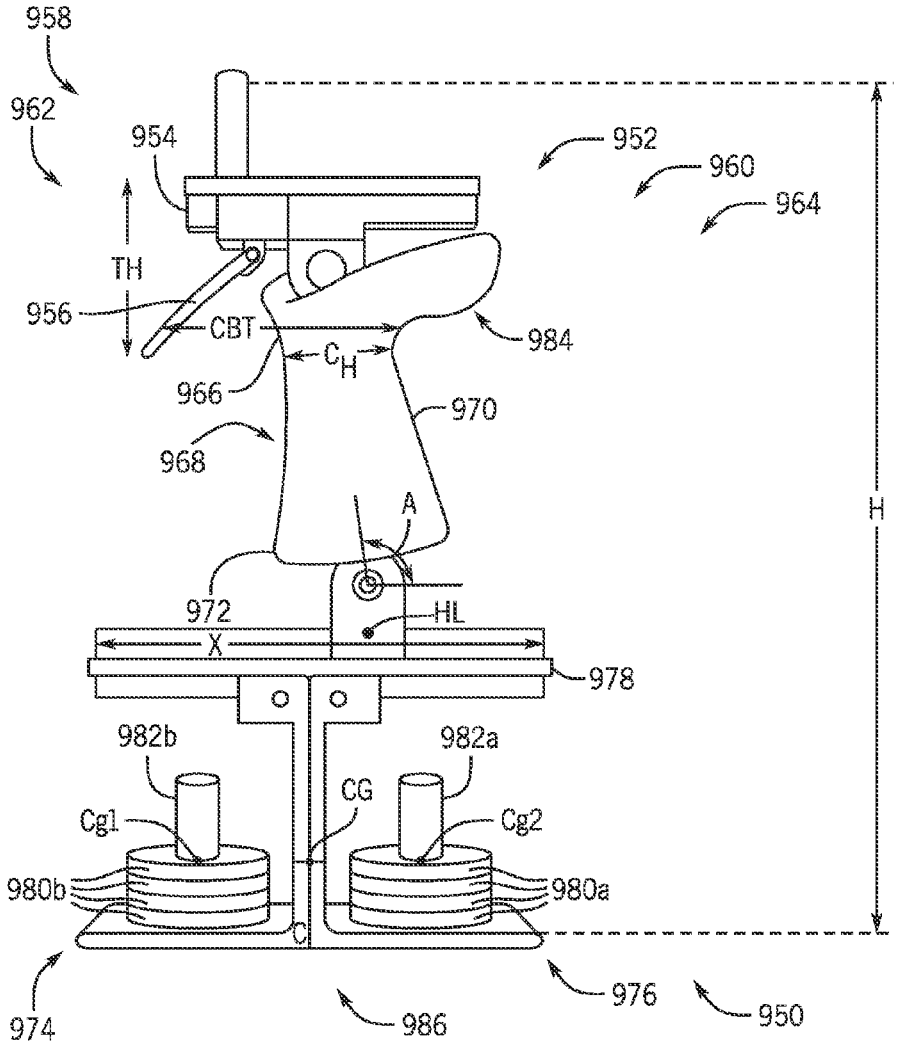
FIG. 32 is a right side perspective view of an experimental testing prototype of the fluid application system in FIG. 25.

Referring now to FIG. 32, an experiment to validate the theoretical analysis of the sprayer neck 916 positioning was performed. In particular, a sprayer test rig 950 having representative components of the various elements described in the fluid application system 900 was provided. The sprayer test rig 950 comprised a test head 952 including a test nozzle 954 and a test trigger 956 disposed toward a front side 958 of the test head 952, which opposes a rear side 960 thereof. A front test rig side 962 and a rear test rig side 964 correspond to the sprayer test head front and rear sides 958, 960, respectively. Further, the sprayer test head 952 was attached to an upper handle end 966 of a sprayer test neck, or handle 968, which has a handle body 970 extending to a lower handle end 972 of the handle 968. The lower handle end 972 was generally positioned above a refill compartment 974 and a diluent compartment 976 with a horizontal test rig diameter plate 978 disposed therebetween. In a particular aspect, the sprayer test rig 950 had a height H of about 30.1 cm and the handle 968 had a circumference $C_H$ of about 13.5 cm and was angled at about 100 degrees from a horizontal plane parallel to the test rig diameter plate 978.

In the ergonomic experiment, the sprayer test rig 950 was adjustable to simulate various user scenarios while allowing for quick adjustments in sprayer neck positioning, angle, and form as manipulated by the moveable handle 968. Representative hands within the $95^{th}$ percentile of US male hands and the $5^{th}$ percentile of US female hands were tested using the sprayer test rig 950 in a simulated cleaning environment.

Initially, the sprayer test rig 950 was set up to represent a fluid application system 900 having a full refill container 924 and a full diluent container 926. The containers 924, 926 are represented by the refill compartment 974 and the diluent compartment 976, which each initially held eight washers 980*a, b* on posts 982*a, b*, respectively. Each washer 980*a, b* weighed approximately 1.29 oz for a total weight of about 10.3 oz per eight washers 980*a, b*. The sprayer neck 916, represented as the handle 968, was initially set at a forward position toward the front test rig side 962. Each user participating in the experiment went through a range of motion that simulated cleaning activities on multiple vertical and horizontal surfaces at a variety of heights and the user's experiences were documented.

Next, the sprayer test rig 950 was modified by removing a single washer 980*b* from the diluent compartment 974. Each user simulated the cleaning activity and the user's experiences were documented. This overall procedure was repeated, continually removing one washer 980*b* from the diluent compartment 974 at a time until the diluent compartment 974 was depleted. Subsequently, the handle 968 was moved closer toward the rear test rig side 964 in 1.0 cm increments while repeating the overall testing procedure and documenting the user's experiences.

Results from the above experiment were found to be representative of the results from the analysis described above. In particular, as the diluent compartment 976 depleted faster, it was found that the handle 968 needed to be adjusted toward the rear test rig side 964 in order to accommodate the changing center of gravity Cg of the sprayer test rig 950. Further, it was found that on average, the handle 968 provided the greatest ergonomic satisfaction to the user at approximately ⅝ of a distance X from the front test rig side 962 to the rear test rig side 964. In a some aspects, the rear and front test rig sides 962, 964 correspond to outermost peripheries of the refill and diluent compartments 974, 976, which further represent the outermost peripheries of the refill and diluent containers 924, 926. As such, a maximum distance from one distal side of the refill container 924 to another distal side of the diluent container 926 defines the distance X.

Still referring to FIG. 32, the next step of the ergonomic experiment involved testing a range of sprayer neck or handle 968 shapes for comfort within the range of $95^{th}$ percentile US male and $5^{th}$ percentile US female hands. The testing analyzed basic handle shapes including circular, elliptical, square, and rounded corner squares, and further tested varying circumferences C of the handles ranging from about 11 cm to 13.5 cm. Therefore, various contours of the handle 968 were tested to find a balance that was acceptable to the $95^{th}$ percentile US male and $5^{th}$ percentile US female hands. A geometry profile was created in view of male respondents' indication that a round handle yielded high performance and an elliptical handle yielded moderate performance, and in view of female respondents' indication that the elliptical handle yielded high performance and the round handle yielded moderate performance. Both male and female respondents agreed on a trigger height and a heel type of the handle 968, which preferably has a wide heel 984 to better support the user's hand without obstructing the user's grip. In particular, the optimized trigger height $T_H$ was approximately 6.5 cm and the optimized handle circumference $C_H$ was approximately 11.0 cm, with the heel 984 abutting an upper portion of the user's hand. As such, a trigger height $T_H$ is between about 6.0 cm to about 7.0 cm, and alternatively between about 6.2 cm to about 6.8 cm, and still alternatively between about 6.4 cm to about 6.6 cm. A handle circumference $C_H$ is between about 10.0 cm to about 12.0 cm. Alternatively, the handle circumference $C_H$ is between about 10.4 cm to about 11.6 cm. Still alternatively, the handle circumference $C_H$ between about 10.8 cm to about 11.2 cm.

In further ergonomic testing, practical weight distribution and handle positioning were analyzed at a higher degree of granularity. It was assumed that the sprayer test head 952 must be horizontal to an x-axis defined by the test rig diameter plate 978 and the sprayer test rig 950 must balance when resting an underside of the sprayer test head 952 on the web of the user's hand. Further, the handle 968 was set at an angle of 100 degrees from a horizontal plane defined by the distance X, it being understood that a 100 degree angle is the optimal angle for spraying a vertical surface and maintaining a neutral wrist posture. It was also understood that since the refill container 924 and the diluent container 926 would rarely be full at the same time, the full situation would not solely drive the handle 968 location along the distance x. Furthermore, it was assumed that the optimal handle 968 location would be between the center of gravity Cg1 of the diluent compartment 974 and the center of gravity Cg2 of the refill compartment 976, since the refill fluid would be depleted more slowly than the diluent fluid. Further, it was assumed that when the diluent level became low, it would be quickly replenished to continue operation.

In the additional test, the user picked up the sprayer test rig 950 having a fixed handle 968 angle A at 100 degrees, 10 washers 980*a, b* in each of the refill and the diluent compartments 976, 976, respectively, and a variable handle 968 location along the distance x. First, the center of gravity Cg and balance of the sprayer test rig 950 were evaluated when the rig 950 was lifted to simulate directly spraying a vertical surface. Second, the user simulated spraying motions by swinging their arm slowly from a 45 degree angle below a horizontal to a 45 degree angle above a horizontal while considering balance and comfort throughout. Third, one diluent washer 980*b* was removed and the first and second steps were repeated. Then, the handle 968 location was changed by incremental centimeters and the above three steps were repeated. Further, the distance X represented a sprayer test rig width of 15.5 cm, and the center of gravity Cg of the sprayer test rig 950 was approximately a linear distance C of 2.5 cm from a base 986 of the rig 950.

It was contemplated that since the refill container 974 is depleted less quickly than the diluent container 976, the handle 968 of the sprayer test rig 950 should be located off-center and more toward the center of gravity Cg2 of the refill container 924 represented by the refill compartment 974. Further, it was rationalized that since the diluent container 926 rarely remains empty, even as the refill container 924 slowly depletes, the optimal handle 968 location is located between the center of gravity Cg of the sprayer test rig 950 and the center of gravity Cg2 of the refill compartment 976.

Given the above ergonomic experiments and analysis, it was found that an optimal sprayer test rig height H is in the range of about 75 mm to about 85 mm. Further, since the refill container 924 is depleted less quickly than the diluent container 926, the handle 968 should be located off-center and biased toward the rear of the sprayer at an approximate location of ⅝ the length of the refill and the diluent reservoirs as measured by the distance X from a front of the sprayer test rig 950. As such, an optimized handle location HL is about at ⅝*X, or about 9.7 cm for a horizontal distance x=15.5 cm measured from the front test rig side 962 for a system in which the diluent compartment 976 empties faster than the refill compartment 974.

Even further, the ergonomic experiments revealed that handle circumference, sprayer test rig to trigger circumference, and engagement of the hand against the heel were highly valued. In an optimized configuration, the handle circumference $C_H$ is about 11 cm to accommodate the $5^{th}$ percentile US female hands and the lower handle end 972 is larger and gently tapered inward to guide the user's hand into the heel 984. Further, it was revealed that the circumference CBT around the back of the handle 968 to the front of the test trigger 956 needs to be about 15 cm to about 18 cm in order to accommodate the $5^{th}$ percentile US female hand. Still further, the heel 984 also distributes force about the top of the index finger, web of the hand and the thumb, without creating pressure points for populations with hand sizes ranging from the $5^{th}$ percentile US female to the $95^{th}$ percentile US male hand sizes.

Figure 33A:
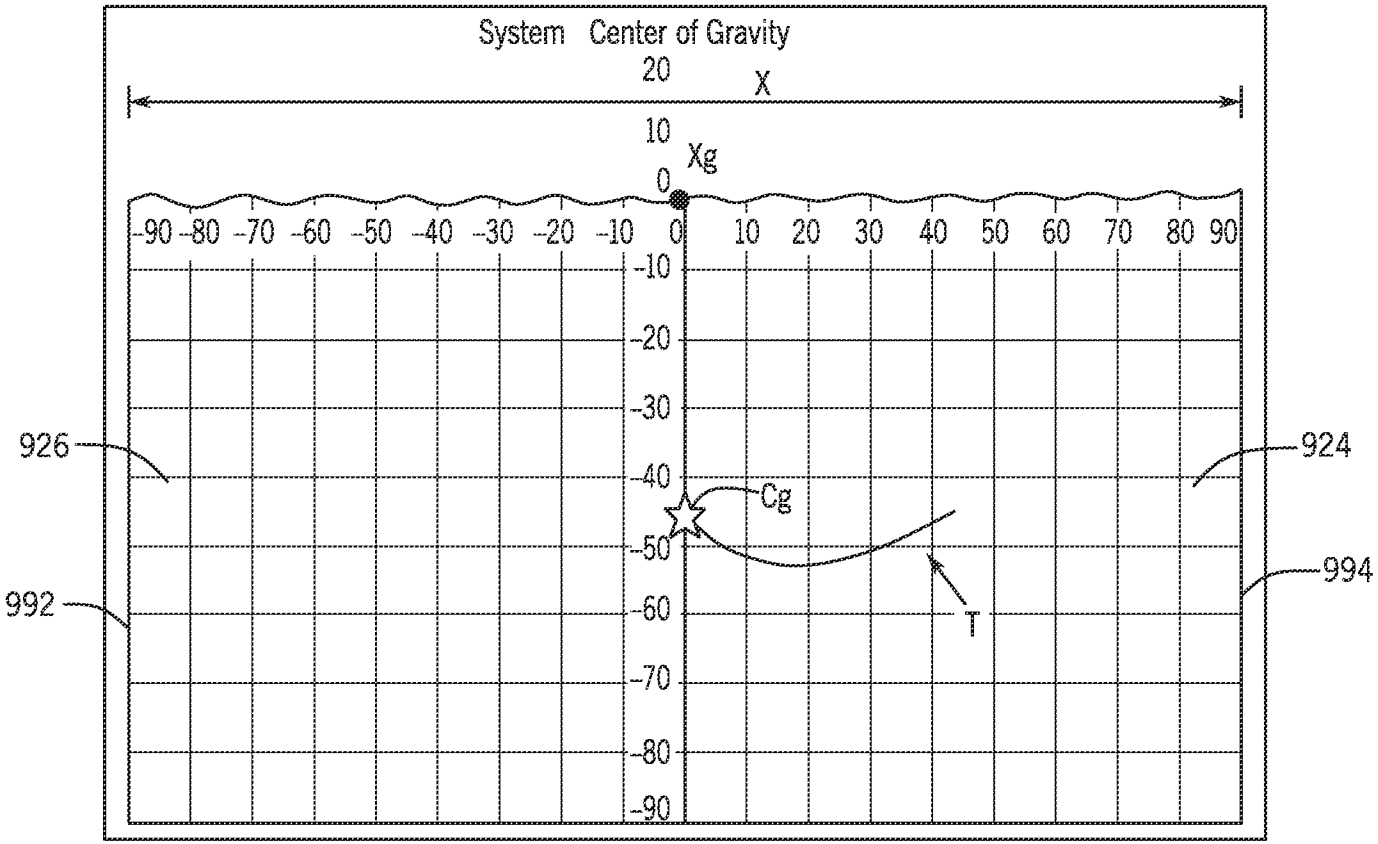
FIGS. 33A-C are plots illustrating the dynamic changes in center of gravity of the fluid application system of FIG. 25.
Figure 33B:
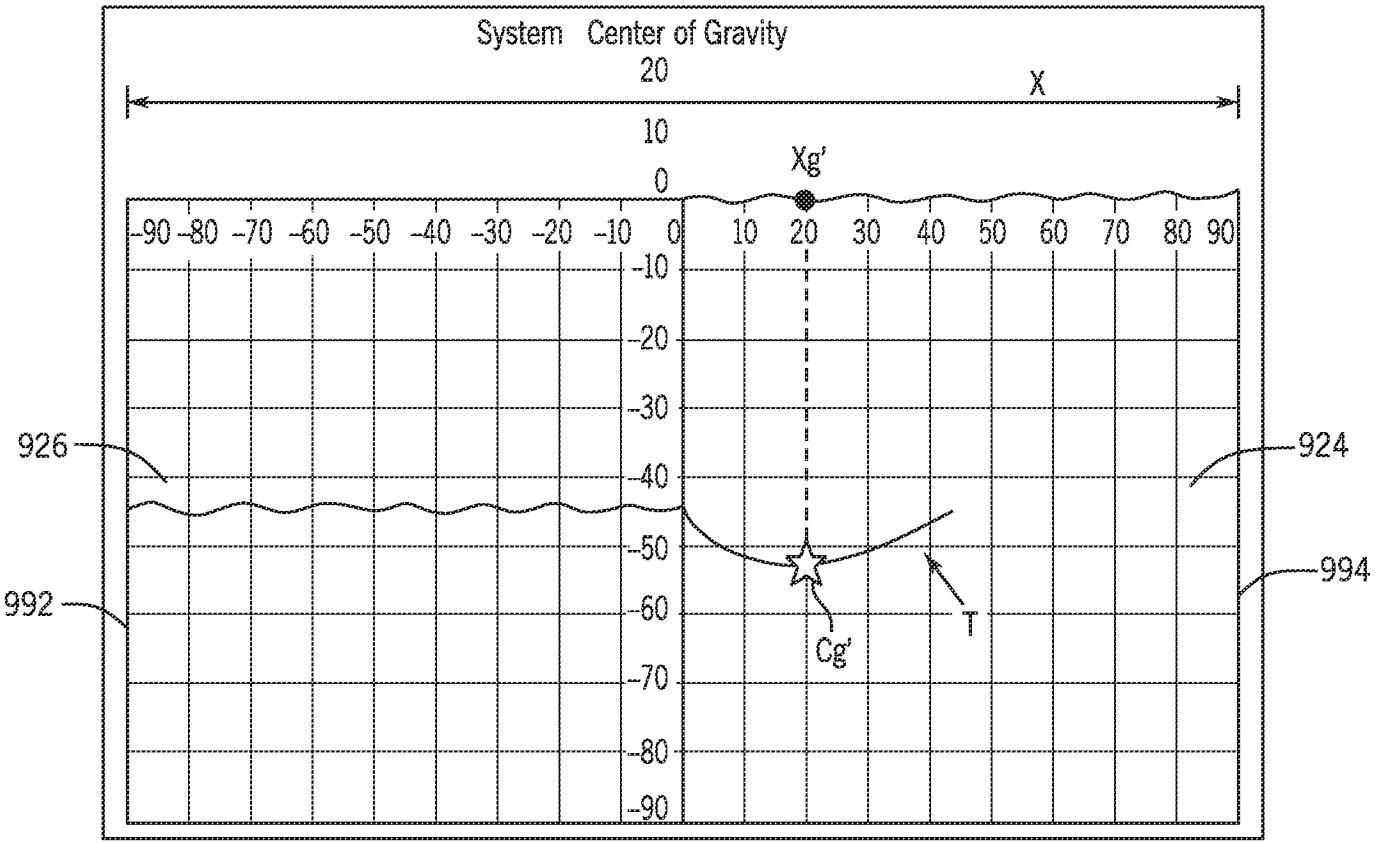
Figure 33C:
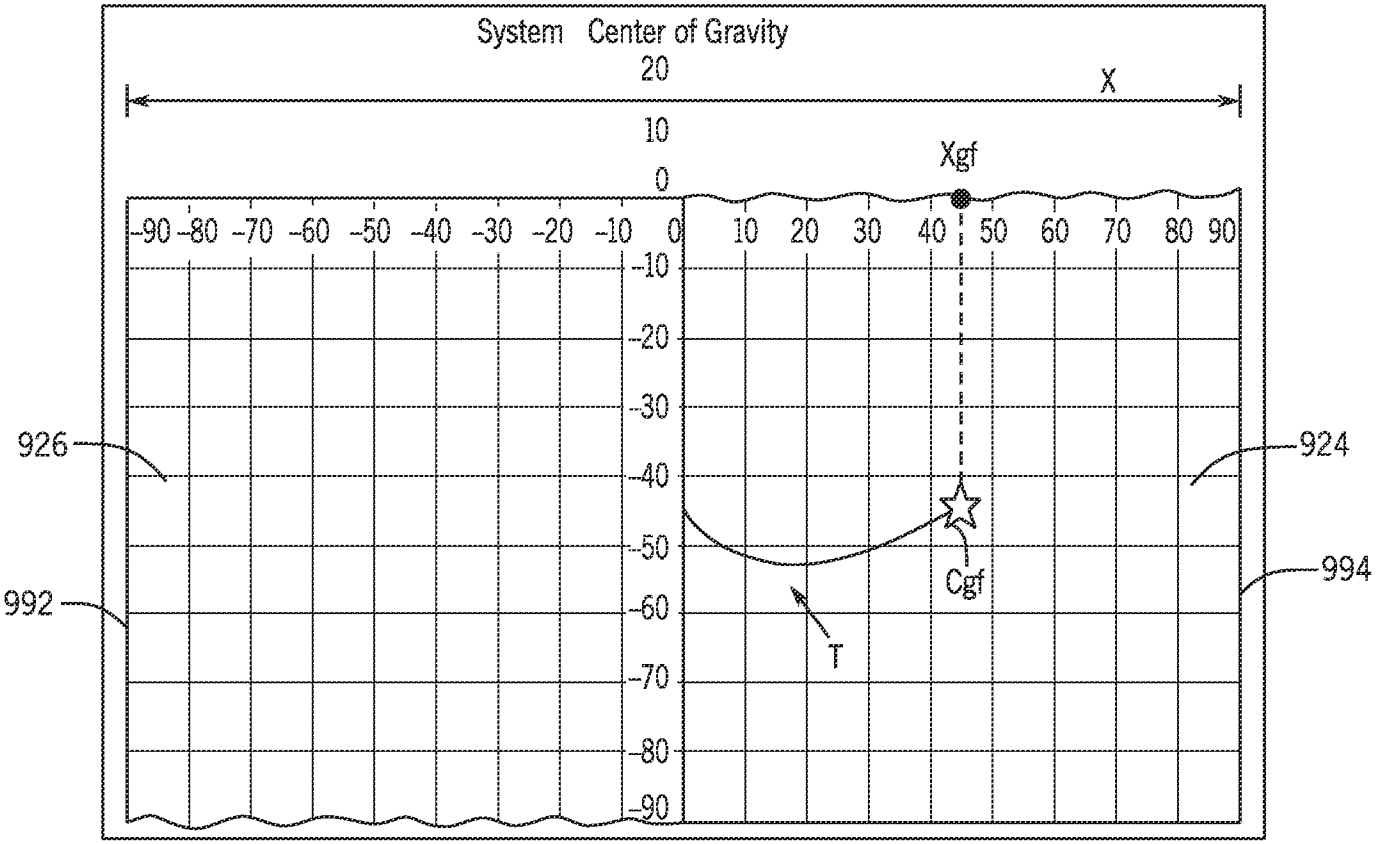

As shown in FIGS. 33A-C, a plot showing the behavior of the dynamic center of gravity for the fluid application system 900 is shown with arbitrary units on the x-y axis. The arbitrary units may change with actual dimensions of the fluid application system 900 and diluent to concentrate mix ratios, however, the underlying x-y axis relationships remain unchanged. In particular, FIGS. 33A-C show that as the diluent container 926 is used at a faster rate than the refill container 924, the center of gravity Cg of the fluid application system 900 generally moves rearward from Cg to a final center of gravity Cgf' along a trajectory T. It is noted that the trajectory T can be used to extrapolate additional centers of gravity for intervening fill levels of the diluent reservoir 926.

In FIG. 33A, when fluid levels of the containers 924, 926 are full and approximately equal, otherwise known as a full-full state or pre-use state, the center of gravity Cg is centered about the distance X, which is taken from a diluent outer periphery 992 to a refill outer periphery 994. In particular, the center of gravity Cg is initially located at position Xg, whereby Xg=X/2. This position, Xg, may also correspond to an optimal sprayer neck 916 location along the distance X during the full state.

FIG. 33B shows that when the fluid level of the diluent container 926 is about halfway full and the refill container 924 is full, otherwise known as a half full state or in-use state, the center of gravity Cg has migrated rearward toward a minimum on the trajectory T to point Cg' at point Xg' along the distance X. It is noted that the center of gravity Cg' is lower along a vertical y-axis of the fluid application system 900. It is contemplated that the half full state is a common usage situation for the fluid application system 900 when deployed.

FIG. 33C illustrates an empty-full state or empty state where the fluid level of the diluent container 926 is substantially depleted while the refill container 924 is still full. In this scenario, the center of gravity Cg' rises along the trajectory T from Cg' to Cgf at a distance Xgf from the diluent outer periphery 992. The final center of gravity Cgf may be close or equal to the center of gravity of the full refill container 924.

It is noted that the above dynamic changes in centers of gravity along the trajectory T are directly related to the faster depletion rate of the diluent container 926 compared to the refill container 924. For instance, and merely by way of example, the faster depletion rate of the diluent container 926 is reflected in various diluent to refill mix ratios that are provided during normal operation, including diluent to refill mix ratios between about 1.5:1 to about 100:1. Preferably, the diluent to refill mix ratio is between about 10:1 to about 75:1, and more preferably between about 20:1 to about 50:1, and most preferably between about 24:1 to about 32:1. In some embodiments, it is contemplated that the fluid level of the diluent container 926 can drop to approximately 50 percent of the fluid level of the refill container 924. As such, a dynamic imbalance exists and the position of the sprayer neck 916 becomes more or less favorable to a user with the changing center of gravity Cg of the fluid application system 900 during use. The imbalances may create a range of continuously-changing favorable positions for the sprayer neck 916 in such a dynamic situation.

In particular, initially the optimal sprayer neck 916 position coincides with Xg to provide a balanced system when both the refill container 924 and the diluent container 926 are full. After one or more uses, whereby the diluent container 926 is emptied faster than the refill container 924, the center of gravity of the system migrates to a new center of gravity Cg' positioned at Xg'. It can be appreciated that the preferred location for the sprayer neck 916 migrates from a first dispense to a second dispense by an absolute distance of approximately Xg'-Xg starting from a half of the distance X due to changing centers of gravity from Cg to Cg'. In particular, the first dispense occurs during a state of full refill and diluent containers 924, 926 while the second dispense corresponds to a half full diluent container 926 and a generally full refill container 924. It is further contemplated that the use of the term second dispense does not necessarily limit the same to the immediately subsequent spraying operation, but may be inclusive of one or more sprays to reach a half full or otherwise non-full state. The dispensing period between the first dispense and the second dispense corresponds to a typical, most common usage state of the system, and thus the position of the sprayer neck 916 can be optimized for those uses between and inclusive of the first dispense and the second dispense (and any of the plurality of dispenses occurring therebetween). Therefore, the sprayer neck 916 location can be optimized for that particular common usage period at a distance of X that is between (X/2) to Xg'. In one aspect, it is contemplated that the lower end 922 of the sprayer neck 916 is located beyond at least 50 percent of the distance X taken from the front 912 of the fluid application system 900. Similarly, in a different situation, where a common usage period spans from the full-full state to the empty-full state, then an optimal distance for the sprayer neck 916 is between (X/2) to Xgf. Furthermore, it is noted that the same types of insights can be gained in systems where one reservoir is slightly larger than the other, such that at the end of a normal usage period, the remaining fluid level in the larger level is still less than in the remaining reservoir. For instance, it is contemplated that the diluent container 926 may be 12 oz. while the concentrate container 924 may be 10 oz.

Further, in another embodiment, it is contemplated that the diluent container 926 includes a weight represented by the value X1 in a full, pre-use state and a refill container 924 includes a weight of the constituent components represented by a value Y in a full, pre-use state. During a use state the percent change in weight of the constituent components of the diluent and refill containers 926, 924 may be expressed by the equation $\% \Delta X1 > \% \Delta Y$. Further, it is contemplated that the weight of constituent components of the diluent and refill containers 926, 924 during a use state may be expressed by the equation $X1 < Y$. In a different embodiment, it is contemplated that the diluent container 926 has a weight and volume represented by the values X1 and V, respectively, in a full, pre-use state and the refill container 924 includes a weight and volume represented by the values Y and W, respectively, in a full, pre-use state. It is contemplated that after the emission of the product during a use state, the constituents may be characterized by X1<Y and/or V<W. Further, after emission of the product during a use state, the constituent components of the diluent and refill containers 926, 924 may be characterized by % ΔX1>% ΔY and/or % ΔV>% ΔW. In a different embodiment, it is contemplated that in a single use, the emitted product comprises a volume $V_1$ of the constituent components of the diluent container 926 and a volume $W_1$ of the constituent components of the refill container 924, wherein $V_1>W_1$. In some embodiments, the $V_1$ is at least 10 times greater than $W_1$. In other embodiments, $V_1$ is at least 30 times greater than $W_1$.

The fluid application systems described herein are also advantageous over common dispensers known in the art due to the unique product flow control mechanism provided with the refill container 924. Specifically, a single fluid application system can dispense a plurality of different diluent to chemical mix ratios with significant ease. In particular, the present fluid application system 900 utilizes the non-pressurized refill container 924 to regulate the controlled outflow of product or chemicals contained therein to be drawn upward into the sprayer head 902.

Figure 34:
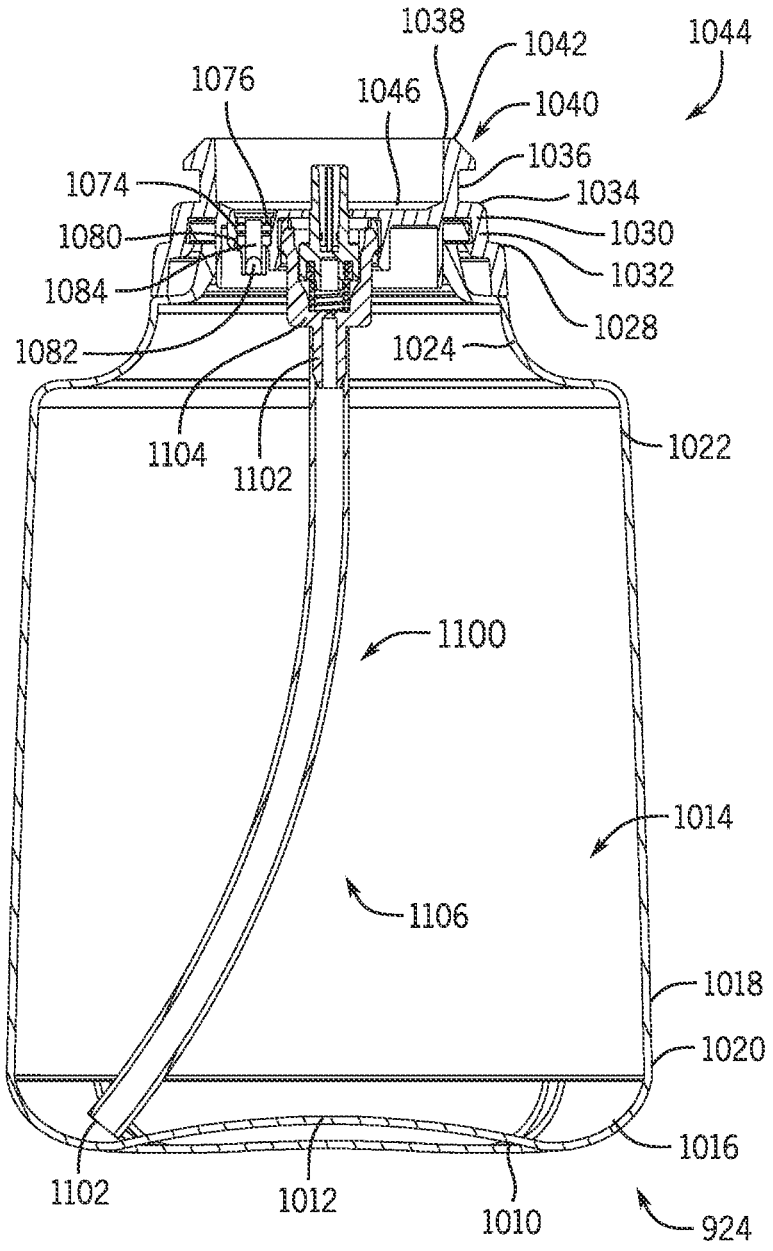
FIG. 34 is a detailed view of one embodiment of a chemical concentrate container for the fluid application system of FIG. 25.

FIG. 34 is a cross-sectional view of the refill container 924, which is similar to the previously described FIG. 17. The chemical container 924 is generally cylindrical-shaped, although other shapes can be contemplated as described above. The chemical container 924 defines a base 1010, which may be flat for engaging a resting surface, such as a table-top. However, the present embodiment includes a convex center 1012 that protrudes as a slight dome-shaped structure into an interior cavity 1014 of the container 924. The base 1010 extends upwardly about its periphery to define a curved bottom edge 1016 or a convex edge that protrudes convexly away from the interior cavity 1014. The curved bottom edge 106 engages or is integrally formed with a sidewall 1018 at a lower sidewall end 1020.

The sidewall 1018 continuously extends to an upper sidewall end 1022 distal from the base 1010. In the present embodiment, the sidewall 1014 tapers continuously inwardly and gradually from the lower sidewall end 1020 to the upper sidewall end 1022. Therefore, a cross-section of the sidewall 1018 and the internal cavity 1014 has a continuously varying shape and volume, respectively.

A concave sidewall 1024 is disposed immediately above the upper sidewall end 1022 and is characterized by an inwardly sloped or concave portion. In the present embodiment, the sidewall 1018 has a generally smooth radius of curvature of about 0.5 cm to about 2.0 cm. Further, a cross-sectional diameter taken about the particular portion of the concave sidewall 1024 region is approximately ⅗ths or less of the cross-sectional diameter taken about the particular portion of the sidewall 1014 region. It is contemplated that the concave sidewall 1024 does not define a continuously-varying cross-sectional area, as it may project in a straight line at ends thereof. Further, it is contemplated that the concave sidewall 1024 has a vertical extent that is shorter than the upward extent of the sidewall 1018.

Still referring to FIG. 34, the upper concave end 1028 is further attached to a stepped portion 1030 that comprises a vertical wall 1032 extending upwardly to a transverse horizontal wall 1034 that extends radially inwardly around a center of the refill container 924. A cylindrical wall 1036 extends upwardly from an innermost end of the horizontal wall 1034 and defines an opening 1038 that is circumscribed by a peripheral flange 1040 having a protruding wall 1042 angled outwardly from the opening 1038. As described previously, the peripheral flange 1040 is adapted to engage attaching means provided in the fluid application system 900. It is contemplated that the cylindrical wall 1036, the peripheral flange 1040, the step 1030, and at least a portion of the concave sidewall 1024, such as the upper concave end 1028, defines a mounting cup 1044 of the chemical container 924.

Figure 35:
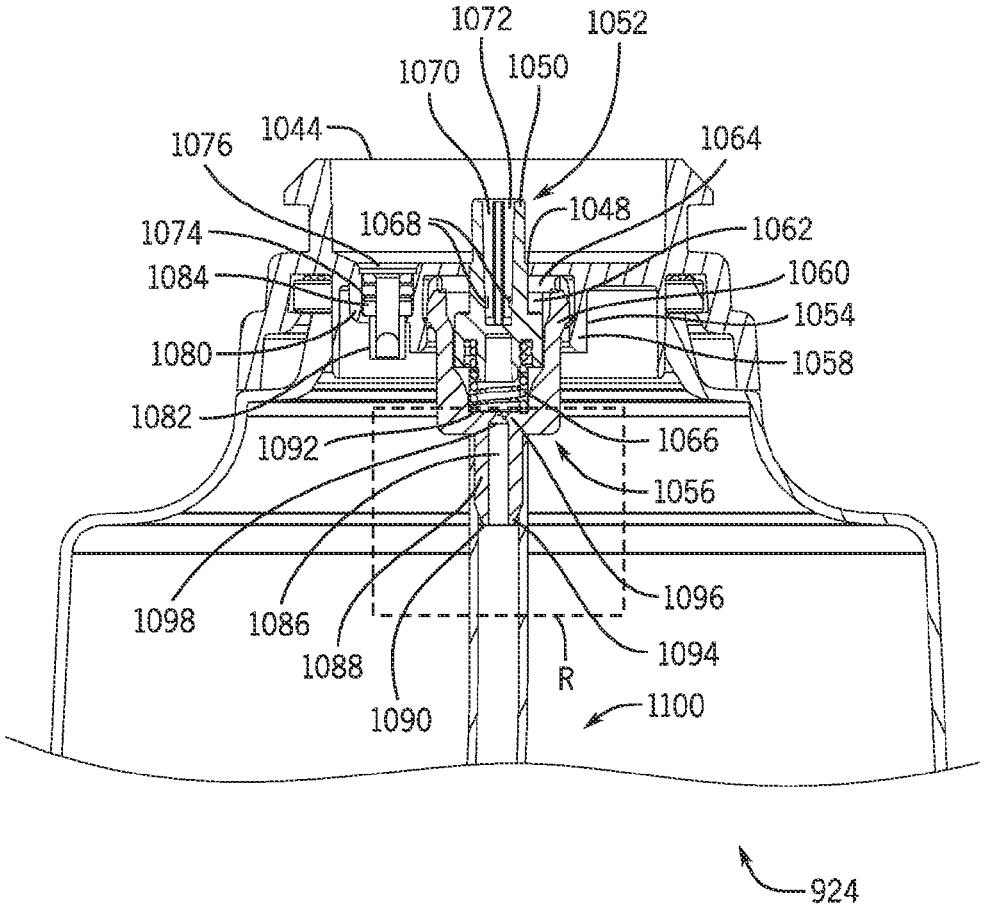
FIG. 35 is a close-up view of a mounting cup and valve assembly of the chemical concentrate container of FIG. 34.

Referring now to FIGS. 34 and 35, in operation, the mounting cup 1044 mounts the chemical container 924 to the remainder of the fluid application system 900 in various methods as described above, and further mounts fluid dispensing components to the chemical container 924. For instance, the cylindrical wall 1036 is bounded at its lower end by a circular, horizontal plate 1046 that has a central hole 1048 which snugly receives therethrough an upper end 1050 of a valve stem 1052. The central hole 1048 defines a top of a downwardly extending central well 1054 which retains a valve body 1056 therein. In particular, the central well 1054 defines a lower ridge 1058 that engages underneath a corresponding upper ridge 1060 of the valve body 1056. The valve body 1056 provides a closed cavity 1062 adapted to receive the valve stem 1052 and a spring 1066 therein to bias the valve stem 1052 upward into a closed position. In particular, in the closed position a plurality of stem orifices 1068 disposed about a lower end of a wall 1070 that defines a cylindrical channel 1072 of the valve stem 1052 are engaged with the stem gasket 1064, which prohibits product from entering the channel 1072. When the refill container 924 is activated and the valve stem 1052 is depressed downward toward the closed cavity 1062, the stem orifices 1068 are exposed, opened, and product is permitted to enter the cylindrical channel 1072 of the valve stem 1052.

Still referring to FIG. 34, a valve retainer, otherwise known as a valve retaining well 1074, is disposed adjacent to and radially offset from the valve stem 1052. The valve retaining well 1074 defines an off-centered hole 1076 on the horizontal plate 1046, also known as an upper plate. The off-centered hole 1076 provides the downwardly extending valve retaining well 1074 having an inwardly protruding lip 1080 for engaging a venting valve 1082, and particularly for engaging an underside of a valve ridge 1084, which is a peripheral ring about the venting valve 1082. As described above previously, the venting valve 1082 can comprise a one-way valve, such as a duckbill valve, or a two-way valve, such an integrated umbrella and duckbill valve. In a different aspect, the venting valve 1082 and its retaining structures on the horizontal plate 1046 are replaced by a porous membrane portion.

In a particular embodiment, the valve body 1056 defines a central passageway 1086 that is coaxially aligned with the cylindrical channel 1072 of the valve stem 1052. The central passageway 1086 is defined by a valve body elongate channel 1088 that has a valve body intake port 1090 at a central passageway lower end 1094 and a valve body outlet port at a central passageway upper end 1096. Further, the central passageway upper end 1096 defines a converging flow path 1098, such as tapering sidewalls as described previously above, to converge flow toward the valve body outlet port 1092. It is contemplated that a cross-sectional area of the valve body outlet port 1092 is less than a cross-sectional area of the valve body intake port 1090. Further, it is contemplated that a product intake conduit 1100 is press-fit over the central passageway 1086 of the valve body 1056 to communicate a volume of product from a lower orifice of the conduit 1100, referred to as a product ingress 1102 upward to an upper orifice of the conduit 1100, referred to as a product egress 1104, and further on to the valve stem 1052.

Figure 36:
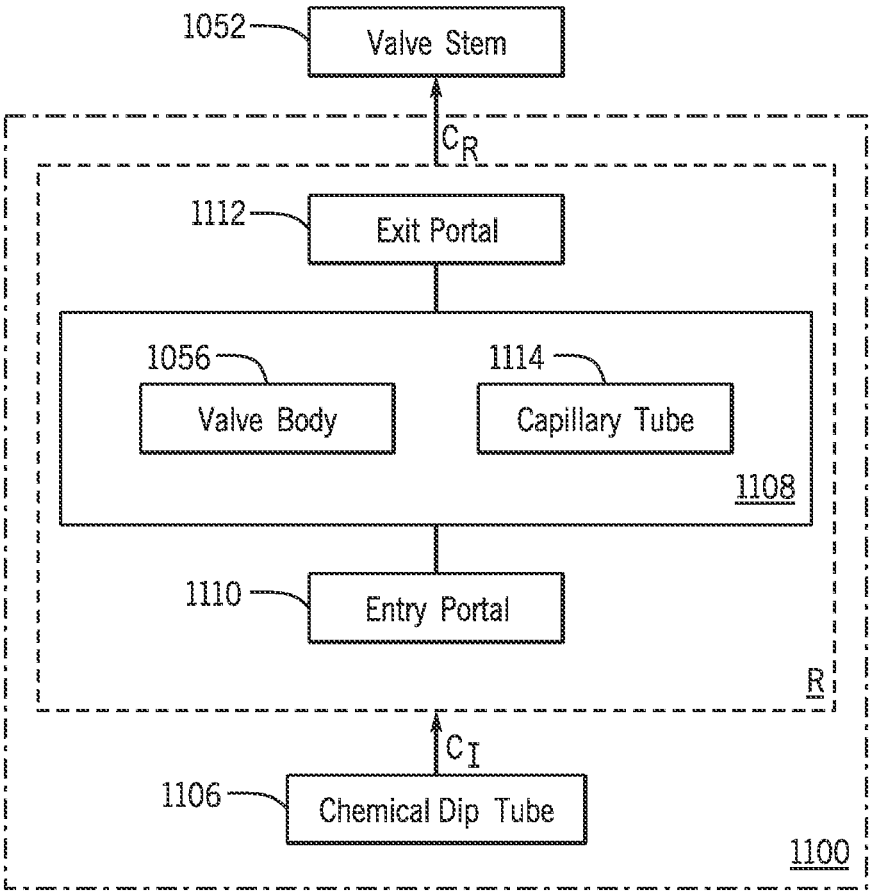
FIG. 36 is a schematic diagram of a flow restriction area of the chemical concentrate container of FIG. 34.

Referring to FIGS. 34-36, in some embodiments it is contemplated that the product intake conduit 1100 comprises a product dip tube 1106 in fluid communication with a restriction region R that is downstream of the tube 1106 and in some embodiments also inclusive of the tube 1106. A flow restrictor 1108 is provided in the restriction region R for imparting flow restraints on a flow of product, or product stream, therethrough. Such flow restraints may cause changes in flow rate and pressure of the product stream traveling therethrough. It is contemplated that the flow restraints applied in the restriction region R assist in achieving particular mix ratios of the diluent to the chemical when expelled from the fluid application system 900. Further, it is noted that the restriction region R is provided to illustrate a general section of the present fluid application system 900 where a flow restriction occurs, and that other flow restrictions can also occur at areas within or outside of the restriction region R.

As shown in FIG. 35, the restriction region R is located on an underside of the mounting cup 1044. Particularly, the restriction region R is located at an area of flow that is upstream of the valve stem 1052. More particularly, the restriction region R is located near the valve body 1056 and in some embodiments the region R is inclusive of the valve body elongate channel 1088. It is contemplated that the flow restrictor 1108 provided at the restriction region R is a physical feature that is adapted to impart a flow characteristic on the product stream to ultimately control an amount of product that enters the previously described mixing chamber 343 of the previously described fluid manifold 340. As such, the restriction region R is applied upstream of the fluid manifold 340 and also the valve stem 1052, which is in the flow pathway from the valve body 1056 to the fluid manifold 340. By controlling the flow characteristics of the product stream, it is possible to achieve a desired diluent to chemical mix ratio, which is expelled from the nozzle 904. Further, by implementing the function of controlling the product stream at the refill container 924, the fluid application system 900 is versatile in achieving a variety of different diluent to chemical mix ratios simply by engaging different refill containers 924 that yield the desired mix ratio. As such, the refill container 924 described herein provides a flow control mechanism that is independent of other mechanisms provided downstream of the refill container 924. Therefore, the fluid application system 900 is significantly improved over traditional multi-reservoir dispensers that instead provide flow control mechanisms downstream of refill reservoirs within the dispensers, whereby their mix ratio is a single mix ratio that is pre-set by the dispenser itself. On the other hand, the fluid application system 900 can expel different chemicals and different diluent to chemical mix ratios by simply changing out the refill containers 924 to other refill containers having other flow restrictions and/or chemicals.

Turning to FIG. 36, a schematic diagram illustrates a portion of a flow pathway surrounding the restriction region R. In particular, the restriction region R includes the flow restrictor 1108 that is downstream of an entry portal 1110 and is upstream of an exit portal 1112. The entry portal 1110 and the exit portal 1112 define positions in the flow pathway where an initial chemical stream Ci enters the restriction region R and a restricted chemical stream Cr exits the region R, respectively. As such, the entry and exit portals 1110, 1112 can change and are dependent on the configuration of the flow restrictor 1108. The initial chemical stream Ci is guided into the entry portal 1110 by the chemical dip tube 1106. The restricted chemical stream Cr leaving the restriction region R is subsequently guided into the valve stem 1052. In particular, it is contemplated that the initial chemical stream Ci is restricted by a portion of the valve body 1056 and/or a capillary tube 1114, which provided together or as alternatives are considered the flow restrictor 1108 of the present embodiment. Further, it is noted that the components upstream of the valve stem 1052 are collectively referred to as the chemical intake conduit 1100.

Figure 37:
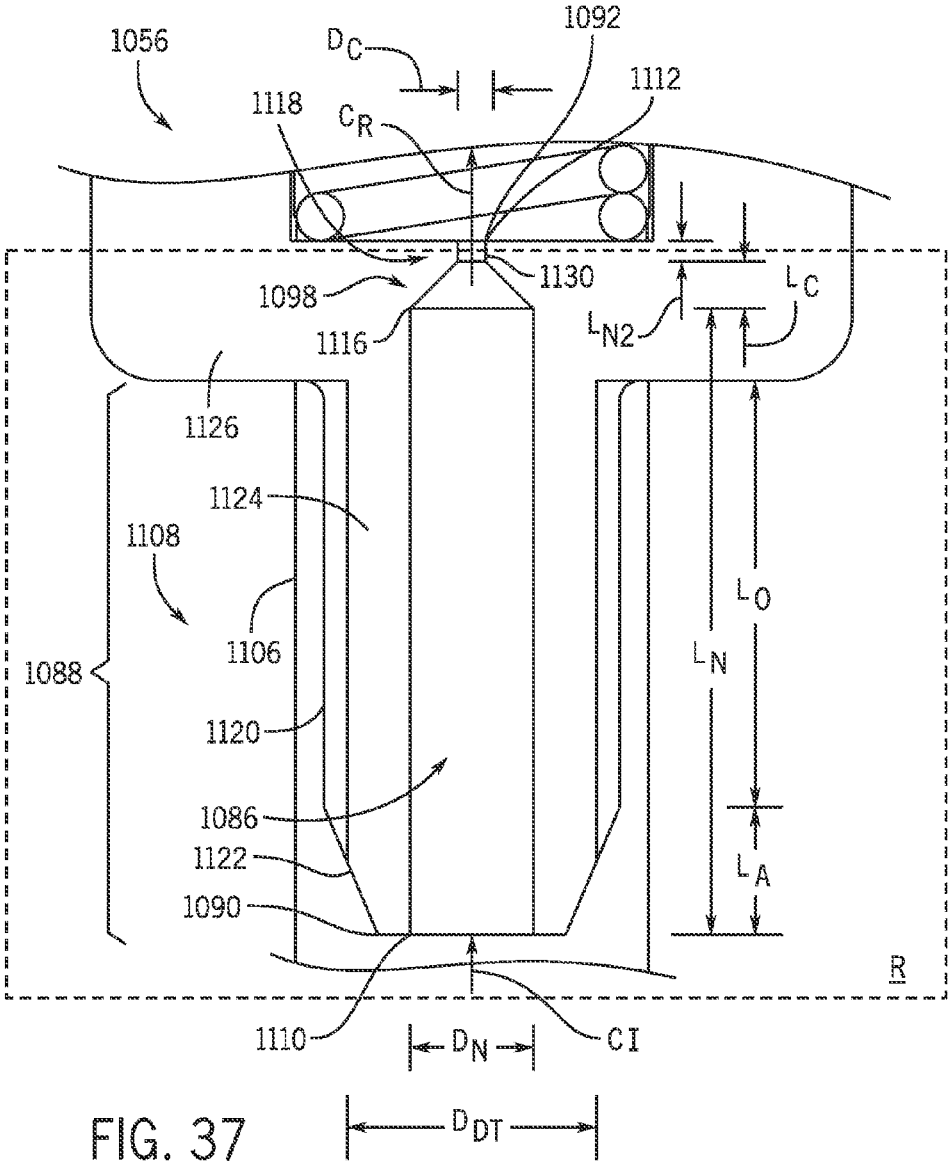
FIG. 37 is a close-up view of the flow restriction area of the chemical concentrate container of FIG. 34.

Turning now to FIG. 37, the present embodiment of the flow restrictor 1108 comprises a portion of the valve body 1056 as shown in greater detail within the restriction region R. In particular, the flow restrictor 1108 comprises a non-converging channel, hereon referred to as the central passageway 1086; a converging channel, hereon referred to as the converging flow path 1098; and a secondary non-converging channel 1118 that has an upstream terminating end defined by the valve body outlet port 1092. In the present embodiment, the entry portal 1110 to the flow restrictor 1108 coincides with the valve body intake port 1090 and the export portal 1112 coincides with the valve body outlet port 1092. Further, the chemical dip tube 1106 is press-fit over an outer surface 1120 of the valve body elongate channel 1088. The outer surface 1120 provides an angled outer surface 1122 that tapers inwardly to define the valve body intake port 1090. It is contemplated that the angled outer surface 1122 eases assembly of the chemical dip tube 1106 onto the valve body elongate channel 1088 by allowing it to slide on into a sealing-fit.

In the present embodiment, the central passageway 1086 is a straight, hollow, tubular passageway that receives and alters a flow rate and/or pressure of the initial chemical stream Ci. It is contemplated that the central passageway 1086 has straight longitudinal sidewalls 1124 with an axial length $L_N$, whereby a portion of the longitudinal sidewalls 1124 comprise the valve body elongate channel 1088. A downstream portion of the longitudinal sidewalls 1124 coincide with a valve body base wall 1126, which is transverse to the valve body elongate channel 1088 extending downwardly therefrom. Further, the central passageway 1086 comprises a radial diameter $D_N$ that is uniform throughout the extent of the passageway 1086. In the present embodiment, the central passageway 1086 or the non-converging channel comprises an axial length of between about 5 mm to about 8 mm and preferably about $L_N$=7.7 mm. The internal radial diameter $D_N$ is between about 1 mm to about 2 mm and preferably about $D_N$=1.5 mm. The valve body elongate channel 1088 surrounding the central passageway 1086 comprises a cylindrical length $L_O$ between about 4 mm to about 7 mm and preferably about $L_O$=5.0 mm from the valve body base wall 1126 to the angled outer surface 1122. The angled outer surface 112 comprises an axial length $L_A$ of between about 0.5 mm to about 2.5 mm, and preferably about $L_A$=1.5 mm. For comparison, the chemical dip tube 1106 comprises an internal diameter $D_{DT}$ between about 2.5 mm to about 4 mm and a length $L_{DT}$ between about 15 mm to about 25 mm. Preferably, the length $L_{DT}$=19.1 mm and the diameter $D_{DT}$=3.1 mm. As such, at the entry portal 1110, the cross-sectional flow diameter is decreased by about $(D_{DT}-D_N)/D_{DT}$, or 50 percent from that provided by the chemical dip tube 1106 to restrict the initial chemical stream Ci. It is contemplated that other changes in the cross-sectional flow diameter at the entry portal 1110 can be realized ranging from between about a 25 percent decrease to about an 80 percent decrease depending on the amount of flow restriction desired.

Still referring to FIG. 37, the central passageway 1086 extends upwardly toward the converging channel entrance 1116, whereupon an angled wall 1128 converges inwardly from an inner surface of the central passageway 1086 to define the converging flow path 1098. It is contemplated that the converging flow path 1098 defines a smallest diameter $D_C$ between about 0.20 mm to about 0.60 mm and preferably about $D_C$=0.40 mm. Further, the converging flow path 1098 defines an axial length $L_C$ between about 1.0 mm to about 2.0 mm, and preferably about $L_C$=1.2 mm.

The secondary non-converging channel 1118 is disposed between the converging flow path 1098 and the valve stem 1052. It is contemplated that the non-converging channel 1118 has straight sidewalls 1130 extending upwardly at an axial length $L_{N2}$ at about 0.10 mm to about 0.50 mm, and preferably $L_{N2}$=0.25 mm. A radial diameter taken across the secondary non-converging channel 1118 is uniform and approximately the same as the smallest diameter $D_C$ defined above by the converging flow path 1118. As such, at the exit portal 1112, the cross-sectional flow diameter is decreased by about $(D_C-D_N)/D_N$, or about 70 percent from that provided by the central passageway 1086.

Computational Fluid Dynamics Analysis

Figure 38:
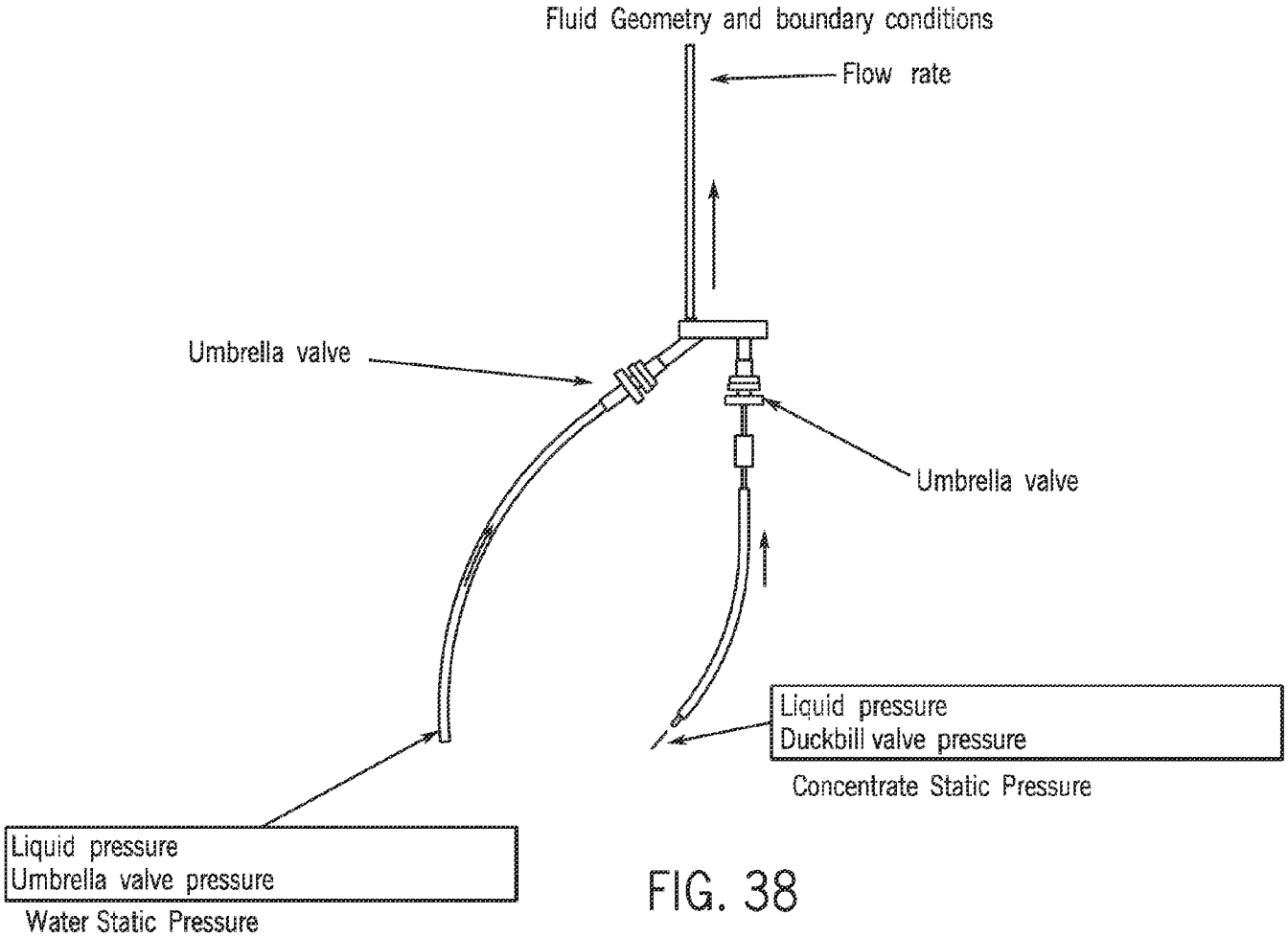
FIG. 38 shows the fluid geometry and boundary conditions used in a Computational Fluid Dynamics (CFD) analysis performed on a fluid application system of the invention.

A computational fluid dynamics (CFD) analysis was performed on the fluid application system 310 using the fluid geometry and boundary conditions shown in FIG. 38. The results of six CFD iterations are shown in Table 1 below. A variety of desired mixing ratios can be achieved through metering methods based on valve cracking pressures within the fluid application system ranging from a minimum of 0 psi to a maximum of 1 psi and varying restriction sizes of the concentrate line. Looking at the non-limiting iterations in Table 1, (1) to achieve a mixing ratio of 9.1 or less during a minimum overall flow rate of 0.5 milliliters per second (ml/s), the pressure drop from the tip of the concentrate line to the mixing chamber should be controlled to −1.283 psi or less; (2) to achieve a mixing ratio of 33.9 or less during a minimum overall flow rate of 2.5 ml/s, the pressure drop from the tip of the concentrate line to the mixing chamber should be controlled to −2.371 psi or less; (3) to achieve a mixing ratio of 63.4 or less during a minimum overall flow rate of 0.5 ml/s, the pressure drop from the tip of the concentrate line to the mixing chamber should be controlled to −1.285 psi or less; (4) to achieve a mixing ratio of 285 or less during a maximum overall flow rate of 2.5 ml/s, the pressure drop from the tip of the concentrate line to the mixing chamber should be controlled to −1.496 psi or less; (5) to achieve a mixing ratio of 1.4 or less during a maximum overall flow rate of 2.5 ml/s, the pressure drop from the tip of the concentrate line to the mixing chamber should be controlled to −1.376 psi or less; (6) to achieve a mixing ratio of 11.8 or more during a maximum overall flow rate of 2.5 ml/s, the pressure drop from the tip of the concentrate line to the mixing chamber should be controlled to −0.077 psi or more; and (7) to achieve a mixing ratio of 9.4 or less during a maximum overall flow rate of 3.5 ml/s, the pressure drop from the tip of the concentrate line to the mixing chamber should be controlled to −0.183 psi or less. The maximum mixing ratio could be controlled to be unlimited. At an overall flow rate from 0.5 ml/s to 3.5 ml/s and a diluent to chemical mixing ratio from 1:1 to 1:300, the pressure drop through the concentrate line ranges from −0.077 psi to −2.371 psi, and the flow rate of the concentrate varies from 0.008 ml/s to 1.05 ml/s, and the pressure drop through the water line ranges from −2.115 psi to −1.027 psi.

TABLE 1

Computational Fluid Dynamics Iterations

| Iteration # | Flow rate (ml/s) | Restriction size of Concentrate line (in) | Water Static Pressure (psi) | Concentrate Static Pressure (psi) | Umbrella Manifold Pressure (psi) | Pressure inside the mixing chamber (psi) | Water Mass Flow Rate (kg/s) | Concentrate Mass Flow Rate (kg/s) | Water Line Pressure drop (psi) | Concentrate line pressure drop (psi) | Ratio |
|---|---|---|---|---|---|---|---|---|---|---|---|
| 1 | 0.5 | 0.006 | −0.116 | 0.14 | 1.0 psi water, 0 Concentrate | −1.143 | 0.000452942 | 0.0000497404 | −1.027 | −1.283 | 9.1 |
| 2 | 2.5 | 0.006 | −0.116 | 0.14 | 1.0 psi water, 0 Concentrate | −2.231 | 0.002428440 | 0.0000716359 | −2.115 | −2.371 | 33.9 |
| 3 | 0.5 | 0.003 | −0.116 | 0.14 | 1.0 psi water, 0 Concentrate | −1.145 | 0.000492943 | 0.0000077741 | −1.029 | −1.285 | 63.4 |
| 4 | 2.5 | 0.003 | −0.116 | 0.14 | 1.0 psi water, 0 Concentrate | −1.356 | 0.00249144 | 0.0000087292 | −1.24 | −1.496 | 285.4 |
| 5 | 2.5 | 0.023 | −0.116 | 0.14 | 1.0 psi water, 0 Concentrate | −1.236 | 0.00145347 | 0.00104653 | −1.12 | −1.376 | 1.4 |
| 6 | 2.5 | 0.023 | 0.14 | −1 | 0 psi water, 0 Concentrate | −1.077 | 0.00230461 | 0.000195343 | −1.217 | −0.077 | 11.8 |
| 7 | 3.5 | 0.023 | 0.14 | −1 | 0 psi water, 0 Concentrate | −1.183 | 0.00315962 | 0.000337613 | −1.323 | −0.183 | 9.4 |

Iterations 1, 2, 3, 4, 5, and 7 are for minimum possible mixing ratio. Iteration 6 is for maximum possible mixing ratio.
All analyses assume the chemical density and viscosity are the same value as water.

Thus, the present invention provides an improved chemical application system. Among other things, the chemical application system automatically dilutes a concentrate refill with water without use of a venturi. The chemical application system mixes chemical on demand and allows the consumer to use a multitude of different refill chemistries that require different dilution ratios with no adjustments. The refill mates with the sprayer device of the chemical application system. The chemical application system is portable and may include a manual pump, or a pump having a motor powered by batteries. The dilution rate can be controlled by a restriction orifice in the dip tube in the chemical refill container. The fluid application system preferably provides the same dilution ratio from a concentrate refill when the same concentrate refill is used with a manual pump or a pump having a motor powered by batteries.

Although the present invention has been described in detail with reference to certain embodiments, one skilled in the art will appreciate that the present invention can be practiced by other than the described embodiments, which have been presented for purposes of illustration and not of limitation.

Therefore, the scope of the invention should not be limited to the description of the embodiments contained herein.

INDUSTRIAL APPLICABILITY

The present invention provides a fluid application system for mixing a chemical with a diluent and spraying a mixture of the chemical and the diluent. The fluid application system includes a sprayer assembly, a diluent reservoir, and a complementary system of one or more fluid chemical concentrate refills, each including a chemical dip tube with a restriction orifice that provides for a proper dilution ratio of the diluent and chemical concentrate.

All documents cited in the Detailed Description of the Invention are, in relevant part, incorporated herein by reference; the citation of any document is not to be construed as an admission that it is prior art with respect to the present invention.

What is claimed is:

1. A fluid application system for mixing a chemical with a diluent and spraying a mixture of the chemical and the diluent, the system comprising:

a sprayer housing;

a diluent reservoir for holding the diluent;

a chemical container for containing the chemical, the chemical container including a chemical dip tube for delivering chemical to a valve in an opening of the chemical container, the chemical dip tube being in fluid communication with a restriction orifice at an entry port of a valve body of the valve having a smaller inner diameter than an inner diameter of an adjacent section of the chemical dip tube wherein the valve has a closed position in which fluid flow is blocked from the opening of the container and the valve has an open position in which fluid can flow from the opening of the container, the valve being moved from the closed position to the open position when the chemical container is attached to the sprayer housing;

a manifold located in the sprayer housing, the manifold including a diluent inlet in fluid communication with the diluent reservoir and a mixing chamber of the manifold, the manifold including a chemical inlet in fluid communication with the chemical dip tube and the mixing chamber, the manifold including an outlet in fluid communication with the mixing chamber; and a pump assembly including a pump chamber in fluid communication with the outlet of the manifold, the pump assembly drawing a mixture of the diluent and the chemical into the pump assembly from the outlet of the manifold and then expelling the mixture of the diluent and chemical from a nozzle for spraying the mixture of the chemical and the diluent.

2. The fluid application system of claim 1 wherein:

the mixture of the chemical and the diluent has a ratio of chemical to diluent of 1:16 to 1:256.

3. The fluid application system of claim 2 wherein:

variability of the ratio is ±10% when operating the pump assembly.

4. The fluid application system of claim 1 wherein:

the sprayer housing comprises an attachment mechanism for attaching the chemical container to the sprayer housing, the attachment mechanism including a moveable collar suitable for engaging a hollow outlet of a closure of the chemical container.

5. The fluid application system of claim 1 wherein:

the chemical container includes a mounting cup, the mounting cup is attached to an opening of the chemical container, the valve includes a valve body and a valve stem, the valve body is attached to the mounting cup thereby defining a closed space between the valve body and the mounting cup, the valve stem has a first end arranged in the closed space, the valve stem has a second end extending out of the mounting cup on a side opposite the closed space, the valve stem has a flow passageway in fluid communication with an exit opening of the valve stem and a stem orifice in a wall of the valve stem, when the valve is in the closed position, fluid flow is blocked from the closed space into the stem orifice, and when the valve is in the open position, fluid can flow from the closed space through the stem orifice and into the flow passageway.

6. The fluid application system of claim 5 wherein:

the valve body has an entry orifice in fluid communication with the closed space, and the restriction orifice is located in the entry orifice.

7. The fluid application system of claim 6 wherein:

the restriction orifice has an inner diameter in the range of 0.07 millimeters to 0.7 millimeters.

8. The fluid application system of claim 5 wherein:

the mounting cup of the chemical container includes a one-way valve, the one-way valve permitting ambient air to enter the chemical container to displace chemical dispensed therefrom.

9. The fluid application system of claim 5 wherein:

the mounting cup of the chemical container includes a two-way valve, the two-way valve permitting ambient air to enter the chemical container to displace chemical dispensed therefrom, and the two-way valve permitting gas generated by the chemical to exit the chemical container.

10. The fluid application system of claim 5 wherein:

the sprayer housing includes an actuator body in fluid communication with the chemical inlet of the manifold, the actuator body having an entry port dimensioned to engage the valve stem and move the valve to the open position when the chemical container is attached to the sprayer housing.

11. The fluid application system of claim 1 wherein:

when diluent is depleted from the diluent reservoir, chemical is not dispensed from the chemical container.

12. A container for retaining a non-pressurized product, comprising:

a reservoir holding a non-pressurized product;

a metering device within the reservoir a valve assembly provided within an upper end of the reservoir, wherein the valve assembly includes:

a product intake conduit, and a spring biased valve stem, wherein the valve stem is an upwardly extending conduit, in fluid communication with the product intake conduit, wherein the spring is provided within an interior of the reservoir.

13. The container of claim 12 further including a dip tube in fluid communication with the product intake conduit.

14. A container adapted to connect to a sprayer assembly structured to spray a mixture of chemical and diluent at a ratio of chemical to diluent of 1:1 to 1:300 at a mixture flow rate in the range of about 0.5 to about 3.5 milliliters per second, the container comprising:

a reservoir holding a non-pressurized product;

a valve assembly secured to an upper end of the reservoir, the valve assembly including a chemical flow conduit and a spring biased valve stem, wherein the valve stem is an upwardly extending conduit in the chemical flow conduit, the chemical flow conduit having a first end in fluid communication with an interior space of the reservoir and a second end at an opening of the valve stem; and a chemical metering device for creating a chemical flow rate in the chemical flow conduit, the chemical flow rate being in the range of about 0.008 milliliters/second to about 1.05 milliliters/second.

15. The container of claim 14 wherein:

the chemical flow rate is measured at the opening of the valve stem.

16. The container of claim 14 wherein:

the chemical metering device comprises a vent valve in fluid communication with an interior space of the reservoir, the vent valve having a cracking pressure in the range of 0 to −1 psi.

17. The container of claim 16 wherein:

the vent valve comprises a duckbill valve.

18. The container of claim 14 wherein:

the chemical metering device comprises a capillary tube.

19. The container of claim 14 wherein:

the chemical metering device comprises a dip tube.

20. The container of claim 14 wherein:

the chemical metering device comprises a valve body having an entry orifice and a restriction orifice is located in the entry orifice, the restriction orifice having a smaller inner diameter than an inner diameter of an adjacent section of the entry orifice, the valve stem being positioned in the valve body.

21. The container of claim 20 wherein:

the restriction orifice has an inner diameter in the range of 0.07 millimeters to 0.7 millimeters.

22. A method for spraying at least two different mixtures of one or more chemicals, the method comprising:

providing a fluid application system having a sprayer housing and a diluent reservoir, the diluent reservoir storing a diluting liquid;

operatively engaging a first chemical container to the sprayer housing, the first chemical container having a first restriction orifice and storing a first chemical;

activating the sprayer housing to spray a first mixture of the first chemical and the diluting liquid;

operatively disengaging the first chemical container from the sprayer housing;

operatively engaging a second chemical container to the sprayer housing, the second chemical container having a second restriction orifice and storing a second chemical;

activating the sprayer housing to spray a second mixture of the second chemical and the diluting liquid;

wherein the first restriction orifice comprises a first entry port of a first valve body of a first valve in the first chemical container, wherein the second restriction orifice comprises a second entry port of a second valve body of a second valve in the second chemical container, and wherein the first restriction orifice and the second restriction orifice allow different quantities of chemicals to pass through.

23. A container for retaining a non-pressurized product, comprising:

a reservoir holding a non-pressurized product;

a metering device within the reservoir a valve assembly provided within an upper end of the reservoir, wherein the valve assembly includes:

a product intake conduit, and a spring biased valve stem, wherein the valve stem is a reciprocating conduit, in fluid communication with the product intake conduit, wherein the spring is provided within an interior of the reservoir.

24. The container of claim 23 further including a dip tube in fluid communication with the product intake conduit.

25. A container adapted to connect to a sprayer assembly structured to spray a mixture of chemical and diluent at a ratio of chemical to diluent of 1:1 to 1:300 at a mixture flow rate in the range of about 0.5 to about 3.5 milliliters per second, the container comprising:

a reservoir holding a non-pressurized product;

a valve assembly secured to an upper end of the reservoir, the valve assembly including a chemical flow conduit and a spring biased valve stem, wherein the valve stem is a reciprocating conduit in the chemical flow conduit, the chemical flow conduit having a first end in fluid communication with an interior space of the reservoir and a second end at an opening of the valve stem; and a chemical metering device for creating a chemical flow rate in the chemical flow conduit, the chemical flow rate being in the range of about 0.008 milliliters/second to about 1.05 milliliters/second.

26. The container of claim 25 wherein:

the chemical flow rate is measured at the opening of the valve stem.

27. The container of claim 25 wherein:

the chemical metering device comprises a vent valve in fluid communication with an interior space of the reservoir, the vent valve having a cracking pressure in the range of 0 to −1 psi.

28. The container of claim 27 wherein:

the vent valve comprises a duckbill valve.

29. The container of claim 25 wherein:

the chemical metering device comprises a capillary tube.

30. The container of claim 25 wherein:

the chemical metering device comprises a dip tube.

31. The container of claim 25 wherein:

the chemical metering device comprises a valve body having an entry orifice and a restriction orifice is located in the entry orifice, the restriction orifice having a smaller inner diameter than an inner diameter of an adjacent section of the entry orifice, the valve stem being positioned in the valve body.

32. The container of claim 31 wherein:

the restriction orifice has an inner diameter in the range of 0.07 millimeters to 0.7 millimeters.

* * * * *